US010895072B2

(12) United States Patent
McDonald

(10) Patent No.: US 10,895,072 B2
(45) Date of Patent: Jan. 19, 2021

(54) FRAME SYSTEMS FOR BUILDING STRUCTURES

(71) Applicant: ROCKHOUSE INTERNATIONAL PTY LTD, Southport (AU)

(72) Inventor: Douglas Arthur McDonald, Biggera Waters (AU)

(73) Assignee: Rockhouse International Pty Ltd, Southport (AU)

( * ) Notice: Subject to any disclaimer, the term of this patent is extended or adjusted under 35 U.S.C. 154(b) by 38 days.

(21) Appl. No.: 16/180,833

(22) Filed: Nov. 5, 2018

(65) Prior Publication Data

US 2019/0078312 A1 Mar. 14, 2019

Related U.S. Application Data

(63) Continuation of application No. 15/324,725, filed as application No. PCT/AU2015/050381 on Jul. 7, 2015, now Pat. No. 10,151,100.

(30) Foreign Application Priority Data

Jul. 7, 2014 (AU) ..... 2014902604
Jul. 11, 2014 (AU) ..... 2014902687

(51) Int. Cl.
*B21D 5/06* (2006.01)
*E04B 1/19* (2006.01)
(Continued)

(52) U.S. Cl.
CPC ..... *E04B 1/19* (2013.01); *B21D 5/06* (2013.01); *B21D 35/001* (2013.01); *B21D 47/01* (2013.01);
(Continued)

(58) Field of Classification Search
CPC ..... B21D 5/06; B21D 19/00; B21D 19/02; B21D 19/04; B21D 19/043; B21D 19/06;
(Continued)

(56) References Cited

U.S. PATENT DOCUMENTS 1,780,433 A * 11/1930 McGregor ..... B21D 19/08 72/397
2,476,595 A * 7/1949 Green ..... B21D 7/03 72/397
(Continued)

FOREIGN PATENT DOCUMENTS

AU 602119 7/1990
AU 622263 4/1992
(Continued)

OTHER PUBLICATIONS

Partial translation of First Office Action in related Application No. CN 2015800447484 dated Oct. 22, 2018.
(Continued)

*Primary Examiner* — Edward T Tolan
(74) *Attorney, Agent, or Firm* — The Marbury Law Group, PLLC

(57) ABSTRACT

A frame system for a building structure includes beam members. Each beam member includes two opposed, parallel flanges. A web is interposed between the flanges. Spreader members include two opposed, parallel side flanges, a web interposed between the side flanges and two opposed end flanges bridging the side flanges at respective terminal ends of the web. The beam members and the spreader members are configured to be fastened to each other to form a frame assembly.

16 Claims, 37 Drawing Sheets

(51) Int. Cl.

| | |
|---|---|
| ***B21D 47/01*** | (2006.01) |
| ***E04B 1/24*** | (2006.01) |
| ***E04B 5/14*** | (2006.01) |
| ***B21D 35/00*** | (2006.01) |
| ***E04C 3/08*** | (2006.01) |
| ***E04B 1/35*** | (2006.01) |
| ***E04B 2/60*** | (2006.01) |
| ***E04B 5/10*** | (2006.01) |
| ***E04B 7/04*** | (2006.01) |
| ***E04C 3/09*** | (2006.01) |
| ***E04C 3/32*** | (2006.01) |

(52) U.S. Cl.
CPC ..... *E04B 1/24* (2013.01); *E04B 1/2403* (2013.01); *E04B 1/3511* (2013.01); *E04B 1/3527* (2013.01); *E04B 2/60* (2013.01); *E04B 5/10* (2013.01); *E04B 5/14* (2013.01); *E04B 7/04* (2013.01); *E04C 3/083* (2013.01); *E04C 3/09* (2013.01); *E04C 3/32* (2013.01); *E04B 2001/1957* (2013.01); *E04B 2001/2415* (2013.01); *E04B 2001/2418* (2013.01); *E04B 2001/2448* (2013.01); *E04B 2001/2454* (2013.01); *E04B 2001/2457* (2013.01); *E04B 2001/2469* (2013.01); *E04B 2001/3588* (2013.01); *E04B 2103/06* (2013.01)

(58) Field of Classification Search
CPC ..... B21D 19/08; B21D 19/082; B21D 19/10; B21D 47/01; B21D 5/08
See application file for complete search history.

(56) References Cited

U.S. PATENT DOCUMENTS

| | | | | |
|---|---|---|---|---|
| 2,536,643 | A * | 1/1951 | Housdorfer | B21D 7/03 72/397 |
| 2,821,233 | A * | 1/1958 | Wahl | B21D 19/08 72/309 |
| 2,966,873 | A | 1/1961 | Hoffman et al. | |
| 3,243,930 | A | 4/1966 | Slowinski | |
| 3,751,870 | A | 8/1973 | Vesei | |
| 4,520,646 | A * | 6/1985 | Pauzin | B21D 5/045 72/313 |
| 4,720,956 | A | 1/1988 | Wiklund | |
| 4,875,274 | A | 10/1989 | Foster | |
| 5,271,256 | A * | 12/1993 | Hedrick | B21D 35/00 72/307 |
| 7,765,771 | B2 | 8/2010 | Serpico et al. | |
| 8,572,906 | B2 | 11/2013 | Nakamura | |
| 8,688,411 | B2 | 4/2014 | Vanker et al. | |
| 2002/0035815 | A1 | 3/2002 | Daudet et al. | |
| 2003/0213194 | A1 | 11/2003 | Kawai et al. | |
| 2004/0144057 | A1 | 7/2004 | Meek et al. | |
| 2006/0185312 | A1 | 8/2006 | Weeks | |
| 2007/0277463 | A1 | 12/2007 | Helrich | |
| 2008/0048366 | A1 * | 2/2008 | Durney | B21D 5/04 264/339 |
| 2011/0252856 | A1 * | 10/2011 | Matsuda | B21D 22/022 72/364 |
| 2015/0267393 | A1 | 9/2015 | Bovet | |
| 2015/0275500 | A1 | 10/2015 | Dalla et al. | |
| 2015/0322675 | A1 | 11/2015 | Shih | |
| 2016/0024779 | A1 | 1/2016 | Clus et al. | |
| 2017/0081852 | A1 | 3/2017 | Nanayakkara | |

FOREIGN PATENT DOCUMENTS

| | | |
|---|---|---|
| AU | 640566 | 8/1993 |
| AU | 2006 200 728 A1 | 9/2006 |
| CA | 2643248 | 5/2010 |
| EP | 1514974 A1 | 3/2005 |
| JP | 2014-4618 A | 1/2014 |
| WO | 2006/069435 A1 | 7/2006 |

OTHER PUBLICATIONS

Extended European Search Report from the European Patent Office in related Application No. 15819176.7-1005 / 3186455 based on PCT/AU2015/050381 dated Feb. 13, 2018.

* cited by examiner 20
29
16
9
14
20
43
131
21

16
12
125
9
14
131
125
20
43
21

Typical 5 Grid x 4 Grid Assembly

General arrangement of columns & frames

2 Columns external corner (external view)

2 Columns external corner (internal view)

2 Columns external corner (plan view)

1 Column internal corner (plan view)

1 Column internal corner (pictorial view)

2 Columns internal corner (plan view)
Single Beam
Double 'C' Spreader
Single Spreader 1 Column external (external view)

1 Column external (internal view)
Double 'C' Beam

VARIOUS TYPES OF COLUMN MOUNTINGS

EXTERNAL VIEW: TYPICAL FIRST FLOOR COLUMN CONNECTION SHOWING THE SPLICE PLATES

INTERNAL VIEW: TYPICAL FIRST FLOOR COLUMN CONNECTION SHOWING INTERNAL GUSSET

JACK: Closed condition
Showing the upper grid in place on the upper housing of the jack, with the upper keepers in place JACK: Closed condition
seated on the top face of a lower grid

JACK EXTENDED

FIGURE 3: COLUMN

ENLARGED STAGE 2:
SHEET 1

STAGE 1: BLANK IN DIE SPACE FOR TOP DIE TO CLOSE

STAGE 2: TOP DIE CLOSED

STAGE 4: PLUNGER DOWN

STAGE 5: PLUNGER UP

STAGE 3: FLIPPER DOWN

SHEET 2

STAGE 7: TAIL ARM OUT (NORMAL POSITION)

STAGE 6: TAIL ARM IN

STAGE 9: END PUNCH OUT (NORMAL POSITION)

ITEM 9 NOT SHOWN FOR CLARITY

STAGE 8: END PUNCH IN

SHEET 4

STAGE 11: TOP DIE OPEN
FLIPPERS UP
PART EJECTED FROM DIE

STAGE 10: TOP DIE OPEN
FLIPPERS STILL DOWN

SHEET 5

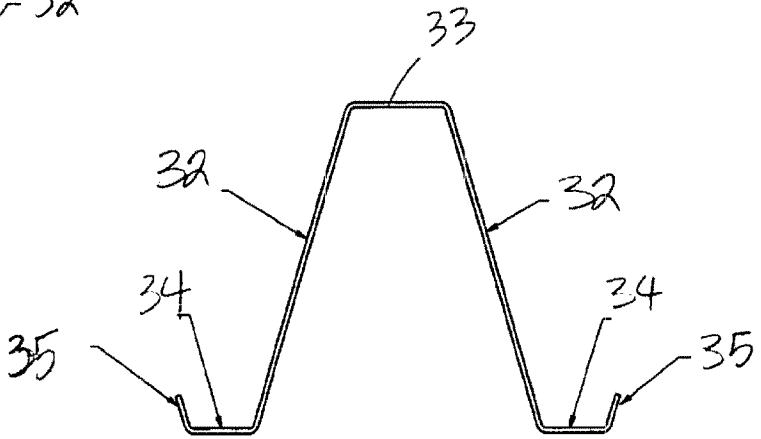
FIG 83
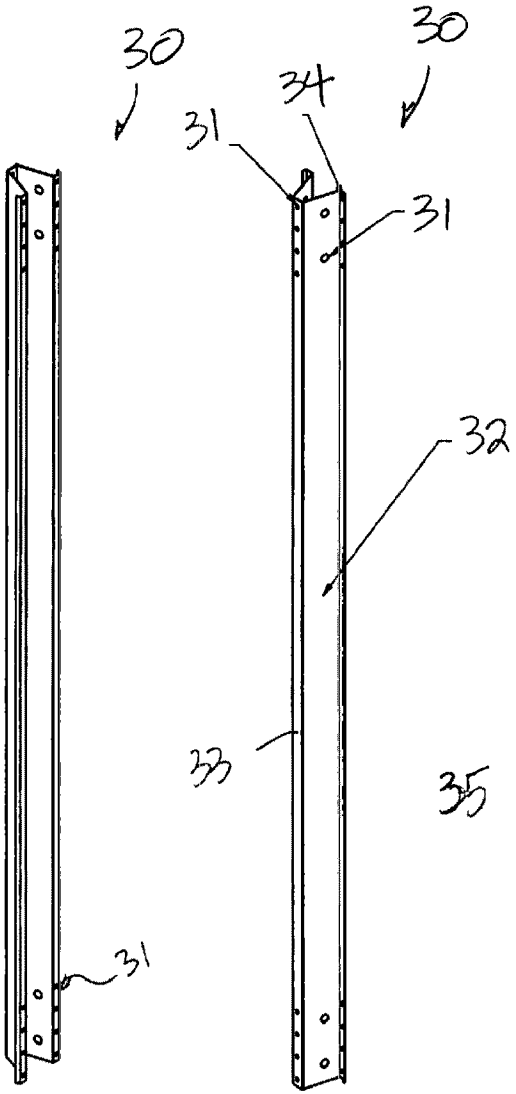
FIG 82
FIG 81

Flipper in the down position after the drawing process

Flipper in the up position before drawing process

FRAME SYSTEMS FOR BUILDING STRUCTURES

RELATED APPLICATIONS

This application is a continuation of U.S. patent application Ser. No. 15/324,725 filed Jan. 8, 2017, which is a U.S. National Stage application under 35 U.S.C. § 371 of PCT Application PCT/AU2015/050381 filed Jul. 7, 2015, which claimed the benefit of Australian patent application numbers 2014902604 and 2014902687 filed on 7 Jul. 2014 and 11 Jul. 2014, respectively. The entire contents of each of these priority applications, including the subject matter disclosed in the specifications and drawings, are hereby incorporated herein by reference.

TECHNICAL FIELD

Various embodiments of frame systems suitable for building structures such as housing and commercial buildings are described. Various embodiments of forming machines for forming structural members for the frame systems and methods of forming the frame systems are described.

SUMMARY

Various exemplary embodiments of a frame system for a building structure include: beam members, each beam member including two opposed, parallel flanges; and a web interposed between the flanges and spreader members, each spreader member including two opposed, parallel side flanges, a web interposed between the side flanges, and two opposed end flanges bridging the side flanges at respective terminal ends of the web, wherein the beam members and the spreader members are configured to be fastened to each other to form a frame assembly.

At least one end portion of each spreader member may have a length that is greater than a depth of the flanges of the beam members and may be of a reduced width to permit the end portion to fit and to extend between the flanges of the beam members.

The at least one end portion of each spreader member may have a reduced width such that the at least one end portion can fit between the flanges of the beam members with the flanges of the beam members and the spreader members being substantially co-planar so that the frame system can define a planar support surface.

The at least one end portion may be of a reduced width to an extent that is substantially equivalent to twice a thickness of a material of the beam members.

The beam member and the spreader member may be the products of at least a punching and folding operation carried out on lengths of sheet steel.

The side flanges of the spreader member may be bent to define the at least one end portion.

The end flanges of the spreader member may be bent to define inwardly extending zones that accommodate tabs extending from the side flanges, such that the end flanges and the tabs present a substantially flat surface so that the end flanges can be fastened directly to the webs of the beam members without the use of washers or packing.

The webs of the beam and spreader members may define apertures or openings for accommodating services for a building.

The frame system may include pairs of beam members arranged with abutting webs, wherein the beam pairs are arranged into a spaced apart, parallel array, and wherein adjacent beam pairs are bridged by an array of spaced apart, parallel spreader members.

The spreader members may include at least one pair of spreader members arranged with abutting webs.

Various exemplary embodiments of a method of building comprise fastening the beam and spreader members together to form the frame system.

The method may comprise:

- forming two or more of the frame systems on a substrate, one on top of the other, such that a lowermost frame system defines a ground floor assembly and an uppermost frame system defines a roof assembly;
- erecting a roof structure on the uppermost frame system while the uppermost frame system remains on one of the ground floor assembly and an intermediate floor assembly; and
- lifting at least the uppermost frame system to define at least one floor level of the building structure.

The method may comprise forming the beam and spreader members by carrying out reciprocal forming and shaping operations on metal sheet.

Each spreader member may be formed by carrying out the following operations on a length of metal sheet:

- punching the sheet to form apertures and notches or cuts in the sheet;
- folding sides of the sheet to form side flanges;
- folding ends of the sheet to form opposed end flanges; and
- folding tabs extending from the side flanges over the end flanges.

The above operation could also be carried out so that the opposed end flanges are folded over to cover the tabs.

The step of folding the sides of the sheet may be carried out so that at least one end portion of the resultant spreader member has a length that is greater than a depth of the flanges of the beam members and is of a reduced width to permit the end portion to fit and to extend between the flanges of the beam members.

The step of folding the sides of the sheet may be carried out so that the at least one end portion can fit between the flanges of the beam members with the flanges of the beam members and the spreader members being substantially co-planar.

The reciprocal forming and shaping operations may be carried out by a forming machine that is located at a building site at which the building structure is to be built.

Various exemplary embodiments of a building structure comprise:

at least two frame systems as described above.

One of the frame systems may be a ground floor assembly supported on a base and another of the frame systems may be a roof assembly supported above the ground floor assembly, such that at least one floor level is defined between the ground floor assembly and the roof assembly.

Various exemplary embodiments of a forming machine for forming a spreader member of a frame system for a building structure comprise

- a base;
- a platform positioned above the base;
- a top die arranged on the platform;
- a bottom die supported by the base and operatively arranged with respect to the top die, the top and bottom dies being reciprocally displaceable relative to each other to punch apertures and notches or cuts in the sheet;
- two side flange formers arranged on the base, one on each side of the bottom die, for forming parallel side flanges of the spreader member, the flange former being capable of horizontal and vertical actuation;

two end flange formers arranged on the base, one at each end of the bottom die, for forming parallel end flanges of the spreader member, the end flange formers incapable of horizontal and vertical actuation; and actuators arranged on the base and the platform and operatively engaged with the flange formers, the actuators being configured for operation such that the side flange formers can fold sides of the metal sheet to form the side flanges and the end flange formers can fold ends of the metal sheet to form the end flanges.

The side flange formers may incorporate a die former that is shaped so that, upon operation of the side flange formers, the die formers can carry out an operation on the sides of the metal sheet retained between the top and bottom dies to bend the side flanges so that at least one end portion of the spreader member has a reduced width.

The end flange formers may incorporate a die former that is shaped so that, upon operation of the end flange formers, the die formers can carry out an operation on the ends of the metal sheet so that a resultant end flange of the spreader member has inwardly extending zones to accommodate tabs that extend from the side flanges such that, when the tabs are folded inwardly, the end flanges and the tabs present a substantially flat surface.

BRIEF DESCRIPTION OF DRAWINGS

FIGS. 56 to 58 show, consecutively, three stages in the construction of a floor assembly between floors of a building.

FIG. 67 is a detail view of the forming machine during a second stage of operation thereof.

FIG. 68 is a detail view of the forming machine during a third stage of operation thereof.

FIG. 69 is a detail view of the forming machine during a fourth stage of operation thereof.

FIG. 78 is an isometric view of a forming machine for forming the beam member of FIGS. 1 and 2.

FIG. 81 is a three-dimensional view, from one side, of a column member of FIG. 5.

FIG. 82 is a three-dimensional view, from another side, of the column member.

FIG. 83 is an end view of the column member.

FIGS. 92 to 94 show different views of a punching station for punching holes or openings into a blank that is to be formed into the column member.

DESCRIPTION OF EMBODIMENTS

Figures 1, 2, 3, 4, 5, 6, 7, 8:
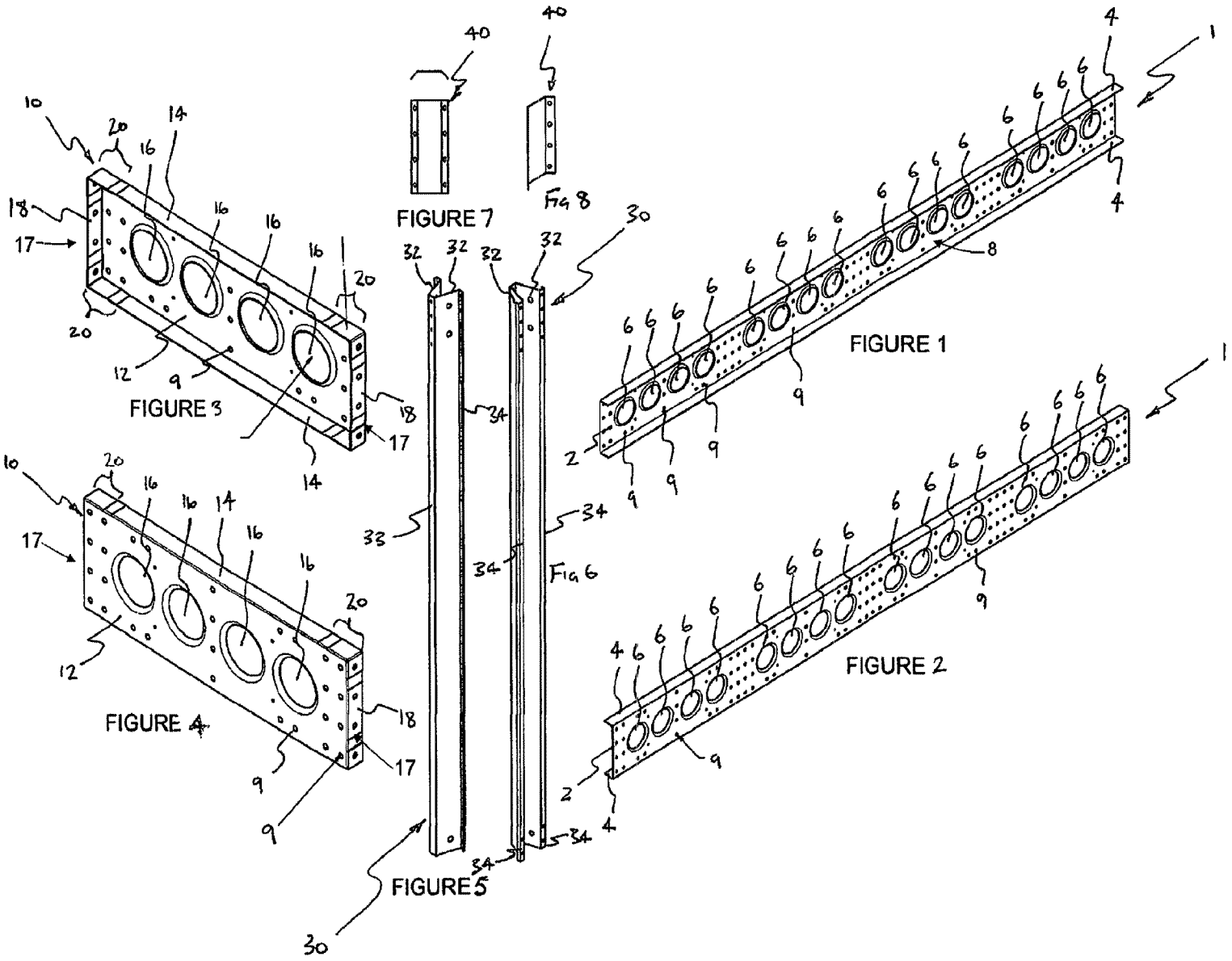
FIGS. 1 and 2 are isometric views of a beam member for an exemplary embodiment of a frame system for a building structure.
FIGS. 3 and 4 are isometric views of a spreader member for an exemplary embodiment of a frame system for use with the building structure.
FIGS. 5 and 6 are isometric views of a column member for an exemplary embodiment of a frame system for use with a building structure.
FIG. 7 is a front view of a cleat or splice member.
FIG. 8 is an isometric view of the splice member of FIG. 7.

In the following description, like reference characters designate like or corresponding parts throughout the figures. However, use of common reference characters is for convenience only and is not to be construed as identifying a component of one embodiment as being essential to any other embodiment. Furthermore, it is to be understood that, where practical, the following description describes further embodiments comprising combinations of components drawn from different embodiments.

Referring to FIGS. 1 and 2, reference numeral 1 generally indicates an exemplary embodiment of a beam member 1 of a frame system for a building structure. The beam member 1 comprises a parallel flange channel section comprising a web 2 bridging two parallel flanges 4, and an array of through-apertures or openings in the form of service openings or holes 6 spaced lengthwise along the web 2. The holes 6 are dimensioned so that, in use in the frame system, for example as a floor or roof assembly, wiring and pipework can be passed through the holes 6. The beam member 1 is open between the parallel flanges 4 to define a C-channel 8.

Referring to FIGS. 3 and 4, reference numeral 10 generally indicates an exemplary embodiment of a spreader member or spreader 10. The spreader 10 comprises a parallel flange channel section comprising a web 12 bridging two parallel side flanges 14, and an array of through-apertures in the form of service openings or holes 16 spaced lengthwise along the web 12. The holes 16 are dimensioned so that, in use in a base or floor assembly, wiring and pipework can be passed through the holes 16.

The spreader member 10 is shorter than the beam member 1. The spreader member 10 has a parallel end flanges 18 extending between or bridging the side flanges 14 at each terminal end 17 of the member 10. Opposed end portions 20 of the spreader 10 are sized to fit snugly between the parallel flanges 4 of the beam member 1. In other words, a width of the spreader 10 is reduced at the portions 20 so that the portions 20 can fit snugly between the parallel flanges 4 without the use of packing to take up any play. The width of the spreader 10 measured between the external sides of the parallel flanges 14 is substantially the same as the width of the channel 8 measured between facing sides of the parallel flanges 4. An extent of reduction of the spreader 10 at the portions 20 corresponds with twice the thickness of the material used for the beam member 1. Thus, when the portions 20 fit between the flanges 4, external faces of the remaining portions of the spreader 10 are flush with external faces of the flanges 4. Further detail of the spreader 10 can be seen in FIGS. 9 and 10. As a result, a structure, for example a floor made up of planar floorboards or members can be positioned on the spreader and beam members without the need for packing to take up any space between the floorboards or members and the spreader and beam members.

The end flanges 18 also define portions 21 that are folded or bent inwardly to define inwardly extending zones or recesses that accommodate tabs 23 that extend from the side flanges and are folded over when the spreader is formed. The extent of the inward folding of the portions 21 is such that external faces of the tabs 23 are flush with an external surface of a remaining portion of the end flange 18. Thus, when the portions 20 are positioned between the flanges 4, the end flange 18 can butt against an internal surface of the web 2 of the beam member 1. This allows the web 2 to be fastened to the end flange 18 without the use of packing or washers.

It follows that the length of the portions 20 is such that the flange 18 can butt or be brought to bear against the web 2.

Both the spreader member 10 and the beam member 1 share the same sectional depth. In use, end flanges 18 of the spreader member 10 enter the channel 8 of the beam member 1 between the flanges 4 of the beam member 1 to span the web 2 or to bridge or extend between the flanges 4.

The web 12 of the spreader member 10 defines a plurality of openings 9. These can be used for fastening the beam members 1 to the spreaders 10 and for other purposes which are described below.

Referring to FIGS. 5 and 6, reference numeral 30 generally indicates an exemplary embodiment of a column member 30. The column member 30 is generally truncated-"A"-shaped in transverse cross section. The column member 30 comprises a pair of converging walls 32 converging at a flat strip or cap 33 interposed between the walls 32. Each of the walls 32 terminates at an edge from which there extends a foot or flange 34. The flanges 34 are substantially parallel with angled outturns 35 (FIG. 83). The column member 30 has an array of bolt holes 31 in the cap 33, walls 32 and flanges 34. See for example FIGS. 54 and 55 where these bolt holes are used.

A building frame arrangement or system 62 (FIG. 12) consists of three main elements, a 'C' formed member with open ends (i.e. the beam member 1), a 'C' formed member with integral cleats or closed ends (i.e. the spreader 10) and a substantially truncated 'A' formed member with open ends (i.e. the column member 30). All of these components can be formed from a sheet of steel fed from a roll of stock or coil. Alternatively, the components can be formed from sheet stock. For example, the components can use pre-sheeted steel coil or can be enabled to run from slit coil according to a required width of the respective component. Furthermore, widths of the material used for the components can either be the same or can vary with respect to each other depending on structural requirements.

Figure 11:
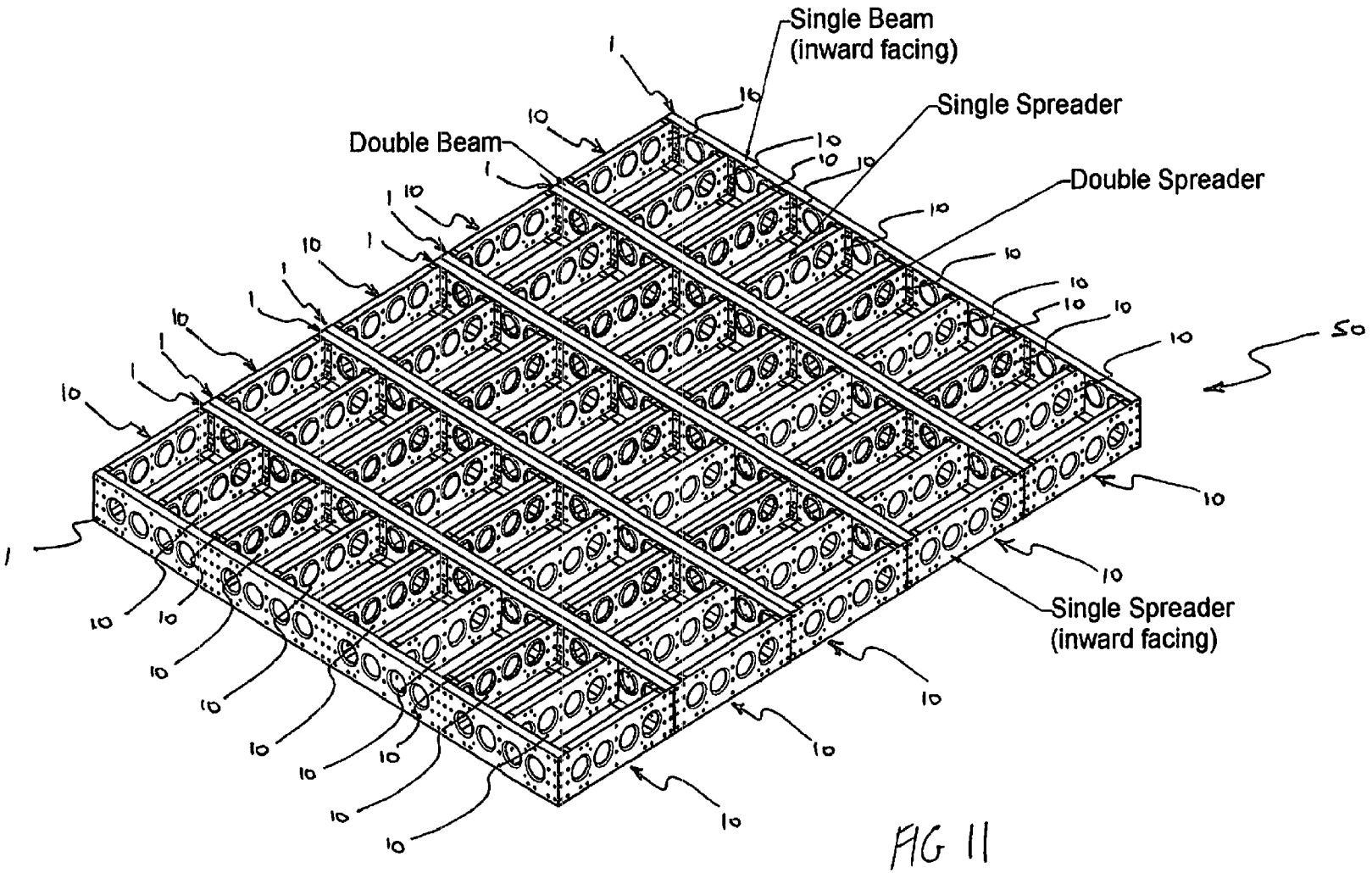
FIG. 11 is an isometric view of the frame system comprised of the beam and spreader members.

Referring to FIG. 11, reference numeral 50 generally indicates an exemplary embodiment of a frame assembly of the building frame system 62. The frame assembly 50 comprises pairs of beam members 1 arranged with webs 2 abutting in a back-to-back arrangement and end beam members 1 with webs 2 facing inwardly. The beam member 1 pairings are arranged into a spaced apart parallel array. Adjacent beam member pairings are bridged by an array of spaced apart parallel spreaders 10 to form a grid arrangement. The beam members 1 and spreaders 10 are bolted together via the bolt holes 9 provided in the beam member 1 and the spreader 10. At select locations of the frame assembly 50, the spreaders 10 are arranged into pairs with abutting webs 12 in a back-to-back arrangement. End flanges 18 of each spreader 10 fit into respective channels 8 of facing beam members 1 to butt or bear against the webs 12 of the beam members 1 as described above. The spreaders 10 are fixed to the beam members 1 by bolts that extend through the bolt holes in the webs 12 of the beam members 1 and the end flanges 18 of the spreader members 10.

The spreaders 10 as well as the beam members 1 are placed back to back to form a double 'C' or 'I' shape in order to improve their load bearing capacity. To better explain and understand the co-operation of the spreaders 10, beam members 1 and column members 30, it may be taken that the spreader 10 is one grid-length and the beam member is (but is not restricted to) four grid-lengths. A length of the column member 30, although not restricted, is set to comply with the most commonly available materials for paneling and walling. In every respect other than those already stated, the features (hole sets) for fasteners and general access holes within each grid of each member are substantially the same. This allows for the spreader member 10 to be positioned in a 'C' or double 'C' (or 'I' shape) arrangement along the length of the beam member 1 at regular repeating grid-length intervals and fixedly located with bolts or other methods as deemed suitable or appropriate.

In some cases, it may be necessary to comply with jurisdictional building codes. Thus, as shown in FIG. 11, further single spreaders 10 can be interposed between the beam members 1 to reduce grid size.

Figure 12:
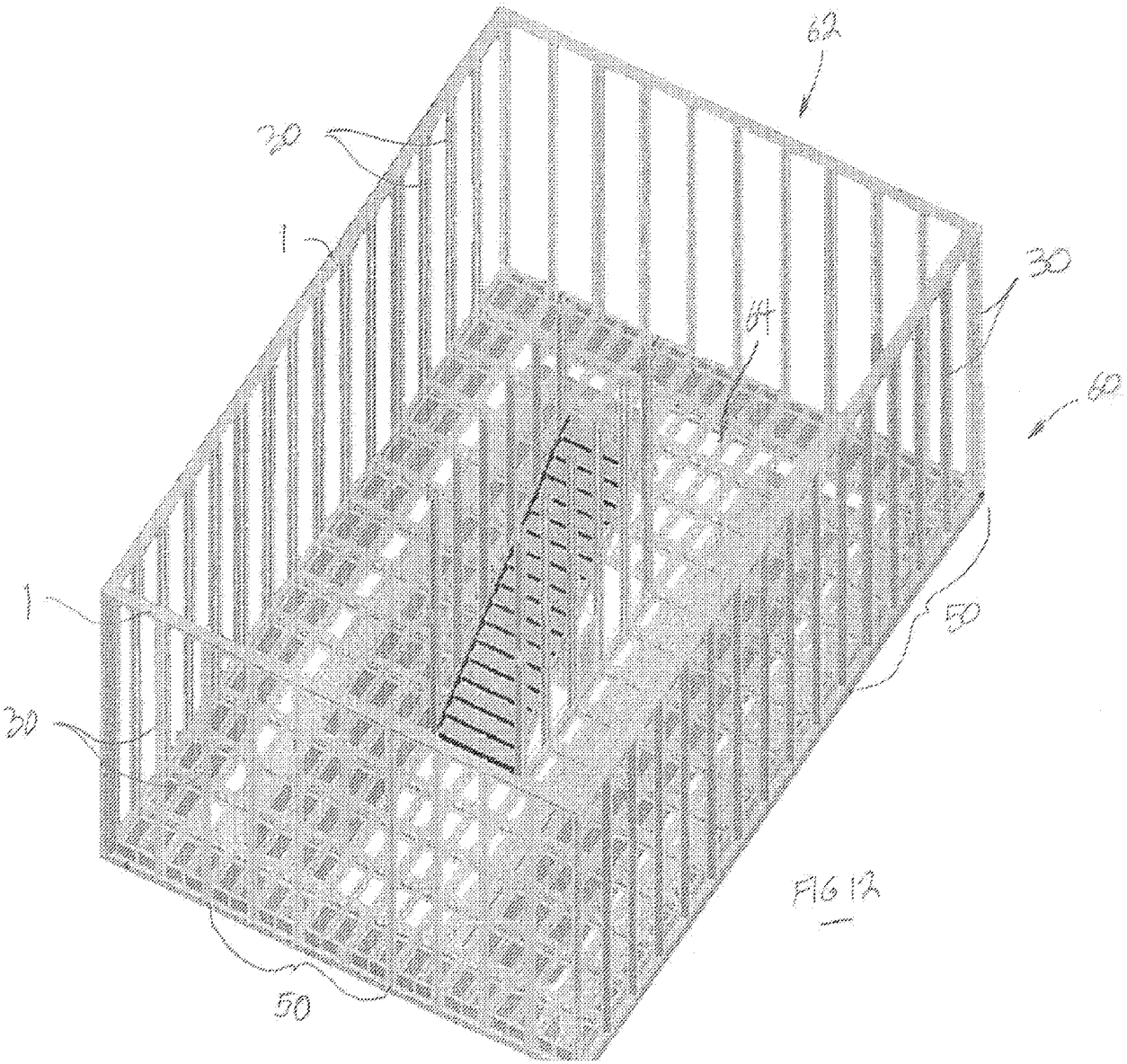
FIG. 12 is an isometric view of a building frame assembly comprised of the beam, spreader, column and cleat members of FIGS. 1 through 10.

Referring to FIG. 12, a floor assembly 60 for a first floor of a building or dwelling includes a plurality of the frame assemblies 50 arranged side by side and bolted together. The floor assembly 60 sits on top of, and is bolted to a substrate such as a building foundation, footing or plinth 64. A plurality of equi-spaced column members 30 is bolted to a periphery of the floor assembly 60, and extends vertically upwards from the floor assembly 60.

Figure 13:
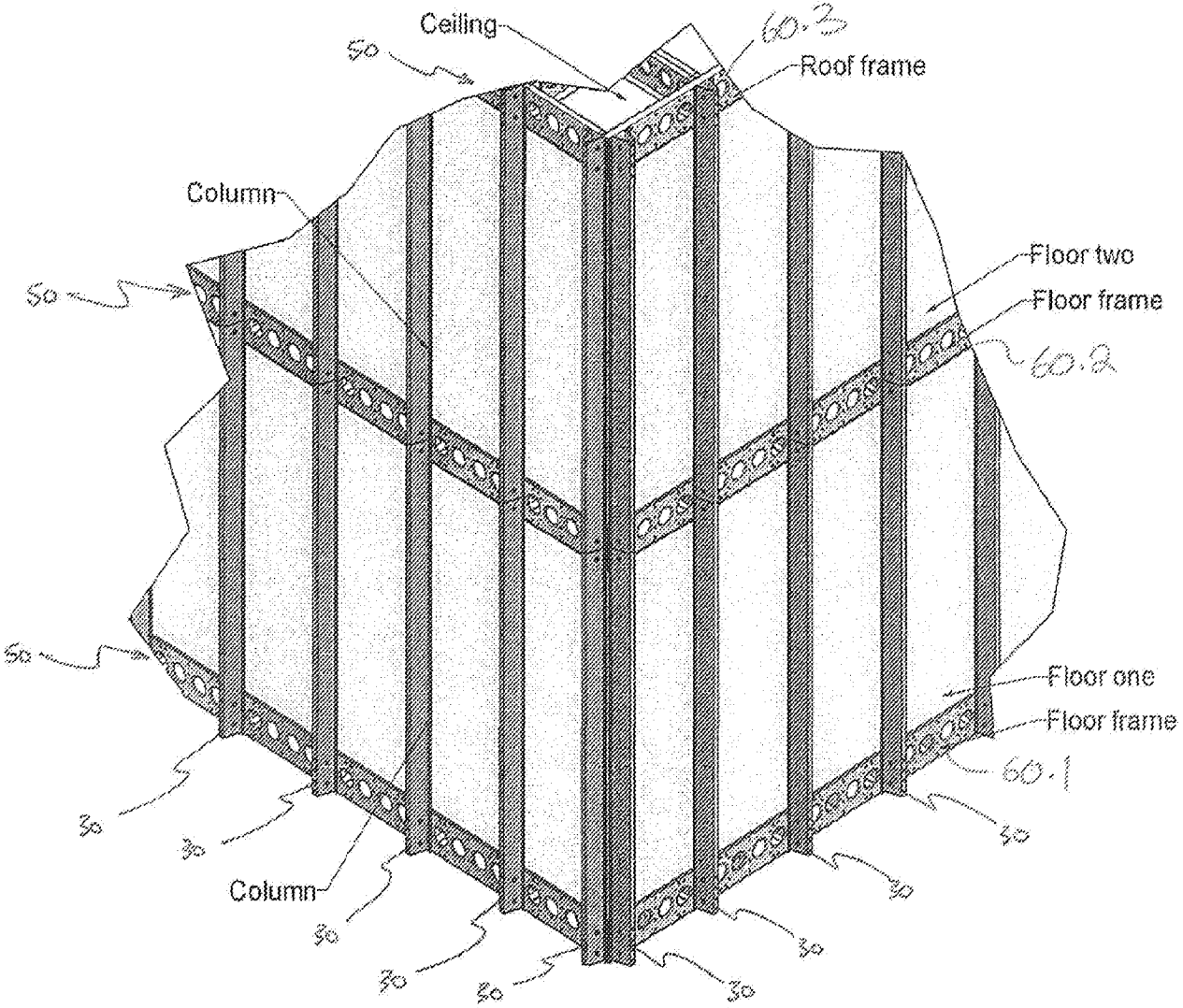
FIG. 13 is a detail view of a corner of a building frame assembly.

With reference to FIG. 13, it can be seen that a plurality (in this case three) of the floor assemblies 60 are horizontally disposed and vertically spaced by a plurality of column members 30. In this way, a lowermost floor assembly 60.1 can support a ground floor of a building, an intermediate floor assembly 60.2 can support a first floor of the building, and an uppermost floor assembly or roof frame assembly 60.3 can support a ceiling and/or a roof of the building.

Figures 14, 15, 16, 17, 18, 19, 20, 21:
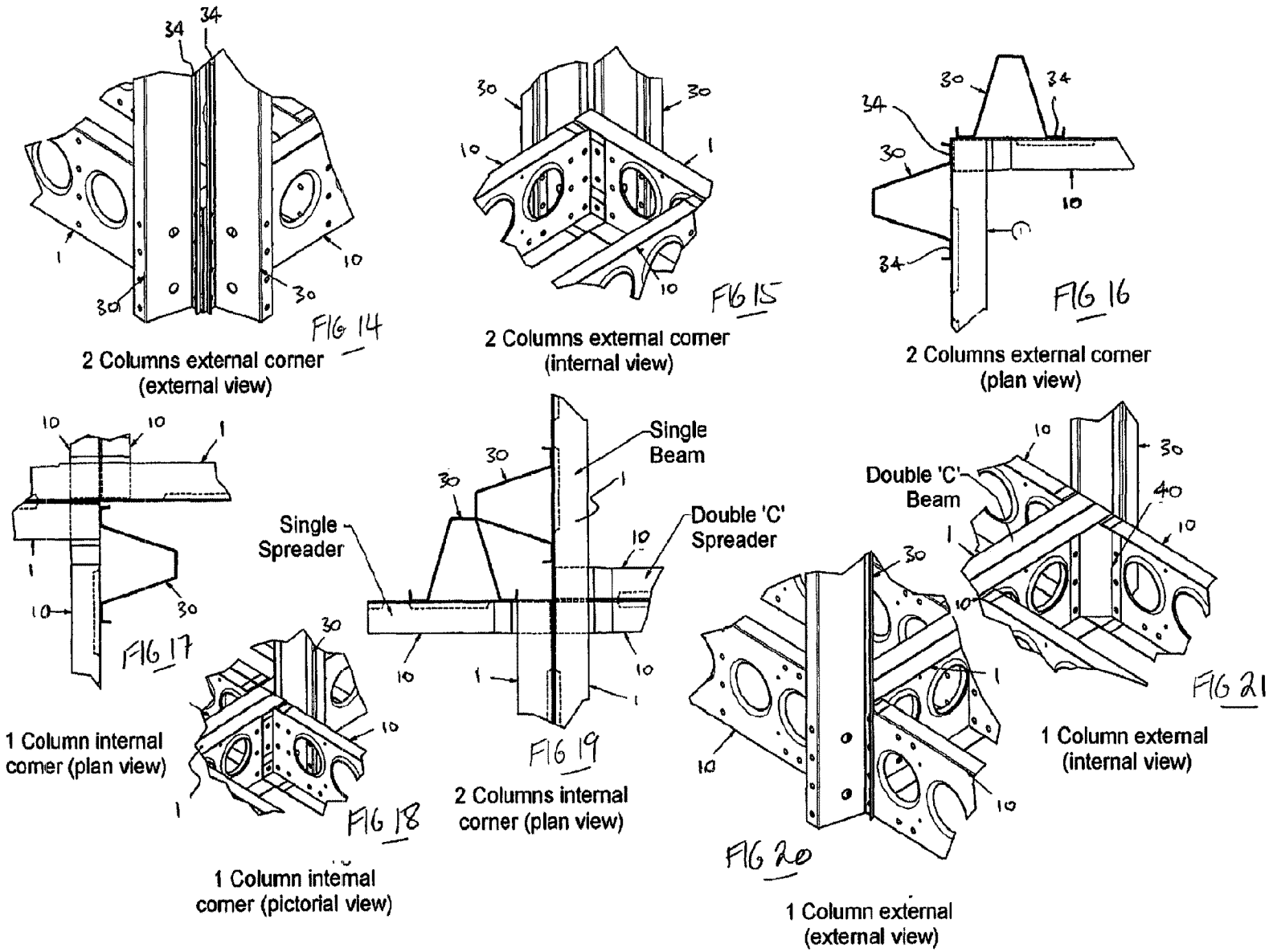
FIG. 14 is an external view of a corner of a base of the building frame assembly of FIG. 13.
FIG. 15 is an internal view of the corner of FIG. 13.
FIG. 16 is a plan view of the corner of FIG. 13.
FIG. 17 is a plan view of an internal corner of the base of the building frame assembly of FIG. 12.
FIG. 18 is an isometric view of the internal corner of FIG. 15.
FIG. 19 is a plan view of a further internal corner of the base of the building frame of FIG. 10.
FIG. 20 is an external view of an attachment point between the base and a column.
FIG. 21 is an internal view of the attachment point of FIG. 20.
Figure 23:
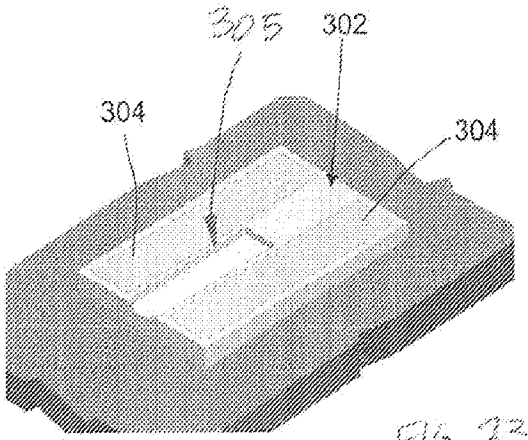
FIG. 23 is an isometric view of the concrete footing of FIG. 22 including thermal masses.

FIGS. 14 to 16 illustrate the formation of an external corner of a frame assembly 50 for a floor assembly 60 by bolting together a beam member 1 and a spreader member 10. Respective column members 30 are bolted through the holes 31 in the flanges 34 thereof to the beam member 1 and the spreader member 10 via a matching pattern of the holes in each.

FIGS. 17 and 18 illustrate the formation of an internal corner of a frame assembly 50 for a floor assembly 60. Beam members 1 are bolted to spreader members 10. A column member 30 is bolted through flanges 34 thereof to one of the spreader members 10, via a matching pattern of holes in each.

FIG. 19 illustrates the formation of an internal corner of a frame assembly 50 for a floor assembly 60 by bolting together beam members 1 and spreader members 10. Column members 30 are then bolted through flanges 34 thereof to the beam member 1 and the spreader member 10 via a matching pattern of holes in each.

FIGS. 20 and 21 illustrate the formation of an external edge of a frame assembly 50 for a floor assembly 60 by bolting together a beam member 1 and a spreader member 10. Column members 30 are then bolted through flanges 34 thereof to two spreader members 10 via a matching pattern of holes in each. FIG. 19 further illustrates a cleat or gusset plate 40 stiffening an internal corner between a beam member 1 and a spreader member 10.

The facility of the single or double 'C' arrangement for both spreader members 10 and beam members 1 allows any platform of any size to terminate at its perimeter with an inward facing 'C'. This in turn allows a column member 30 to be attached at or around the junction of any grid interval. It also permits a column member 30 to be placed anywhere within a platform that has or is provided with a single 'C' form for attachment. Moreover, as previously noted, the commonality of the holes set out within the grids of the spreader members 10, beam members 1, and the column members 30, also provides the facility to fix grids at ninety degrees to each other as well as laterally and even vertically displace them to provide upper levels (such as upper floors and roof structures).

The attributes common to the spreader member 10 and the beam member 1 mean that, however they are configured, they provide access for ducting to convey air from the air handler throughout the structure.

Constructing a Building Structure

FIGS. 22 to 45 show the steps of constructing a double story building structure 300 including three floor assemblies 60 and column members 30.

Figure 22:
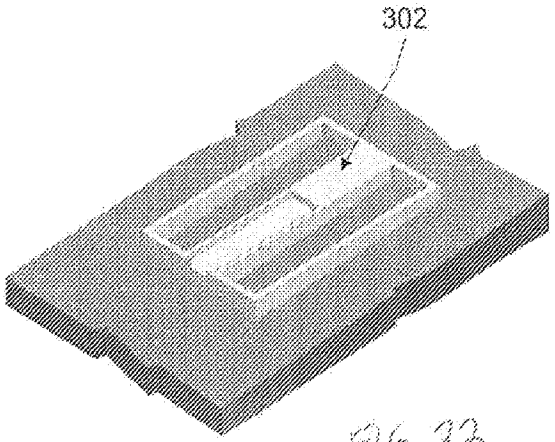
FIG. 22 is an isometric view of a concrete footing of a building structure.

FIG. 22 shows a concrete footing 302 of the building structure 300. The footing 302 may include heated thermal masses 304, shown in FIG. 21, for climate control of the building structure 300. The footing 302 also includes a passage formation 305 for the distribution of treated air from the thermal masses 304 throughout the structure 300.

Figure 25:
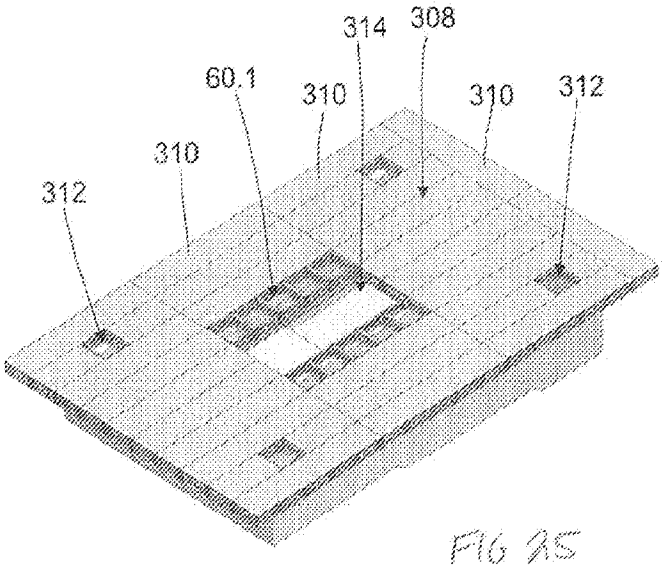
FIG. 25 is an isometric view of a first floor resting on the first floor assembly of FIG. 24.
Figure 24:
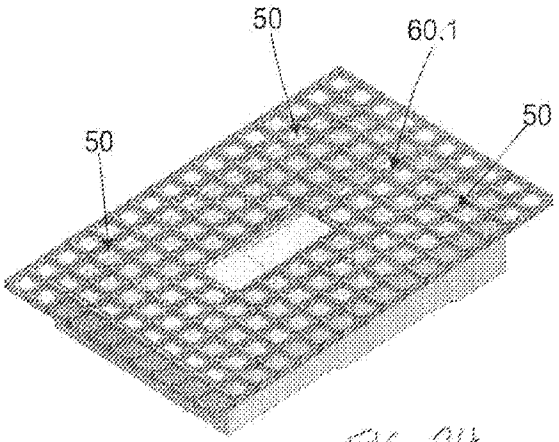
FIG. 24 is an isometric view of a first floor assembly supported on the footing of FIG. 23.

Referring to FIG. 24, a number of frame assemblies 50 are assembled on the footing 302 to form a first floor assembly 60.1. The first floor assembly 60.1 may be bolted or otherwise fixed to the footing 302. Floor panels 310 are placed on top of the first floor assembly 60.1 to form a first floor 308 as shown in FIG. 25. Four gaps or openings 312 are left in the floor 308 to provide access to jacks to rest directly on the footing 302 or to be bolted to the first floor assembly 60.1, as described below. A central gap or opening 314 is provided in the floor 308 for a staircase.

Figure 26:
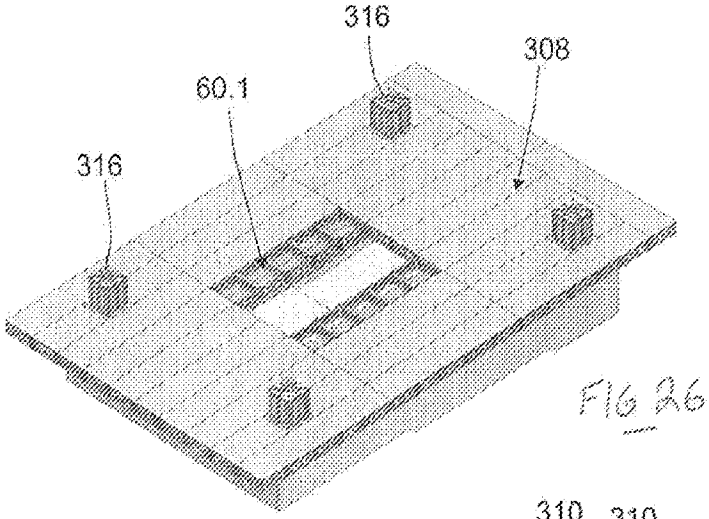
FIG. 26 is an isometric view of jacks supported by the first floor assembly of FIG. 24.

FIG. 26 shows the jacks 316 supported by the footing 302 and extending through the openings 312 in the first floor 308. The foot of each jack 316 rests on the footing 302 or is bolted to the first floor assembly 60.1.

In the drawings, there are shown four jacks for each floor level. However, it will readily be appreciated that any number of jacks could be used, depending on the area of each floor level. For example, in some cases three jacks could be used and in other cases more than four could be used.

Figure 27:
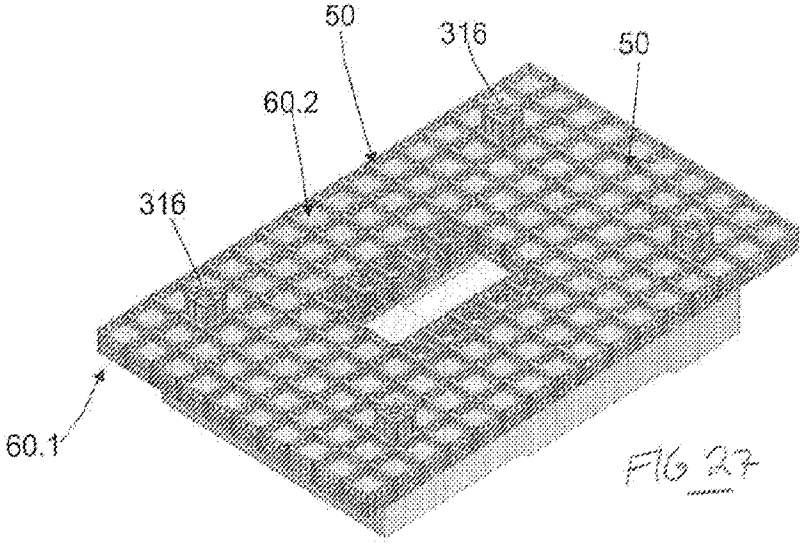
FIG. 27 is an isometric view of a second floor assembly supported on the first floor of FIG. 26.

Referring to FIG. 27, a number of frame assemblies 50 are assembled on the first floor 308 to form a second floor assembly 60.2.

Figure 28:
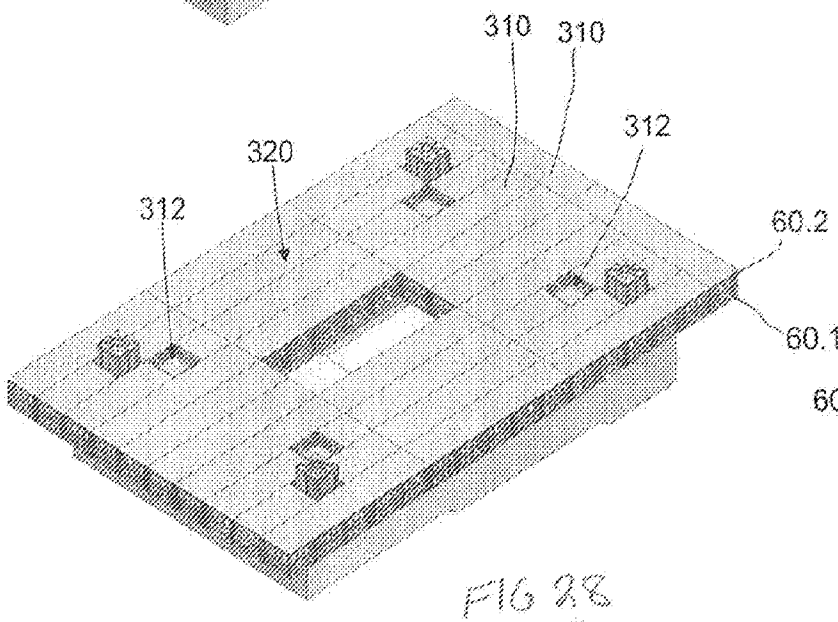
FIG. 28 is an isometric view of a second floor resting on the second floor assembly of FIG. 27.

Floor panels 310 are placed on top of the second floor assembly 60.2 to form a second floor 320 as shown in FIG. 28. Four gaps or openings 312 are left in the floor 320 to provide access for jacks 322 to be bolted to the second floor assembly 60.2. A central gap or opening 314 is provided in the floor 320 for the staircase (FIG. 29).

Figure 29:
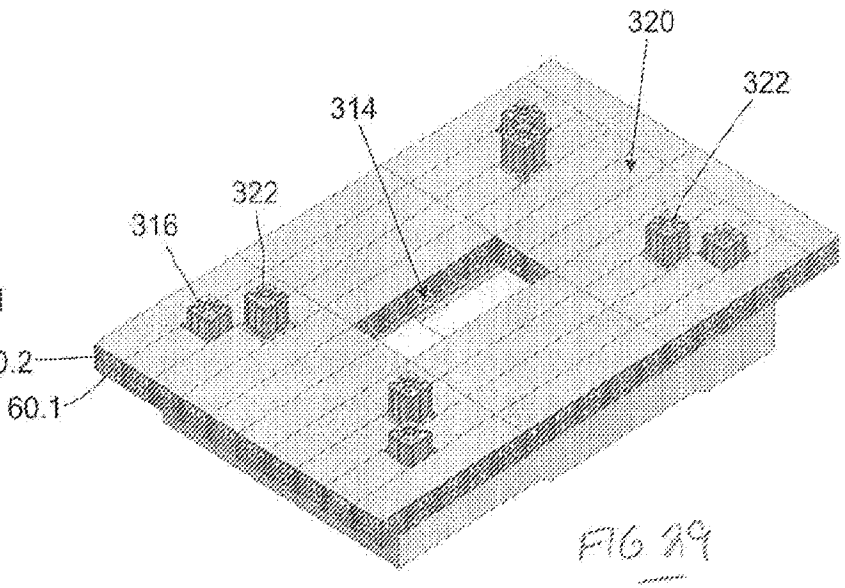
FIG. 29 is an isometric view of jacks supported by the second floor assembly of FIG. 27.

FIG. 29 shows the jacks 322 fixed to the second floor assembly 60.2 and extending through the openings 312 in the second floor 320. The foot of each jack 322 is bolted or otherwise fixed to the second floor assembly 60.2.

Figure 30:
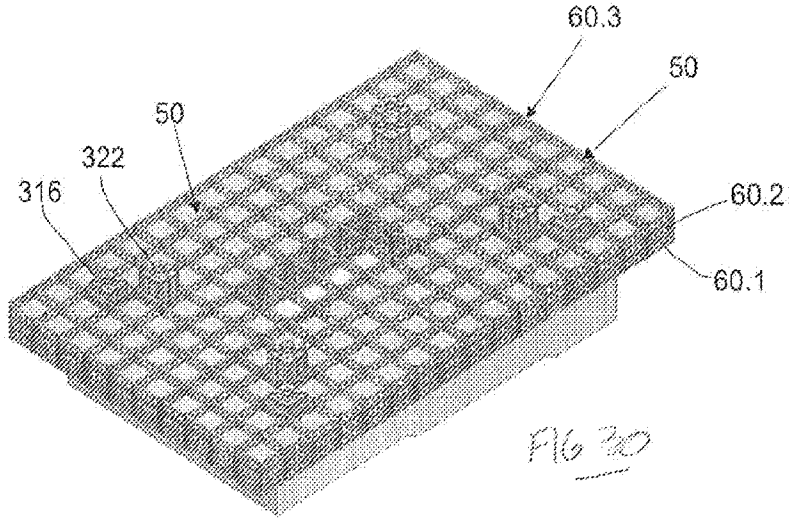
FIG. 30 is an isometric view of a roof frame assembly supported on the second floor of FIG. 28.

Referring to FIG. 30, a number of frame assemblies 50 are assembled on the second floor 320 to form a third floor assembly 60.3.

Figure 31:
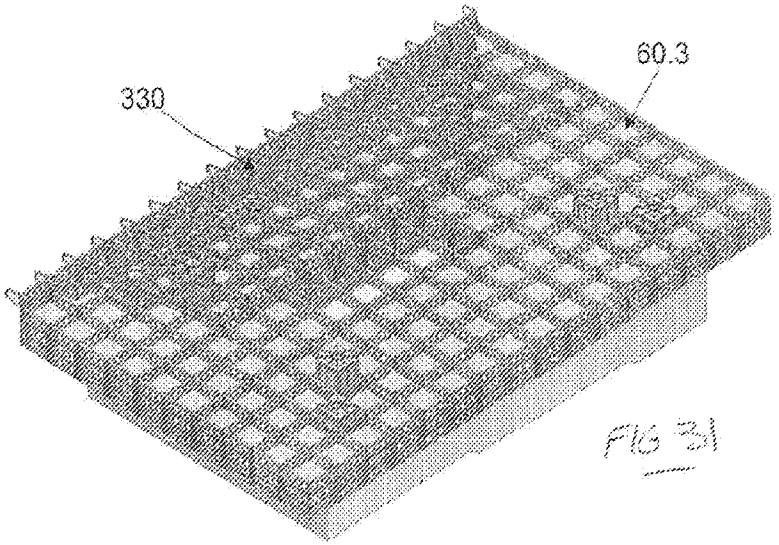
FIG. 31 is an isometric view of a part of roof structure supported by the roof frame assembly of FIG. 30.
Figure 32:
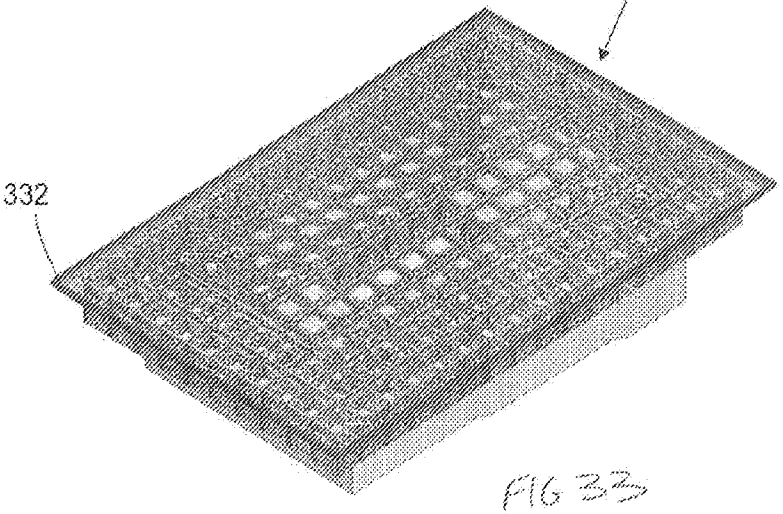
FIG. 32 is an isometric view of the completed roof structure of FIG. 31.
Figure 33:
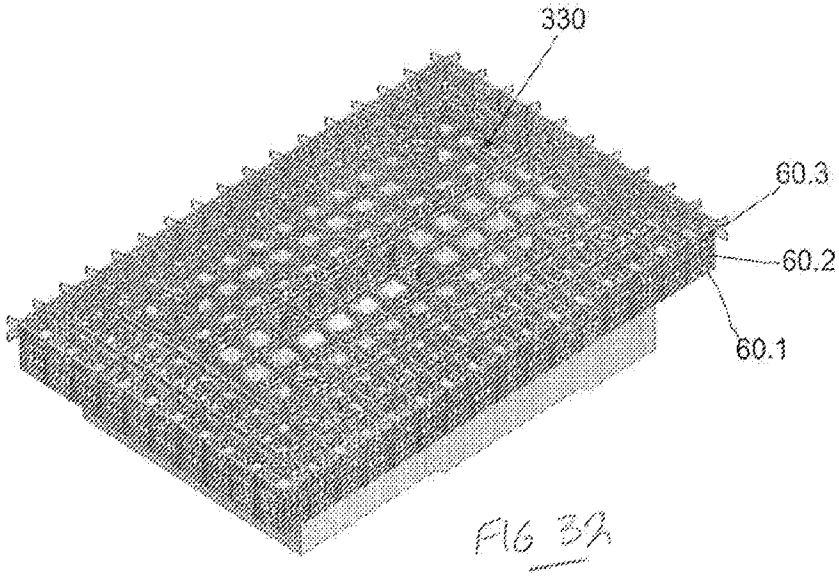
FIG. 33 is an isometric view of the roof structure of FIG. 32 including gutters.

FIG. 31 shows part of a roof framework 330 assembled using beam members 1 and spreader members 10 bolted together. The roof framework 330 is fixed to and supported by the roof frame assembly 60.3. FIG. 32 shows the completed roof framework 330. FIG. 33 shows the roof framework 330 with barge boards and gutters 332 fixed to the framework 330. Assembling the roof structure 330 is made easier and safer by the roof frame assembly 60.3 being close to the ground rather than in a conventional raised position.

Figure 35:
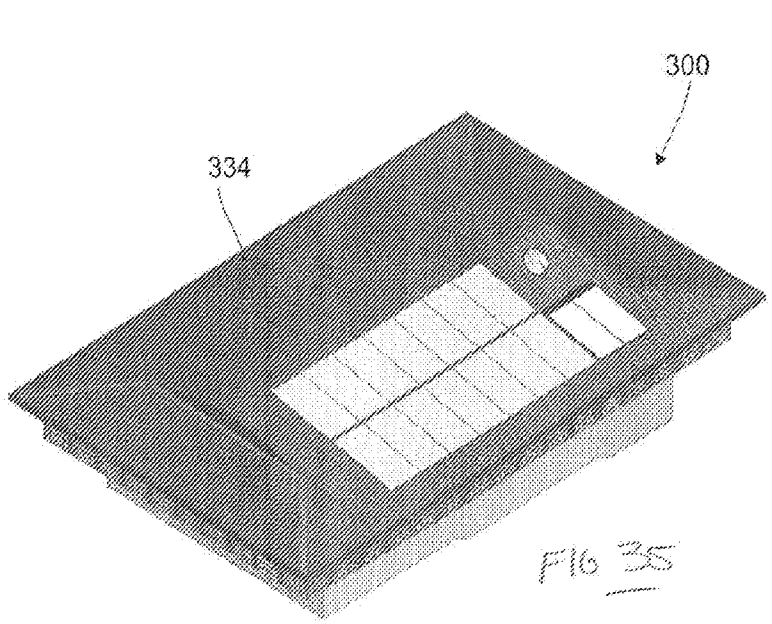
FIGS. 34 and 35 are isometric views of the roof structure of FIG. 33 including roof panels and solar panels.
Figure 34:
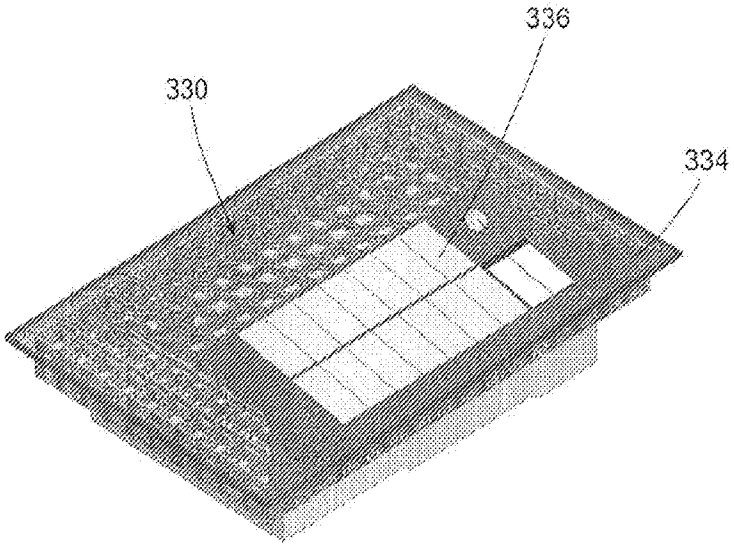
Figure 36:
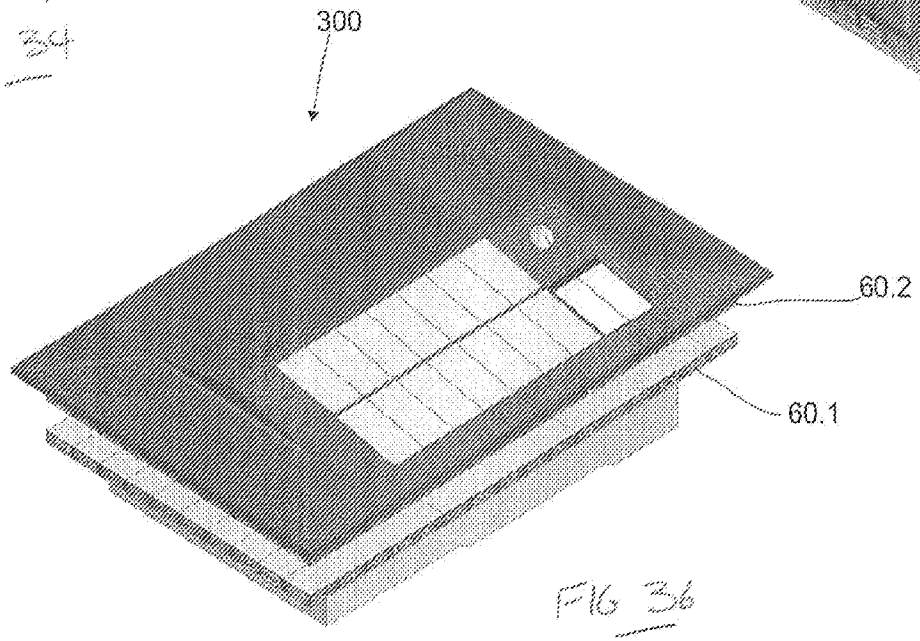
FIG. 36 is an isometric view of a building structure wherein a second floor assembly and a roof frame are partially raised using jacks.

The roof structure 330 is covered by roof sheets 334 and solar panels 336 as shown in FIGS. 34 and 35. Once again, fixing the roof sheets 334 and solar panels 336 to the roof structure is made easier and safer by the roof structure 330 being close to the ground.

Figure 38:
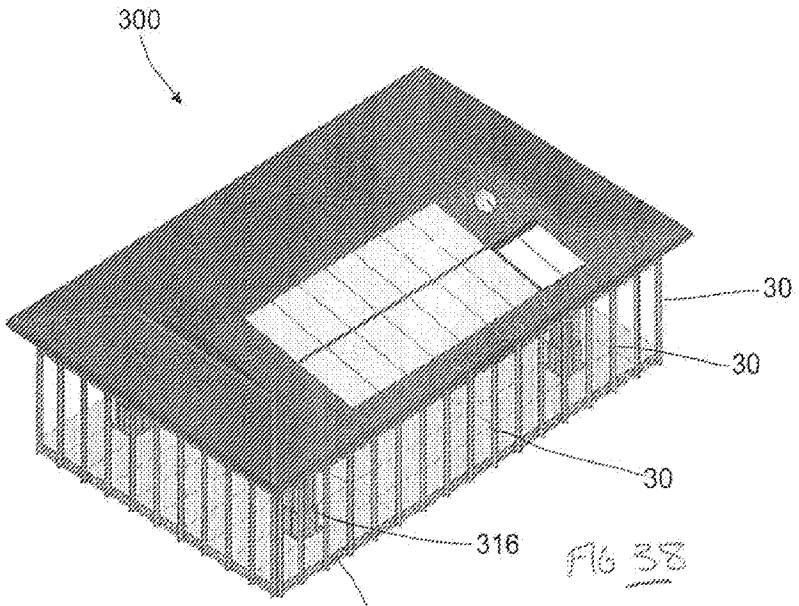
FIG. 38 is an isometric view of the building structure of FIG. 37 with the second floor assembly raised using jacks and columns extending between the first floor assembly and the second floor assembly.

After the roof is completed, the second floor assembly 60.2 and the roof frame assembly 60.3 can be lifted or raised using the jacks 322. FIG. 38 shows the second floor assembly 60.2 and the roof frame assembly 60.3 partially raised relative to the first floor 308 by the jacks 316.

Figure 39:
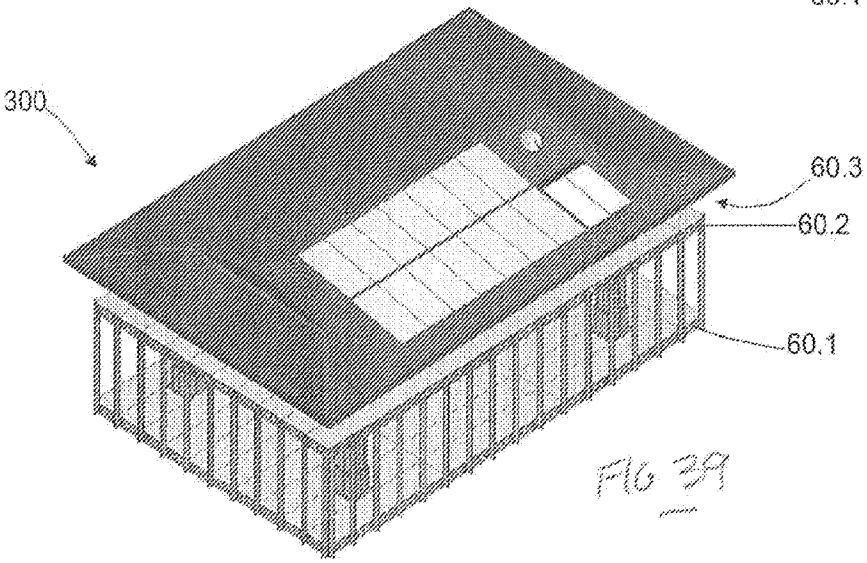
FIG. 39 is an isometric view of the building structure of FIG. 38 wherein the roof frame assembly is partially raised relative to the second floor assembly using jacks.
Figure 37:
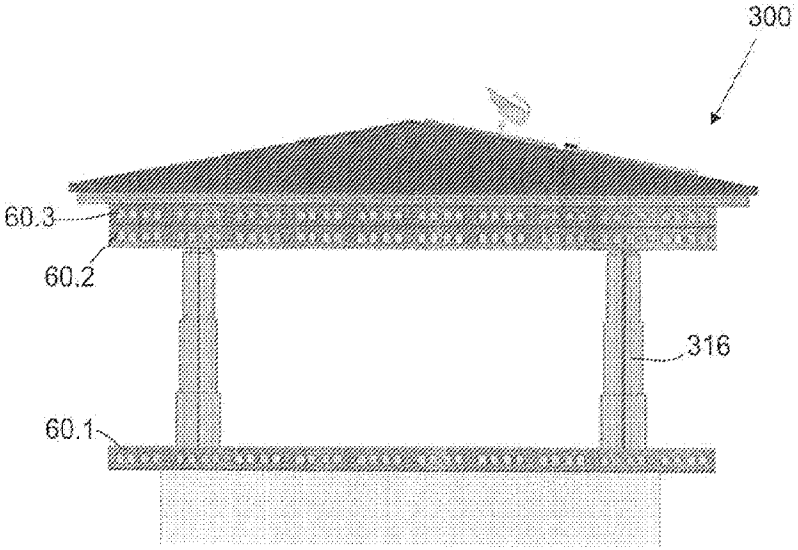
FIG. 37 is a side view of the building structure of FIG. 36 with the second floor assembly and roof frame raised using jacks.
Figure 41:
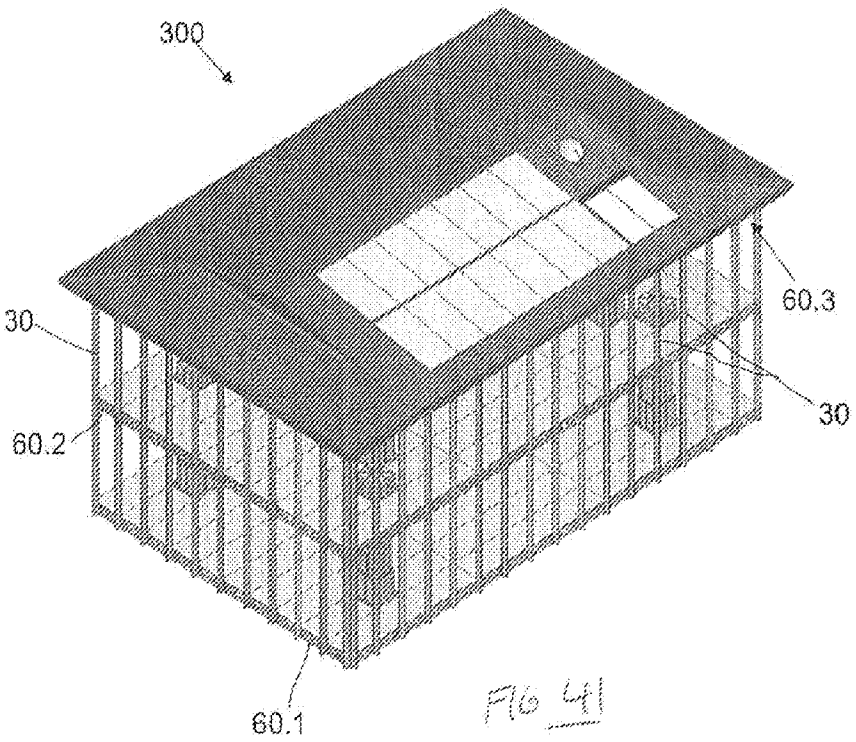
FIG. 41 is an isometric view of the building structure of FIG. 40 including column members extending between the roof frame and the second floor assembly.
Figure 40:
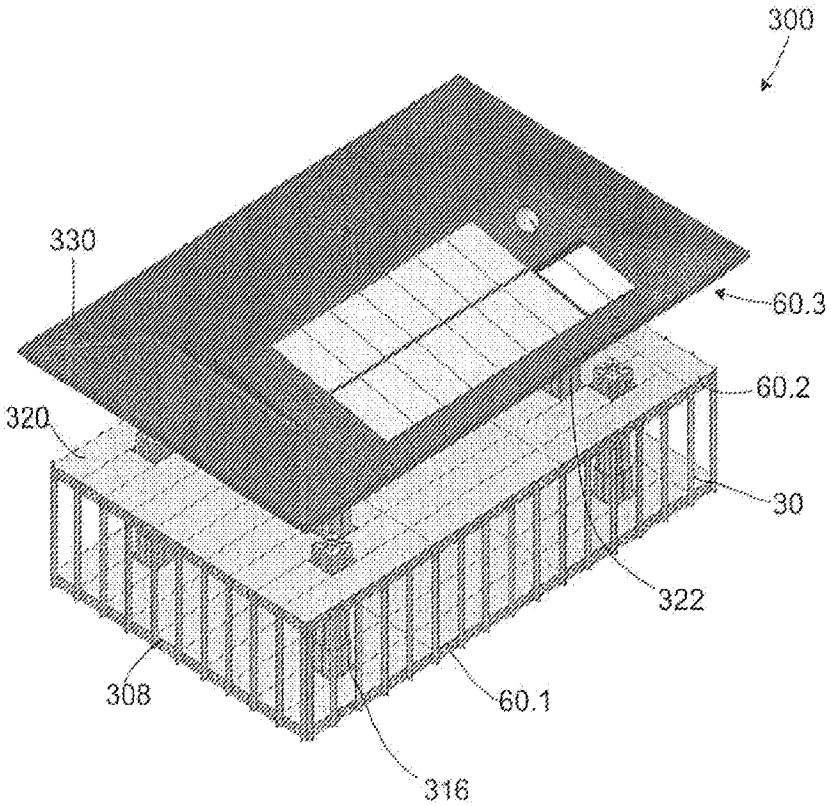
FIG. 40 is an isometric view of the building structure of FIG. 38 wherein the roof frame assembly is fully raised.

The second floor assembly 60.2 is raised by the jacks to the position shown in FIG. 39. Column members 30 are then fixed to the first floor assembly 60.1 and the second floor assembly 60.2 and extend between the floor assemblies 60.1, 60.2. The column members 30 are spaced along the periphery of the floor assemblies 60.1 and 60.2. The column members 30 support the second floor assembly 60.2 in the raised position shown in FIG. 40.

The roof frame assembly 60.3 is lifted or raised using the jacks 322. FIG. 39 shows the roof frame assembly 60.3 partially raised relative to the second floor 320 by the jacks 322. The roof frame assembly 60.3 is raised to the position shown in FIG. 40. Column members 30 are then fixed to the second floor assembly 60.2 and the roof frame assembly 60.3 to extend between the second floor assembly 60.2 and the roof frame assembly 60.3. The column members 30 support the roof frame assembly 60.3 in the raised position shown in FIG. 41.

With the second floor assembly 60.2 and the roof frame assembly 60.3 supported by the column members 30, the jacks 316, 322 can be removed. The first floor 308 and the second floor 320 can then be finished by placing floor panels in the openings 312 where the jacks 316, 322 stood.

It has been found that the use of the grid structure comprising the beam members 1 and the spreaders 10, bolted together, results in a frame system that has sufficient rigidity to limit the extent of deformation of the frame system during jacking to an adequate extent.

Figure 43:
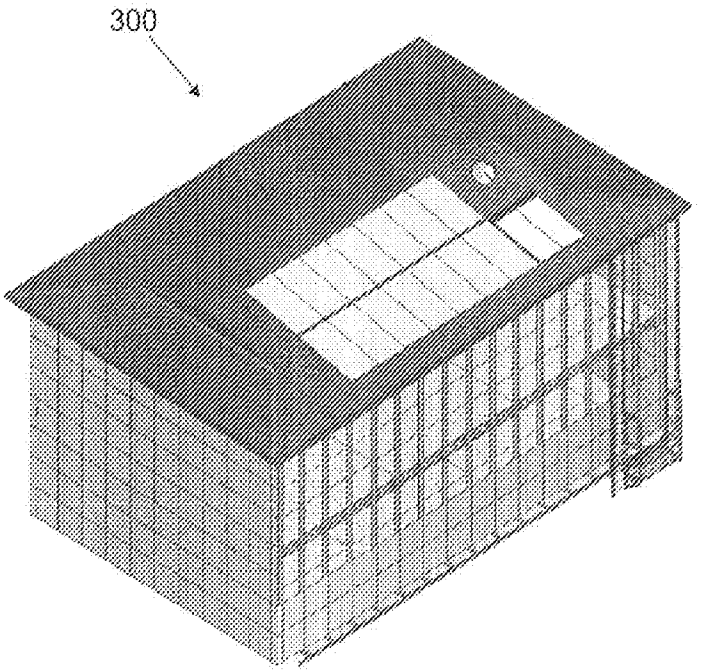
FIG. 43 is an isometric view of the building structure of FIG. 42 being clad.
Figure 42:
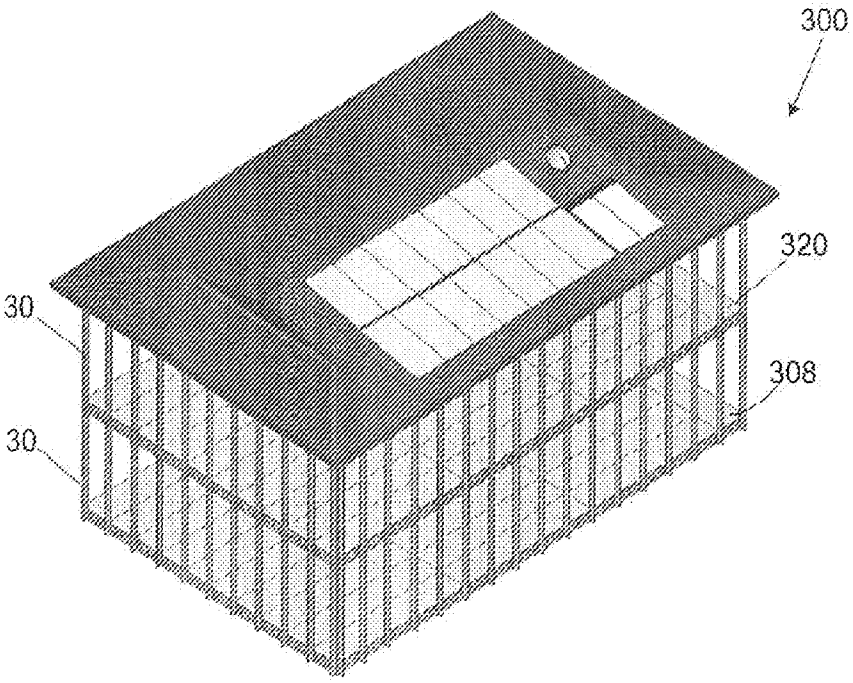
FIG. 42 is an isometric view of the building structure of FIG. 41 with the jacks removed.
Figure 44:
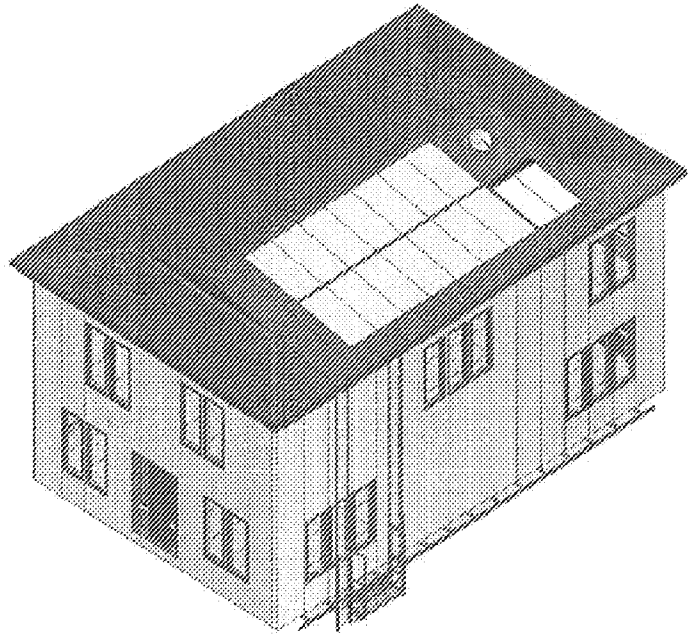
FIG. 44 is an isometric view of the building structure of FIG. 43 including windows.

The building structure 300 is clad by cladding as shown in FIG. 43. Window cavities are formed in the building structure and window frames inserted into the window cavities as shown in FIG. 44.

Figure 45:
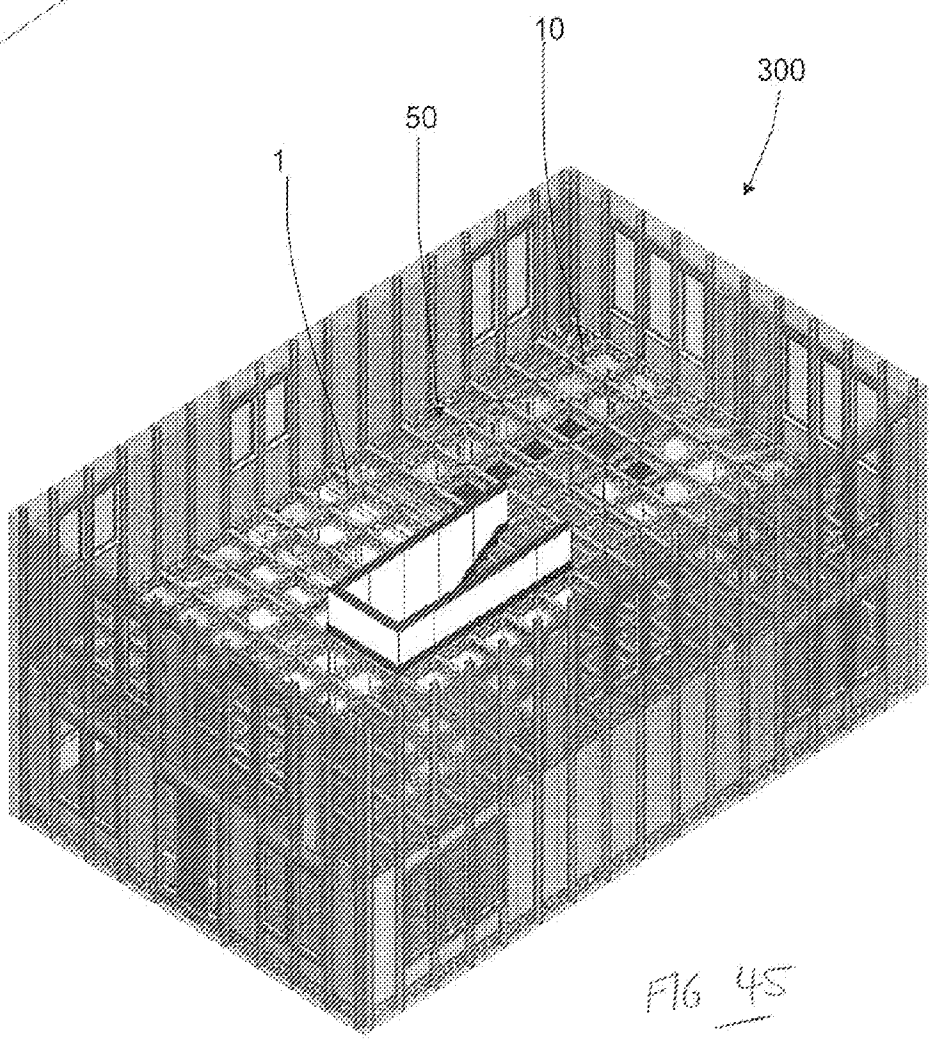
FIG. 45 is an isometric part sectional view of the building structure of FIG. 44.

FIG. 45 shows a partially sectioned view of the building structure. The holes 6, 16 in the beam members 1 and spreader members 10 provide paths for routing services such as wires, piping and ducting under the floors 308, 320 and in the roof.

Figure 47:
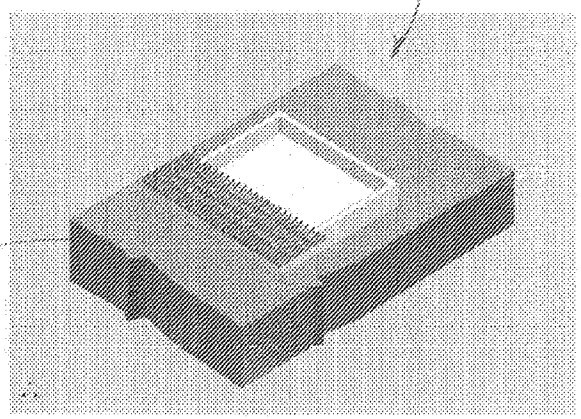
FIG. 47 is an isometric view of the concrete footing showing a second assembly stage of the floor assembly.
Figure 48:
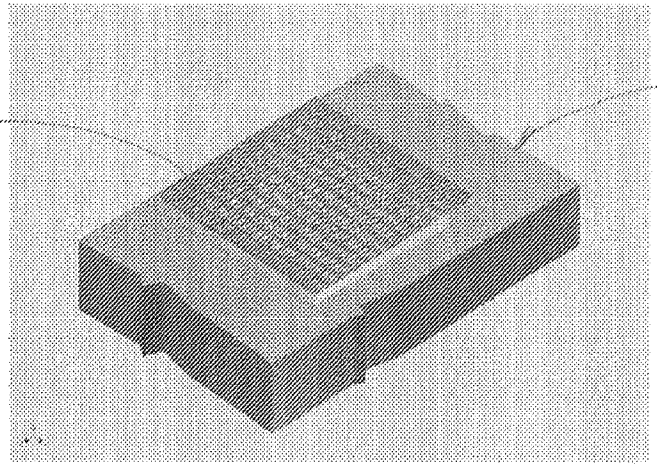
FIG. 48 is an isometric view of the concrete footing showing a third assembly stage of the floor assembly.
Figure 46:
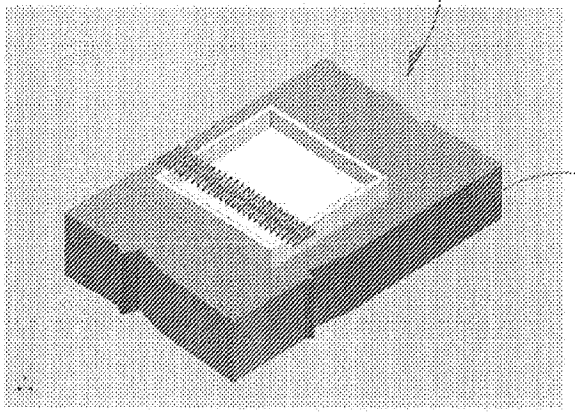
FIG. 46 is an isometric view of the concrete footing showing a first assembly stage of the floor assembly.

FIGS. 46 to 48 are illustrative of an example of a method for conveniently forming the floor assembly 60.1.

Initially, a row of beam members 1 are connected together to span the footing 302. A row of the spreaders 10 is fastened on each side of the row of beam members 1. This initial assembly is formed towards one side of the footing 302.

Further rows of beam members 1 and spreaders 10 are fastened to one side of the footing 302 (FIG. 47). At this point, the assembly can be shifted about on the footing to allow the footing to support the terminal row of beam members 1 and spreaders 10 on the one side of the floor assembly 60.1.

Remaining rows of beam members 1 and spreaders 10 are fastened to the other side of the footing 302 to form the floor assembly 60.1 as shown in FIG. 48.

Using the method described above, it is possible for the floor assembly 60 to be built on the plinth or footing 64 without the need for cranes and other lifting equipment to move the floor assembly about.

During the construction process described above, or after the structure 300 is complete, it may be necessary to move columns 30 or to insert further columns 30, depending on building requirements, such as the addition of further rooms or where further weight-bearing capability is required.

FIGS. 49 to 53 illustrate how the position of the columns 30 can be varied.

Figure 50:
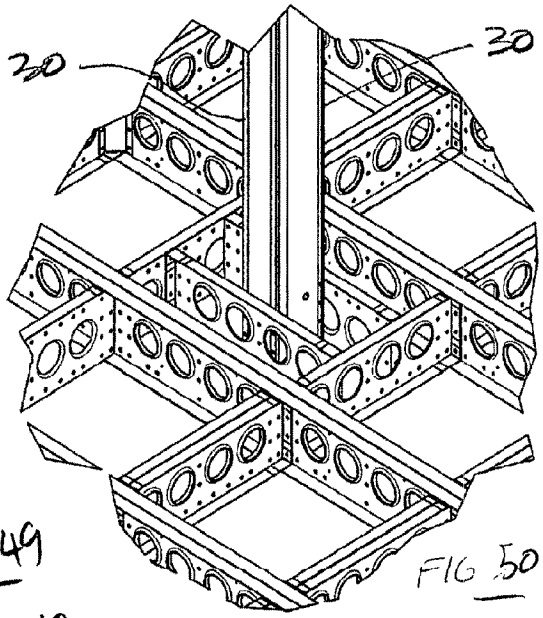
Figure 49:
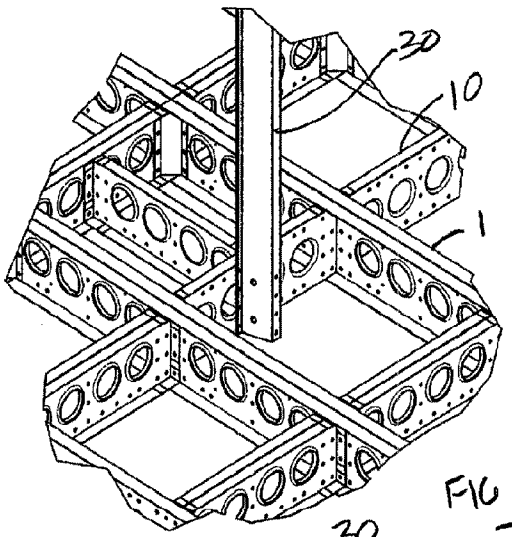

For example, in FIG. 49, a column 30 is fastened to a single spreader 10. In FIG. 50, two columns are fastened between two spreaders 10. In that case, the two spreaders 10 are transversely oriented relative to two other spreaders 10 positioned between paired beams 1. This illustrates the structure of a foot assembly 337 for the columns 30. This is made possible by the modular nature of the spreaders 10 allowing them to be positioned in a wide variety of locations within the floor assembly 60. For example, this would allow the foot assembly 337 to be positioned on any of such locations to support the columns 30.

Figure 51:
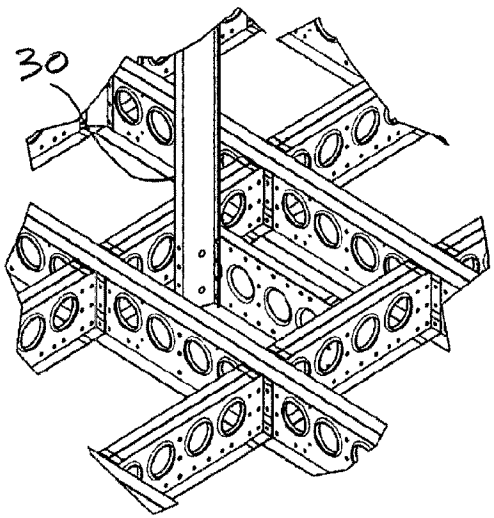
FIGS. 49 to 53 show different positions for a column fastened to the floor assembly.

In FIG. 51, a column 30 is fastened to a spreader 10 at a junction between that spreader 10 and a pair of spreaders 10 connected between consecutive paired beams 1.

Figure 52:
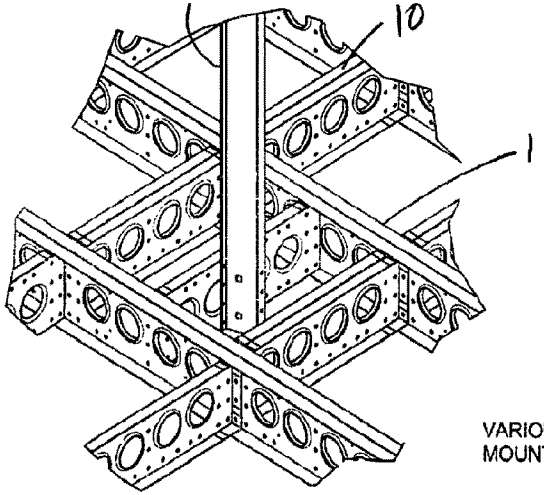

In FIG. 52, a column 30 is fastened to a single spreader 10 extending between consecutive paired beams 1.

Figure 53:
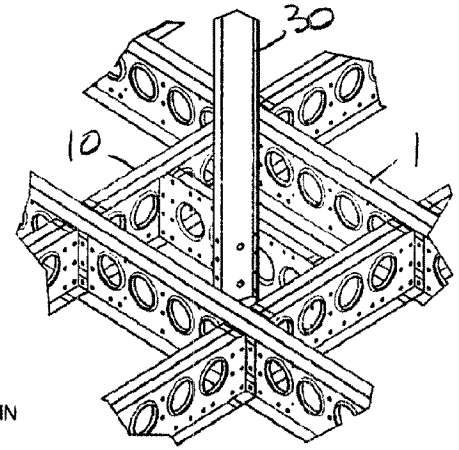

In FIG. 53, a column 30 is fastened to a single spreader 10 extending between consecutive paired spreaders 10.

Figure 55:
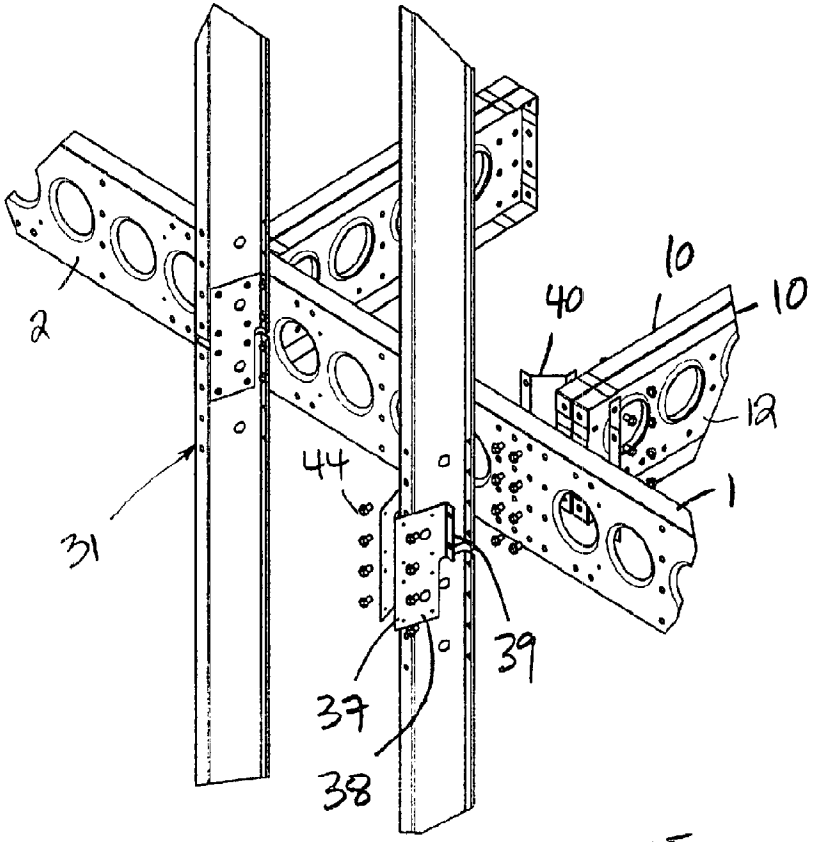
FIG. 55 shows the partly exploded view of FIG. 54 from a different angle.
Figure 54:
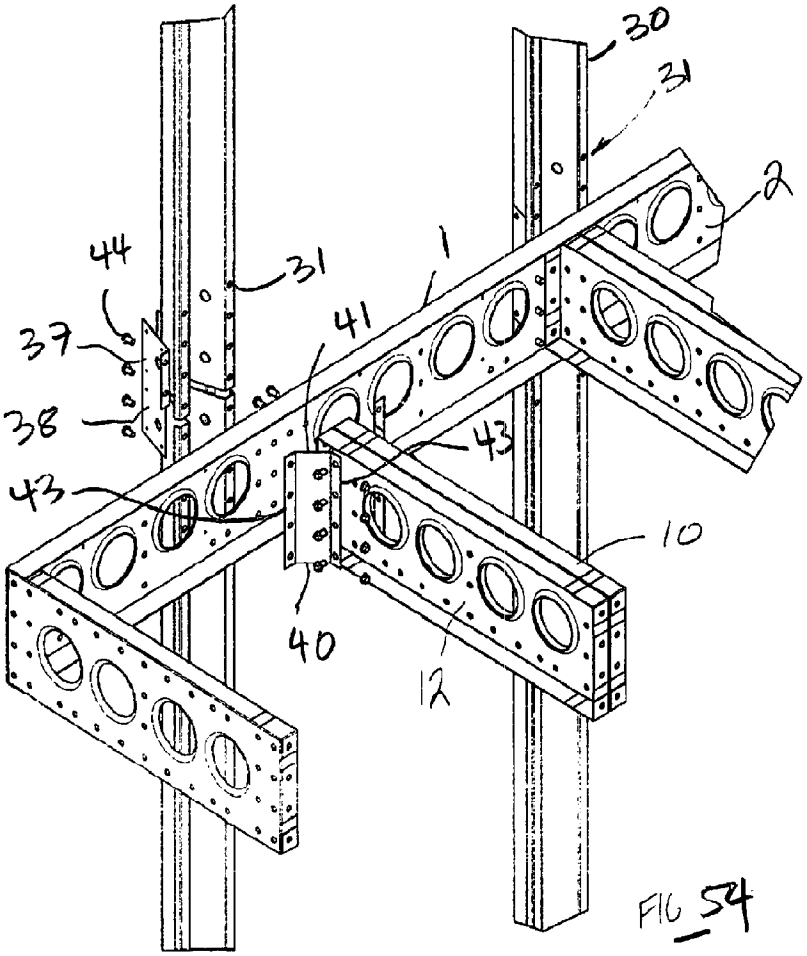
FIG. 54 shows a partly exploded view of a fastening arrangement for fastening a floor assembly between floors of a building.

FIGS. 54 and 55 show two different views of a manner in which a floor assembly 60 is fastened to consecutive columns 30 at a junction between two floors of a building or structure.

The gusset plate 40 has a web 41 interposed between a pair of flanges 43. The flanges 43 and web 41 are oriented at about 45° relative to each other. A height or width of the plate 40 allows one of the flanges 43 to be fastened to the web 12 of the spreader 10 with fasteners 44 received through openings 45 in the flanges 43 and a corresponding set of openings 9 in the web 12.

The opposed flange 43 is fastened to an internal surface of the web 2 of the beam 1 with the fasteners 44. The pair of spreaders 10 can thus be fastened to the internal surface of the beam 1 with two of the gusset plates 40. The end flange 18 of the spreaders 10 can also be fastened to the internal surface of the beam 1, as explained above.

A lower column 30 is connected to an upper column 30 with splice members or plates 37. Each splice plate 37 has a profile that corresponds with a profile of one side of the column 30. Thus, the splice plate 37 has a faceplate 38 that can span adjacent upper and lower portions of consecutive columns 30. Similarly, the faceplate 38 has a flange 39 that can span adjacent upper and lower portions of the flanges 34 of the consecutive columns 30. The faceplate 38 can be fastened or bolted to the converging walls 32 of the consecutive columns 30 via openings in the faceplate 38 and the bolt holes 31 in the columns 30. Likewise, the flange 39 can be fastened or bolted to the flanges 34 of the consecutive columns 30.

The openings in the flange 39, a corresponding set of holes 9 in the web 2 and the holes or openings in the flange 43 can be brought into register with each other allowing the splice plates 37, the columns 30, the beams 1 and the gusset plates 40 to be fastened together with a common set of the fasteners 44.

Figure 57:
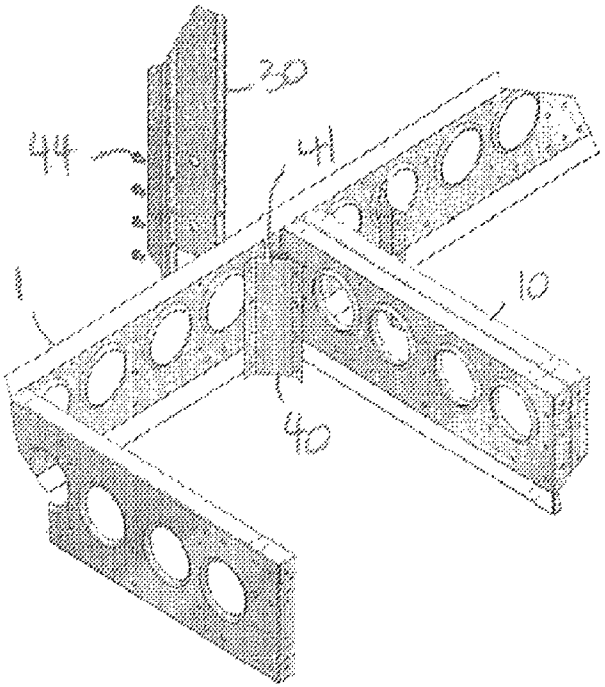
Figure 58:
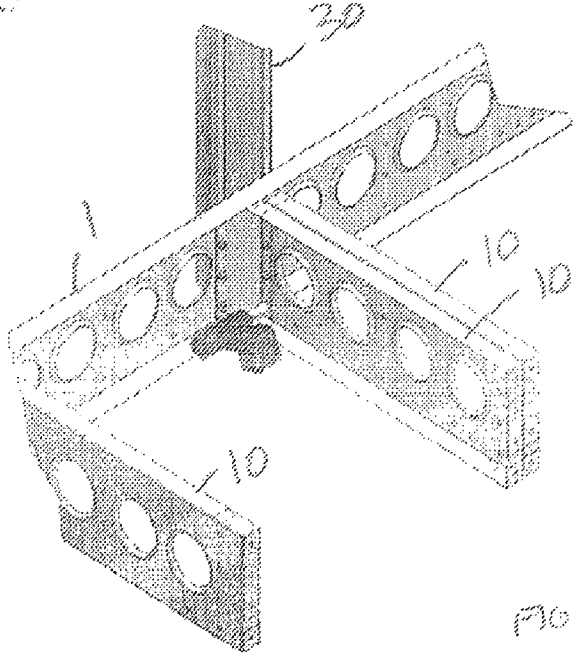
Figure 59:
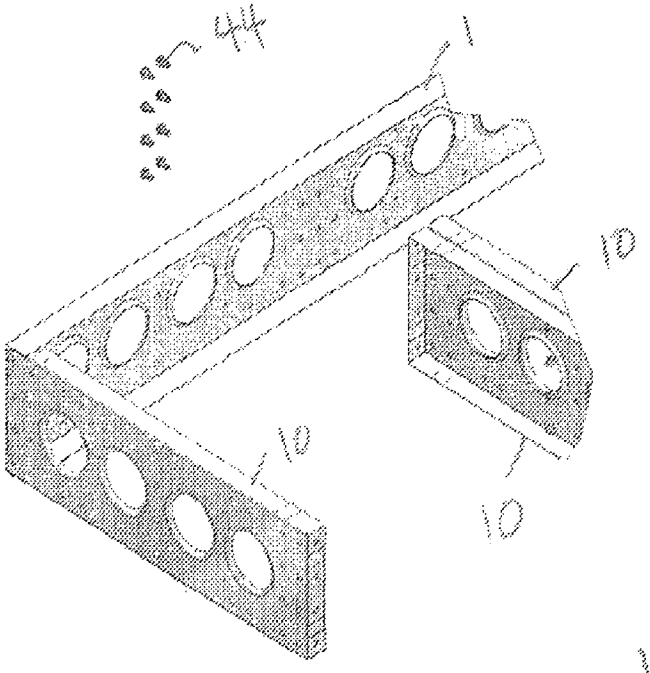
FIG. 59 is a side view of an exemplary embodiment of a jack suitable for use with the building system.
Figure 61:
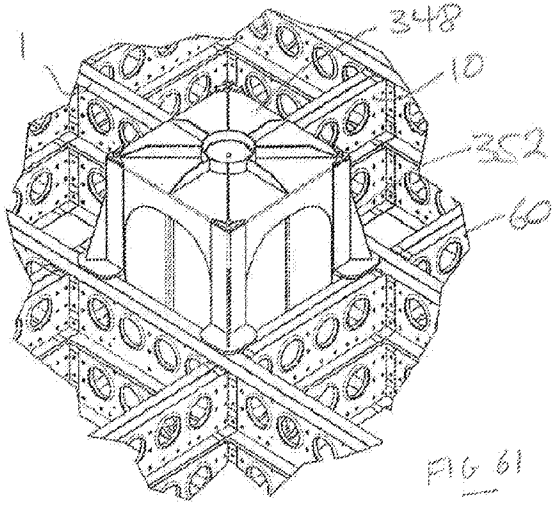
FIG. 61 is a three dimensional view of a mounting head 348 of the jack engaged with a floor assembly.
Figure 62:
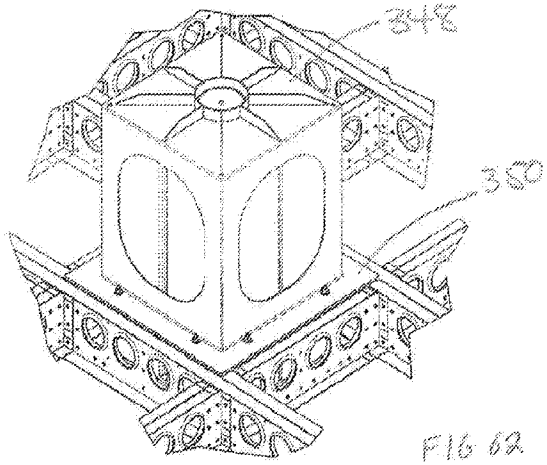
FIG. 62 is a three dimensional view of the jack in a closed condition mounted on a floor assembly.
Figure 60:
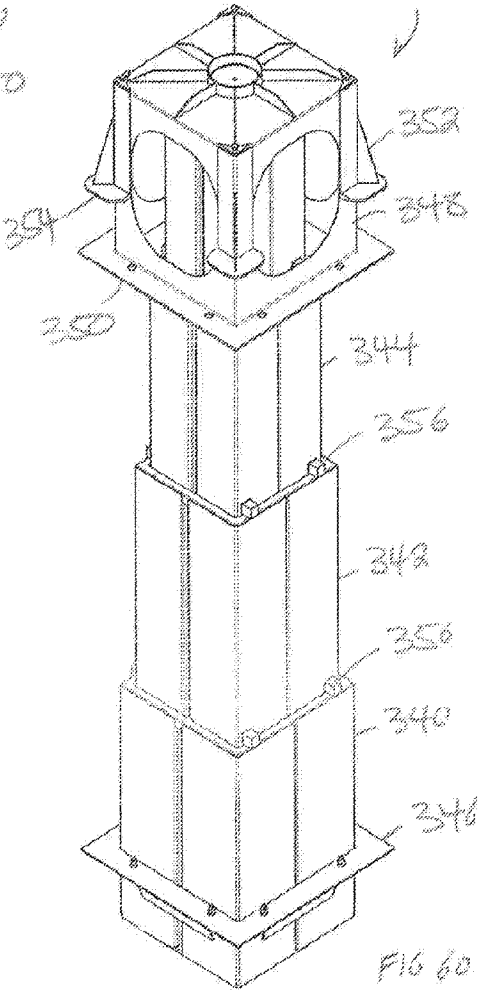
FIG. 60 is a three dimensional view of the jack of FIG. 59.
Figure 59:
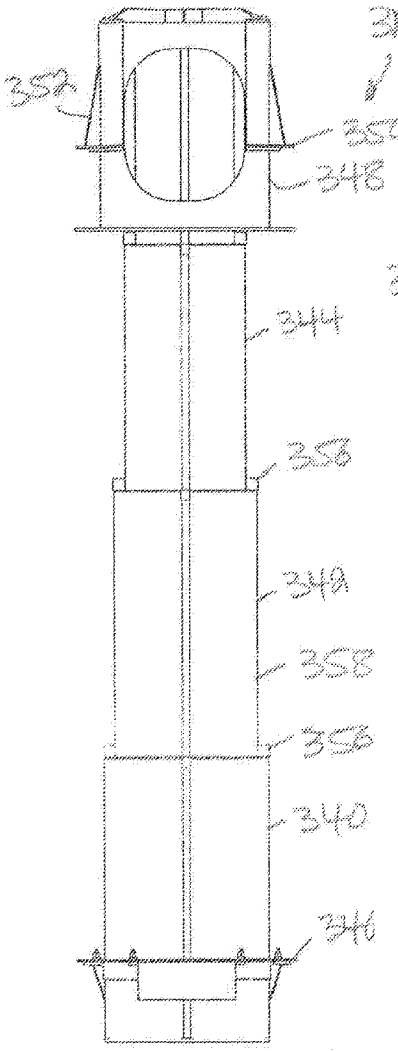

FIGS. 56 to 58 show stages in the fastening of a floor assembly 62 column 30.

In FIG. 56, two spreaders 10, already fastened together, are fastened to a beam 1 with the fasteners 44 engaging the web 2 and the flange 18. In FIG. 57, gusset plates 40 are fastened to the web 12, the web 2, the flange 34 and the flange 39, with the fasteners 44, as described above.

In FIG. 58, there is shown the use of a tool suitable for the fasteners 44.

FIGS. 59 to 62 show one of the jacks 316 (or the jacks 320) that can be used in the construction method or building system described herein.

The jack 316 is telescopic having a lower section 340, an intermediate section 342 and an upper section 344, telescopically arranged with respect to each other. In this example, the sections have a square or rectangular cross-section, in plan. However, it is envisaged that other suitable sectional shapes are possible.

A flange 346 is arranged on the lower section 340. The flange 346 can be bolted to faces of upper flanges 4 and upper flanges 14 of the beam members 1 and the spreader 10, respectively, of the lower or first floor assembly 60.1.

A mounting head 348 is arranged on the upper section 344. The mounting head 348 also has a flange 350. The flange 350 can be bolted to faces of lower flanges 4 and lower flanges 14 of the beam members 1 and the spreader 10, respectively.

Keeper members or keepers 352 are arranged on the mounting head 348. Each keeper 352 has a locating formation or foot 354 that is positioned so that a further floor assembly 60 can be constructed or positioned between the foot or feet 354 and the preceding floor assembly 60.

Thus, the further floor assembly 60, such as the second floor assembly 60.2, can be jacked upwardly while being secured between the flange 350 and the keepers 352.

It will readily be appreciated that the keepers 352 can have a variety of configurations that serve the purpose of securing the further floor assembly 60 against excessive movement relative to the mounting head 348 while being jacked upwardly.

The intermediate section 342 and the upper section 344 have sets of support pins or pegs 356 at the respective lower ends. The pegs 356 of each section are configured to project from walls 358 and to rest on upper ends of a preceding section once that section is extended. The pegs 356 can thus serve to support the jack 316 as it is extended in various stages.

The jack 316 is hydraulic or pneumatic. Thus, the pegs 356 serve to avoid the need for having fluid pressure support the jack 316 in its extended or partially extended condition.

The pegs 356 can be spring mounted to extend automatically. Alternatively, the pegs 356 can be manually or remotely operated.

Spreader Forming Machine

Figure 63:
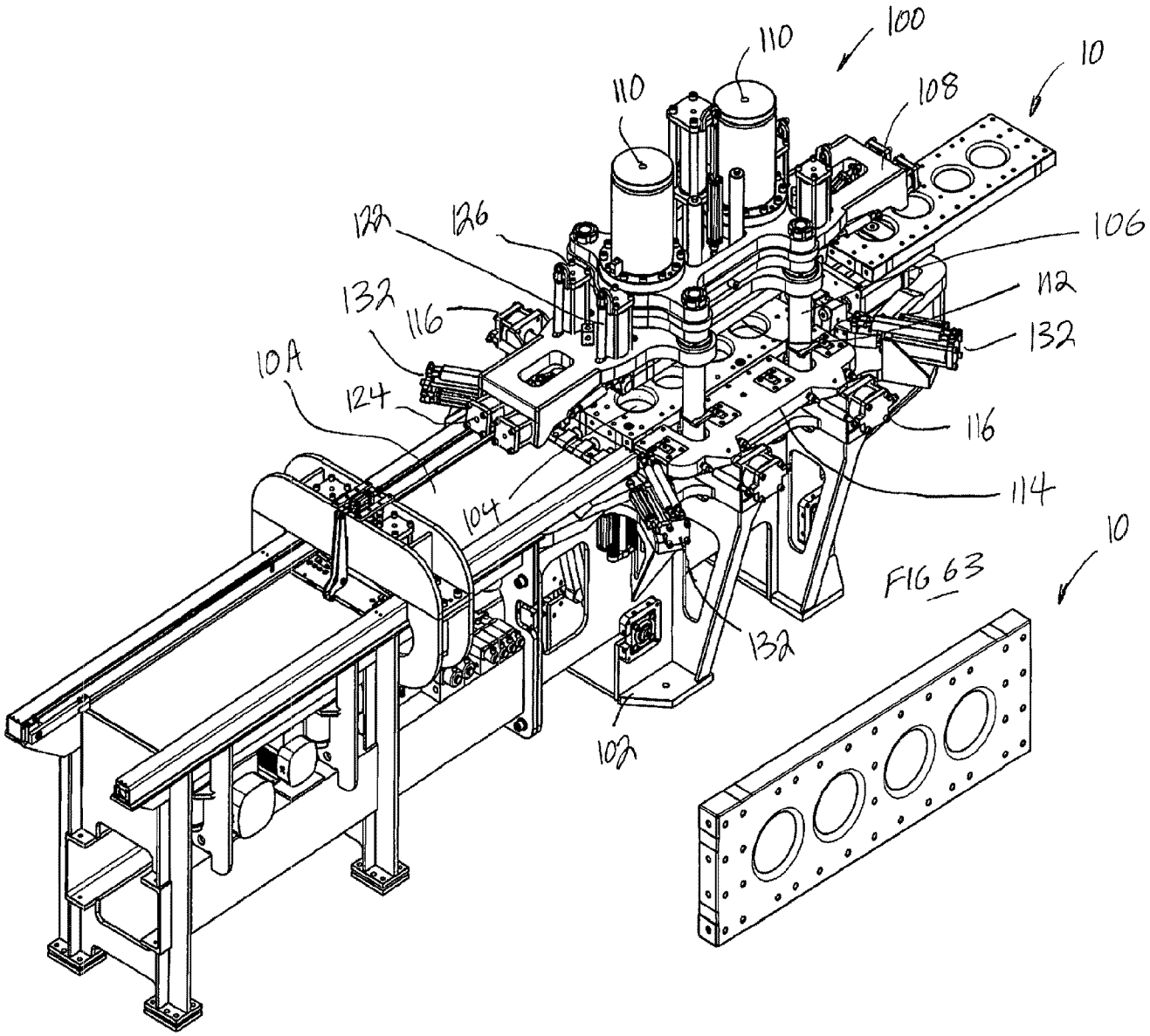
FIG. 63 is an isometric view of a forming machine for forming the spreader member of FIGS. 3 and 4.

FIG. 63 shows a forming machine 100 for forming a blank of material into the spreader member 10. The forming machine 100 is configured for carrying out reciprocal forming and shaping operations on metal sheeting to form the spreader 10. In particular, the forming machine 100 is suited for cutting, stamping and/or punching and pressing and/or folding lengths of steel stockfeed to form the spreader members 10.

The forming machine 100 comprises a base 102 supporting a bottom die 104, and columns 106 extending vertically from the base 102 and spaced around the bottom die 104. The columns 106 support a platform 108 in a suspended position above the bottom die 104.

Two top die actuators 110 are mounted on the platform 108. The actuators 110 drive a top die 112 between a home position and a forming position. When the top die 112 is in its home position sufficient space is provided between the top and bottom dies 112 and 104 to feed a blank 10A between the dies. When the top die 112 is in its forming position, the top and bottom dies 112 and 104 cooperatively carry out a forming operation.

The machine 100 has a two parallel side flange formers 114 (hereinafter referred to as flippers 114) for forming the parallel flanges 14 of the spreader member 10. The flippers 114 are located at either side of the bottom die 104. For each flipper 114 there is a horizontal flipper actuator 116 for moving the flipper 114 horizontally, and a vertical flipper actuator 118 for moving the flipper 114 vertically. The horizontal and vertical flipper actuators 116 and 118 act cooperatively to move the flippers 114 between a home position and a forming position.

FIG. 78 shows a machine 150 for forming the beam member 1. The machine 150 is configured for carrying out reciprocal forming and shaping operations on metal sheet to form the beam members 1. The machine 150 only requires the above described formers and former actuators. Operation of the machine 150 may be at least partially automated by use of a programmable logic controller (PLC) running a program such as that represented in the flow chart of FIG. 79.

The machine 100 for forming the spreader 10 requires all of the above described formers 114 and former actuators 110, plus the additional parts described below with reference to FIGS. 63 to 77.

Two end flange formers 120 (hereinafter referred to as plungers 120) are mounted on the platform 108, with one plunger 120 at each end of the die 104. For each plunger 120 there are plunger actuators 122 and 124 for driving the plungers 120 between a home position and a forming position, and a plunger actuator 126 for returning the plunger 120 to its home position.

The base 102 further supports four tail arms 130 (the function of which will be explained below), two for each end of the die. For each tail arm 130 there is a tail arm actuator 132 for driving the tail arms 130 between a home position and a forming position.

The base 102 further supports two end punches 140, one for each end of the die, for punching holes in the end flanges 18. For each end punch 140 there is an end punch actuator 142 for driving the end punches 140 between a home position and a punching position.

Figure 80:
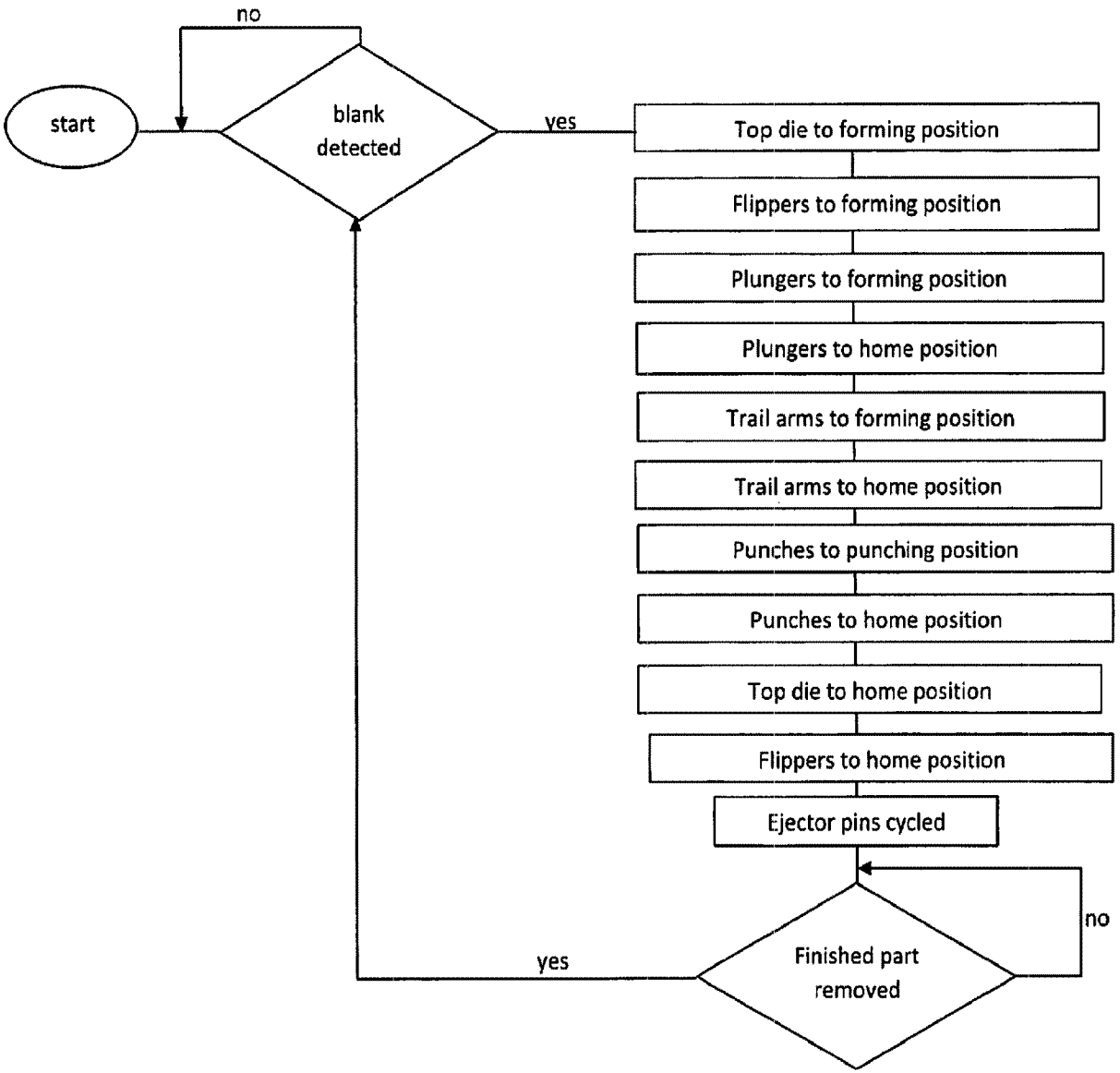
FIG. 80 is a flow chart illustrating a control sequence for a forming machine for forming spreader members.

In use, operation of the forming machine 100 for forming spreader members 10 may be at least partially automated by use of a programmable logic controller (PLC) running a program such as that represented in the flow chart of FIG. 80.

A blank 10A is fed between the top and bottom dies 112 and 104. Where feeding of the blank 10A is automated, sensors may be employed to sense the presence of the blank 10A and commence operation of the machine 100. Where feeding of the blank 10A is performed manually, commencement of operation will likely be contingent upon the closing of a guard (not illustrated).

Figures 64, 65, 66:
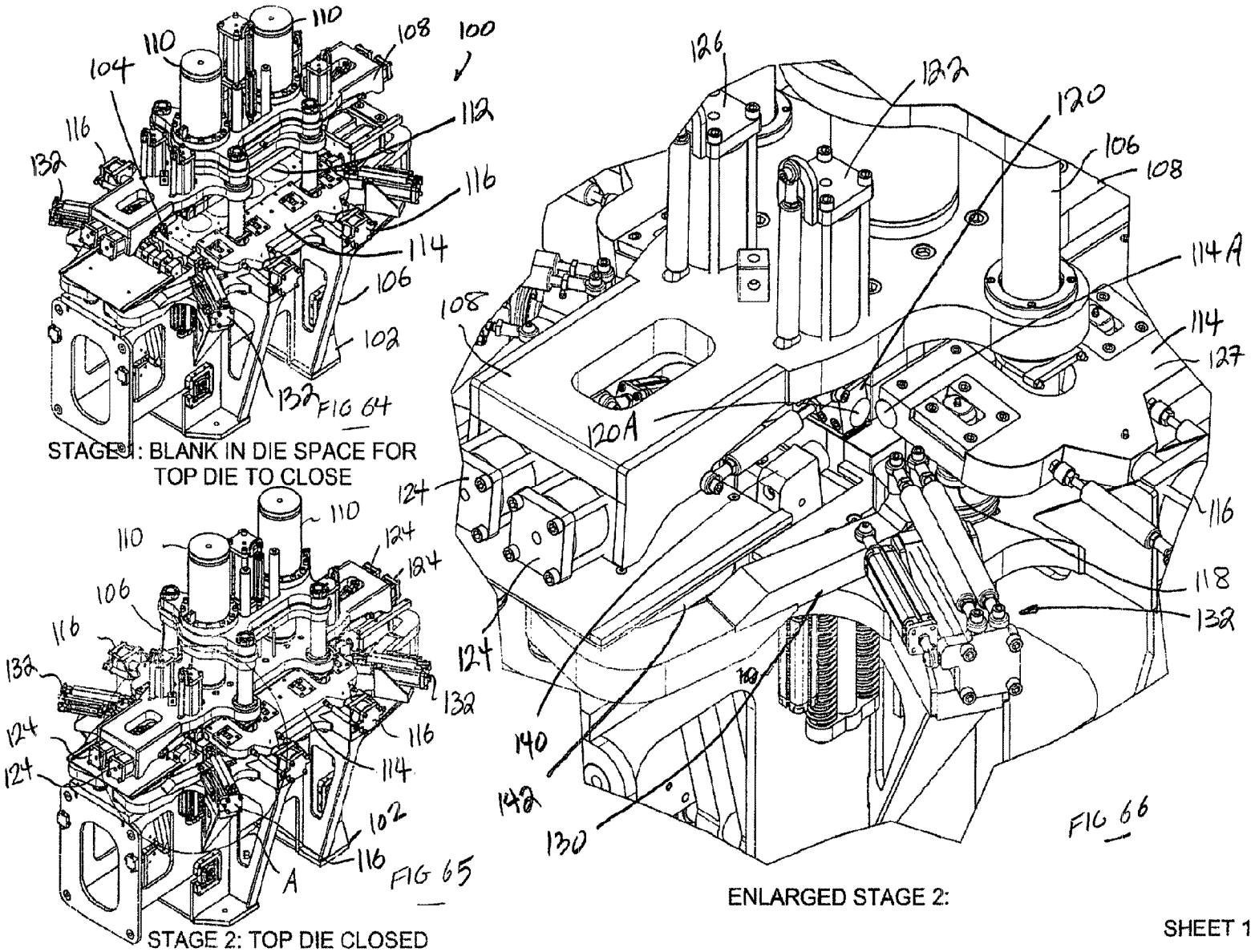
FIG. 64 is an isometric view of the forming machine of FIG. 63 prior to operation.
FIG. 65 is an isometric view of the forming machine of FIG. 63 during a first stage of operation thereof.
FIG. 66 is a view taken at detail A of FIG. 65.
Figure 63:
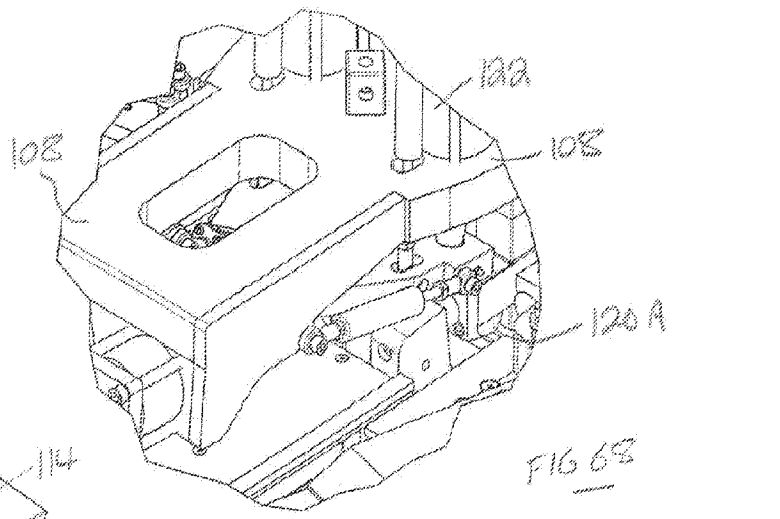
Figure 64:
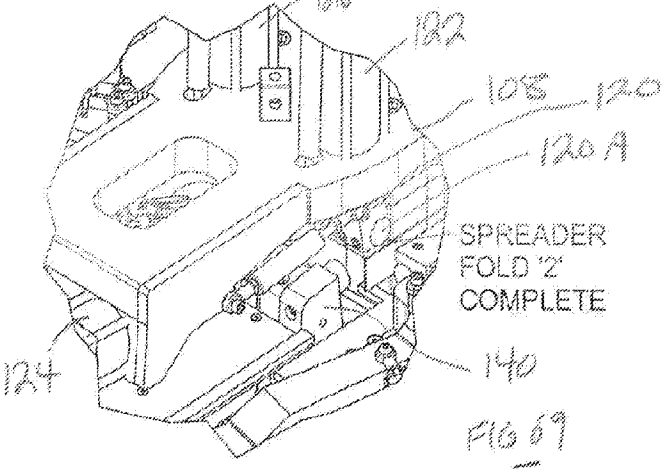
Figure 62:
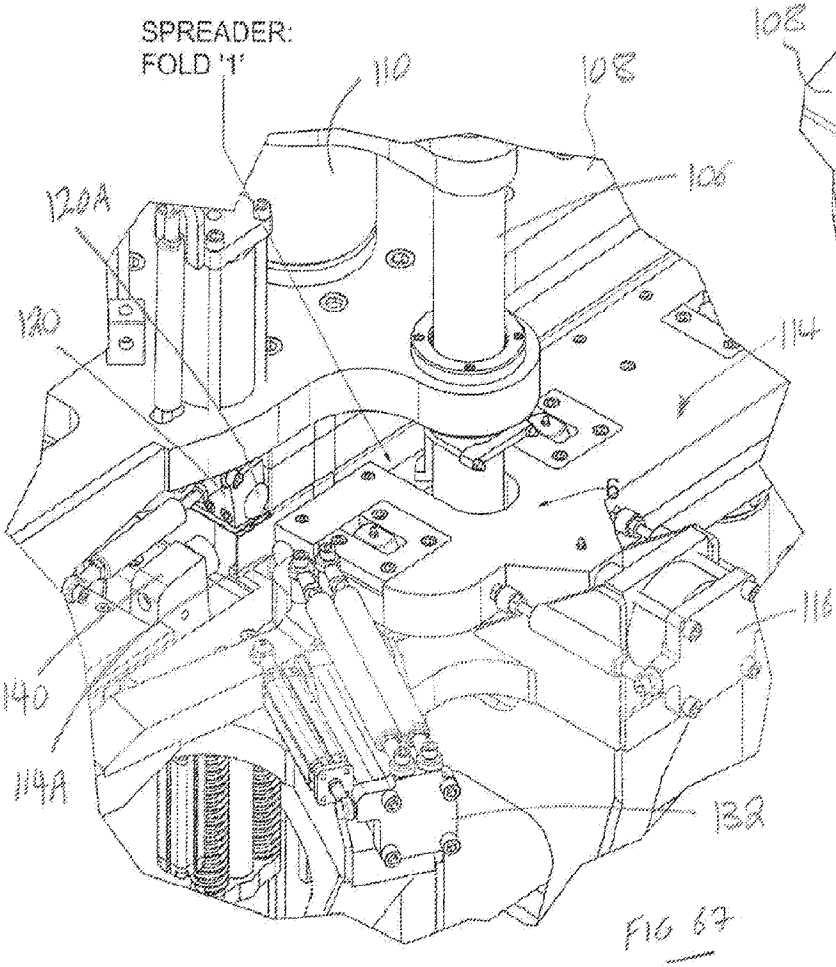
Figure 71:
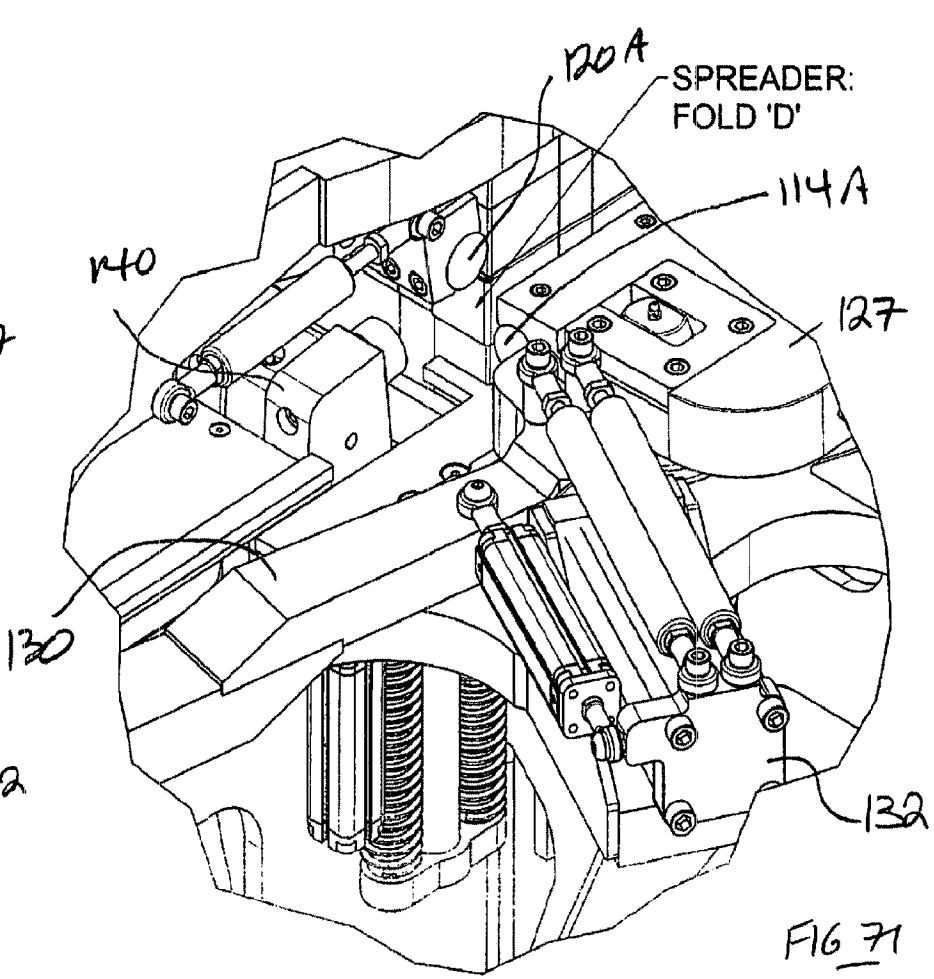
FIG. 71 is a detail view of the forming machine during a sixth stage of operation thereof.
Figure 70:
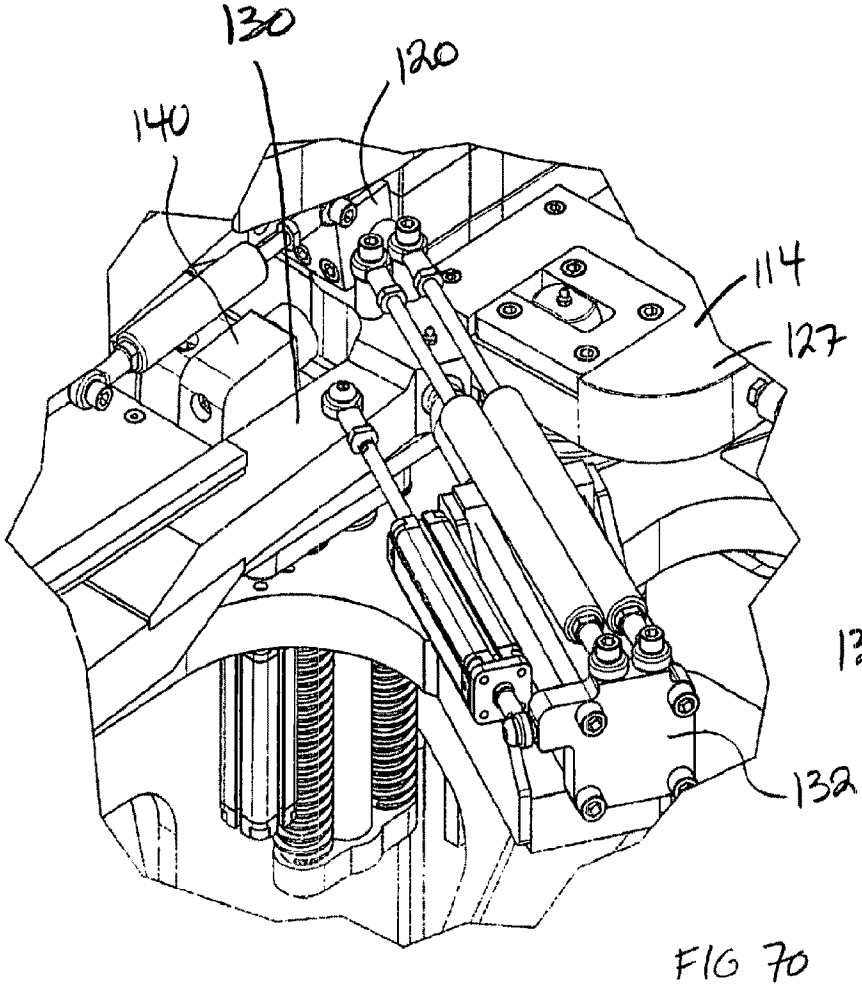
FIG. 70 is a detail view of the forming machine during a fifth stage of operation thereof.
Figure 73:
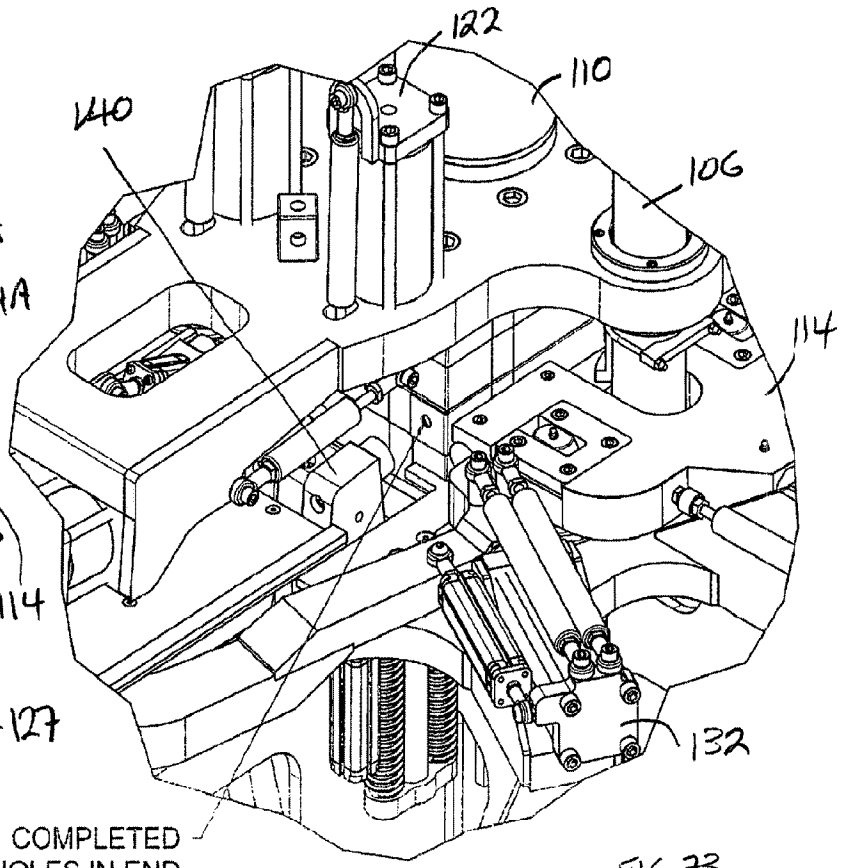
FIG. 73 is a detail view of the forming machine during an eighth stage of operation thereof.
Figure 72:
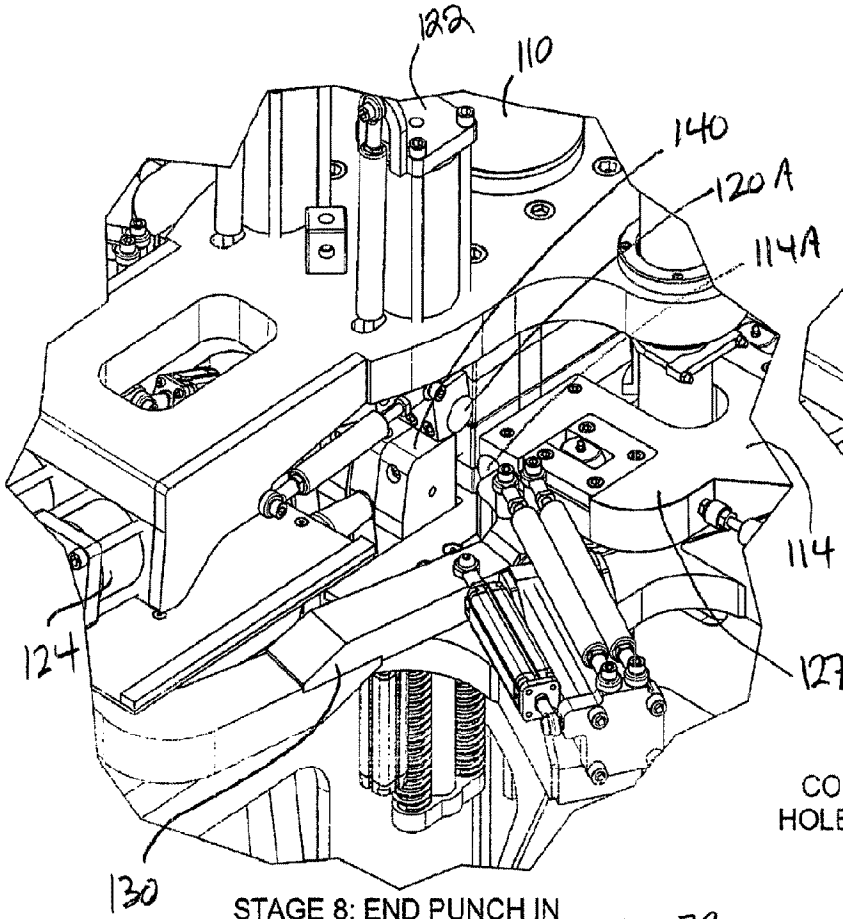
FIG. 72 is a detail view of the forming machine during a seventh stage of operation thereof.
Figure 75:
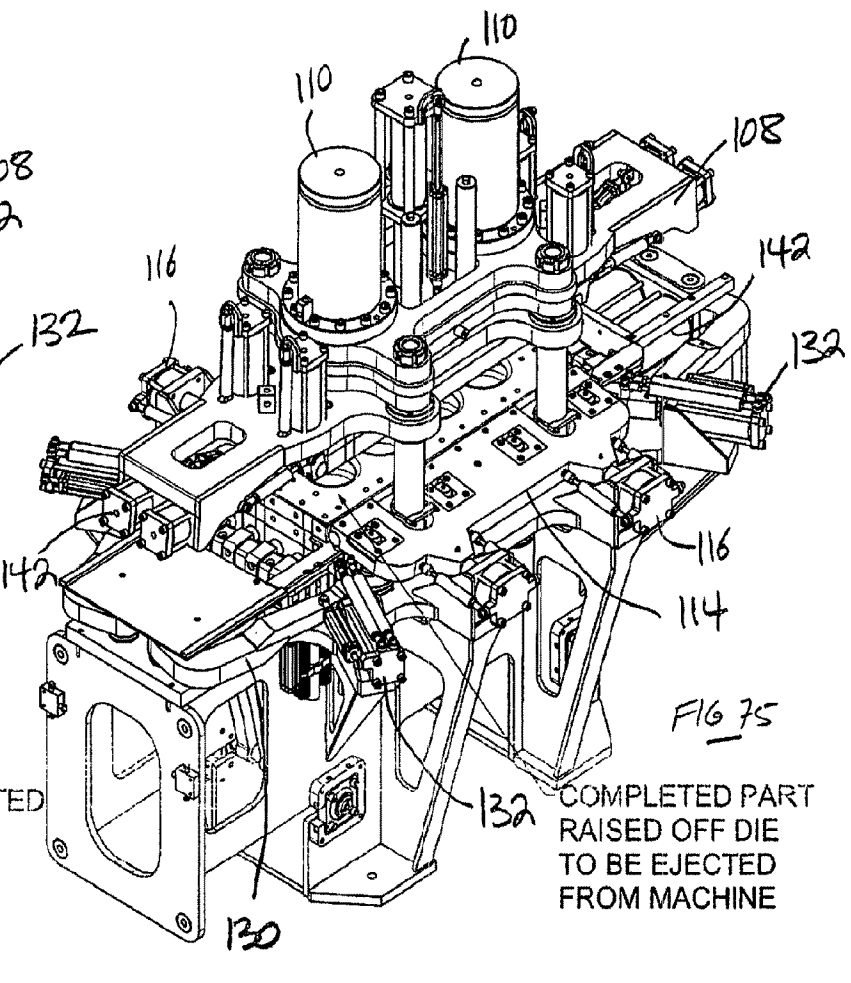
FIG. 75 is a detail view of the forming machine during a tenth stage of operation thereof.
Figure 74:
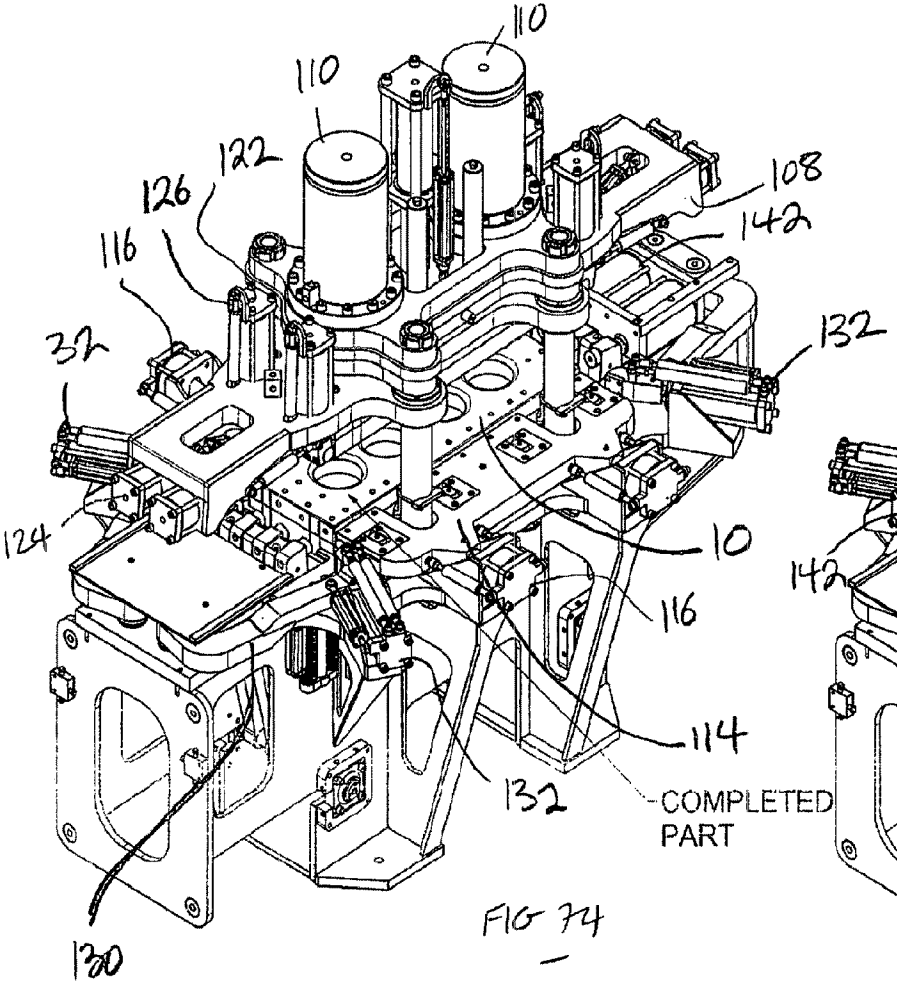
FIG. 74 is a detail view of the forming machine during a ninth stage of operation thereof.

Operation of the machine 100 commences with the closure of the top die 112 onto the bottom die 104, as illustrated in FIG. 65. This forms the holes 9 and 16, and other features on the web 12 of the spreader 10. This also forms the cuts or notches that are required for carrying out the necessary folding or bending operations to achieve the spreader 10. In other words, the flanges 14, 18 and the tabs 28 are in the pre-bent or pre-folded conditions subsequent to operation of the closure of the top die 112 onto the bottom die 104.

The flippers 114 are then moved from their home positions to their forming positions, forming the parallel flanges 14.

Figures 76, 77:
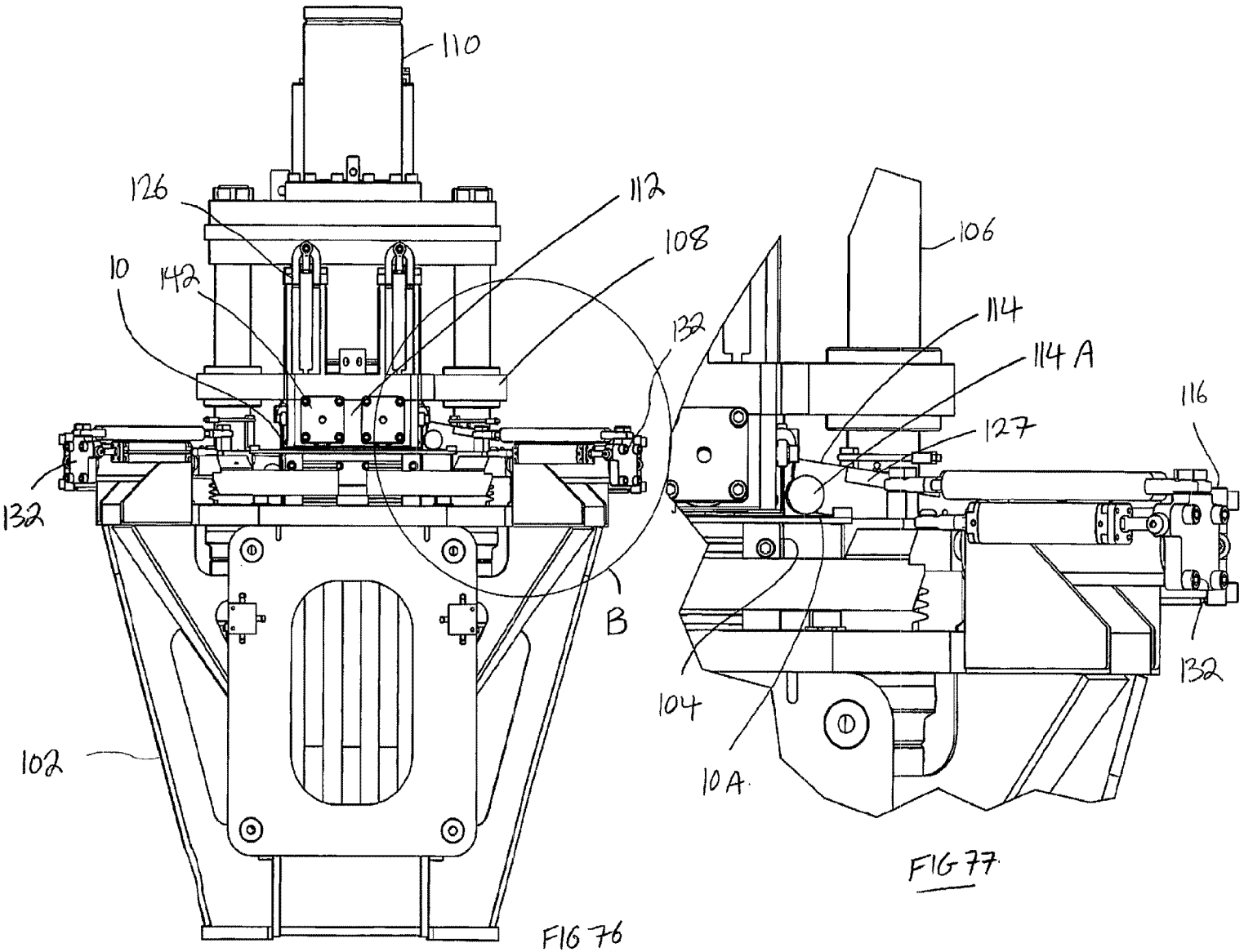
FIG. 76 is a cross-sectional view taken through the forming machine of FIG. 63.
FIG. 77 is a view taken at detail B of FIG. 76.
Figure 74:
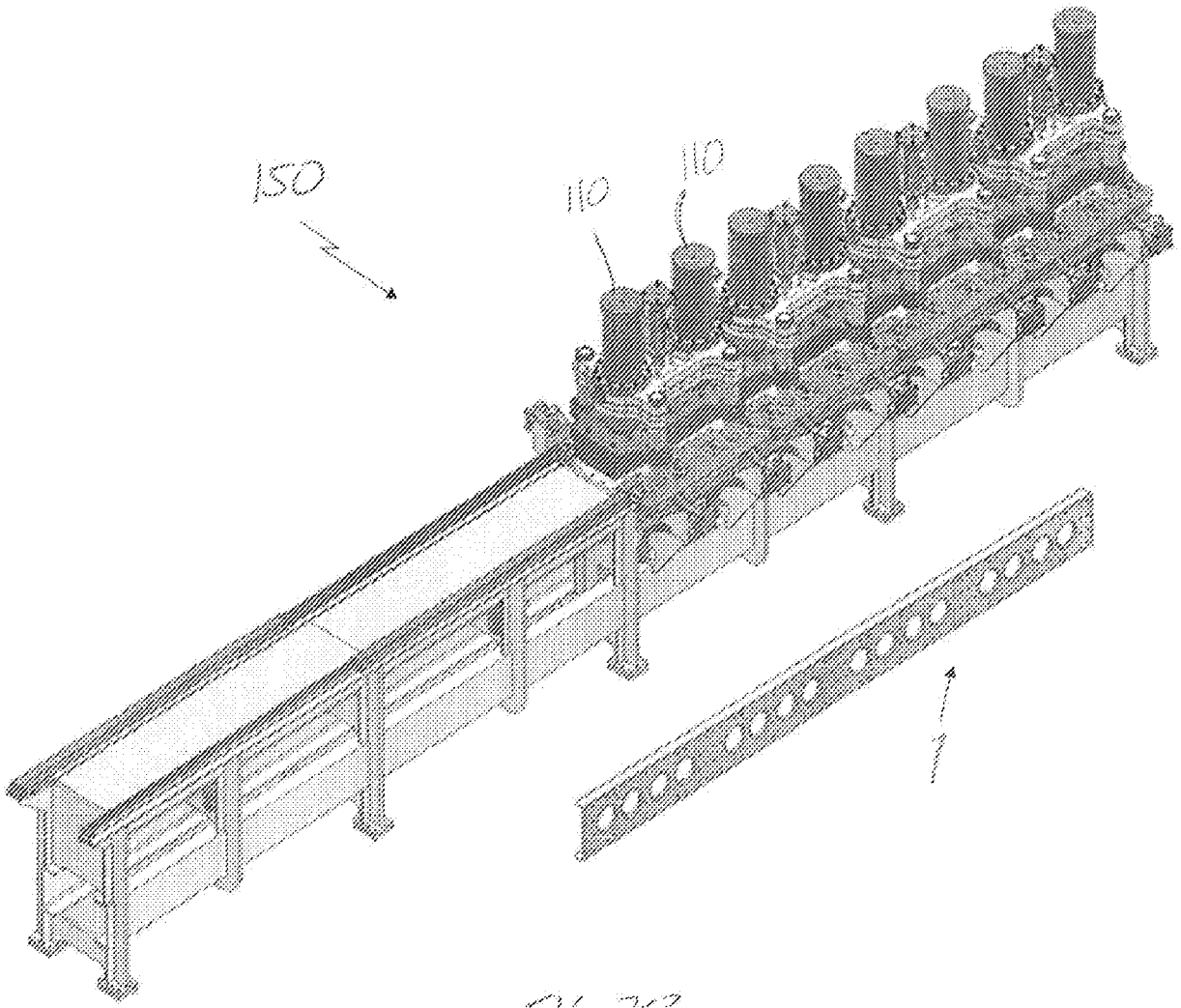

As can be seen in FIGS. 76 and 77, when the top die 112 is seated upon the bottom die 104, a smooth transition for a die former or tool 114A carried by a flipper body 127 to pass downward over the bottom die 104 and take the material to be formed with it is presented. The bottom die 104 is set back one material thickness from the upper die 112 to allow the die former or tool 114A forced onto the side face of the bottom die 104 by the horizontal flipper actuator 116 and pulled downward by the vertical flipper actuator 118 to draw the material down to form the flange 14.

Next, the plungers 120 are actuated to fold the end flanges 18 in a similar process, and then the plungers 120 are returned to their home positions. Then the tail arms 130 are actuated, each tail arm 130 folding one tab 20 over the end flange 18. Each tail arm 130 is then returned to its home position.

The operation that is carried out to form the end flanges 18 is similar to that that is carried out to form the flanges 14. It follows that the plungers 120 incorporate a tool or die former 120A that is similar to the tools 114 A. For example, the actuator 122 drives the downward or vertical movement of the tool 120A while the actuator 124 drives the horizontal movement of the tool 120A.

The end punches 140 are actuated to punch bolt holes in the end flanges 18 and are then returned to their home positions.

Next, the top die 112 is returned to its home position, and then the flippers 114 are returned to their home positions. In this way, the flippers prevent the part (i.e. spreader member 10) being raised with the top die 112.

Finally, ejector pins are actuated to free the finished part from the bottom die 104.

The forming machine 100 performs a number of sequential functions in close order. For reasons of distribution and portability, the forming machine 10 could be mounted to a truck bed or tray, or to a trailer for towing behind a vehicle. In this way, spreader members 10 could be formed at a building site.

Figure 79:
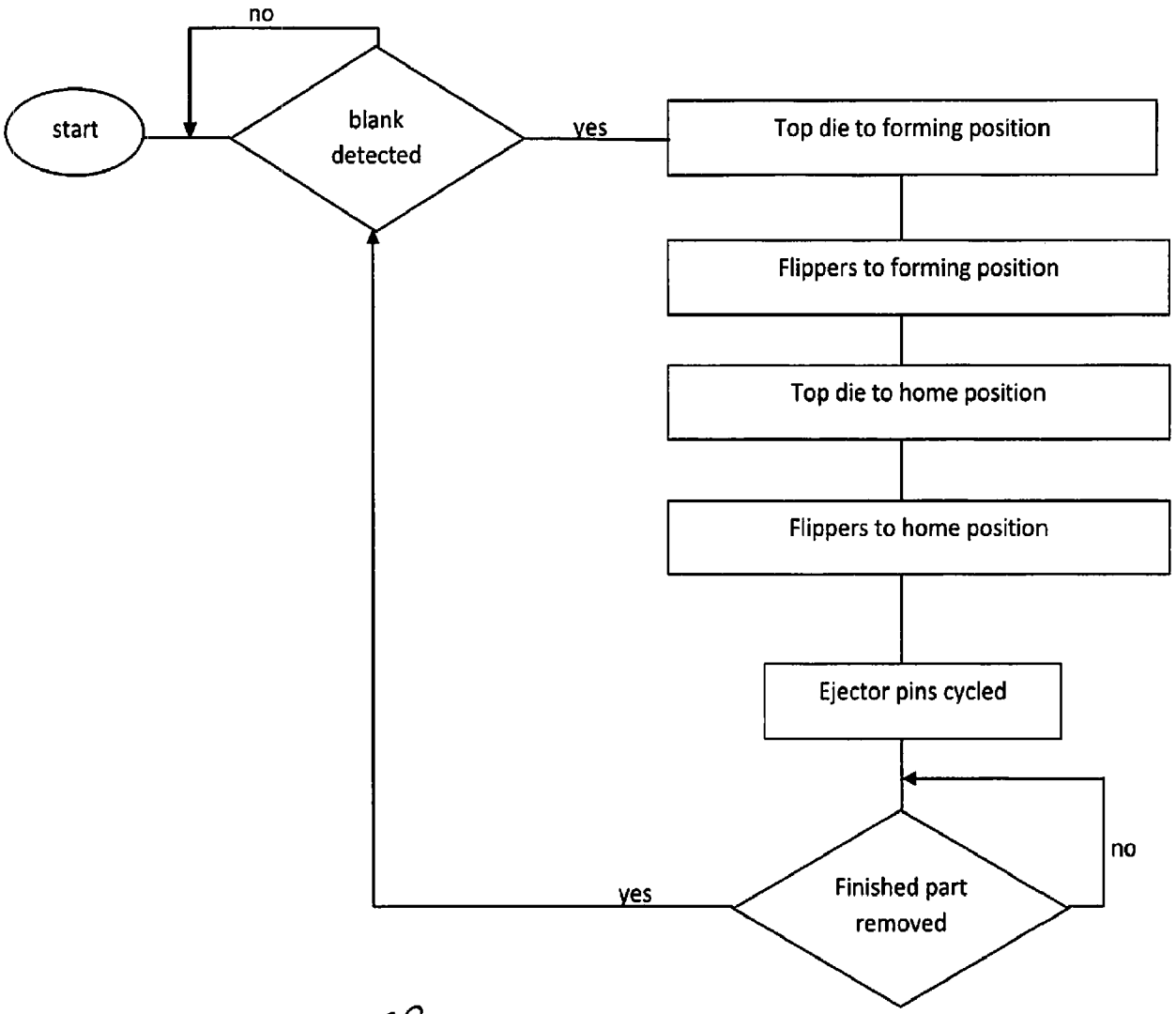
FIG. 79 is a flow chart illustrating a control sequence for a forming machine for forming beam members.

The forming machine 100 could also be used to form the beam members 1, by switching the PLC to run a program such as that represented in the flow chart of FIG. 79, and by feeding a blank (a longer blank than blank 10A—not illustrated) lengthwise into the machine 100 in stages (and with a high degree of accuracy), so that a portion of the beam member 1 profile is formed at a time.

Beam Forming Machine

The forming machine 150 of FIG. 78 is configured specifically for forming beam members 1. The forming machine 150 comprises longer top and bottom dies 112 and 104, and flippers 114 than the forming machine 100. However, the machine 150 does not include the plungers 120, tail arms 130 or end punches 140 of the forming machine 100.

Column Member Forming Machine

FIGS. 81 to 83 show views of the column member 30. The column member 30 comprises a truncated "A" form section comprising sloping walls 32 which depend and diverge from a flat strip or cap 33. The column member 30 includes substantially parallel flanges 34 with angled outturns 35 and arrays of holes 31 in the cap 33, the walls 32 and the flanges 34.

Figures 84, 85:
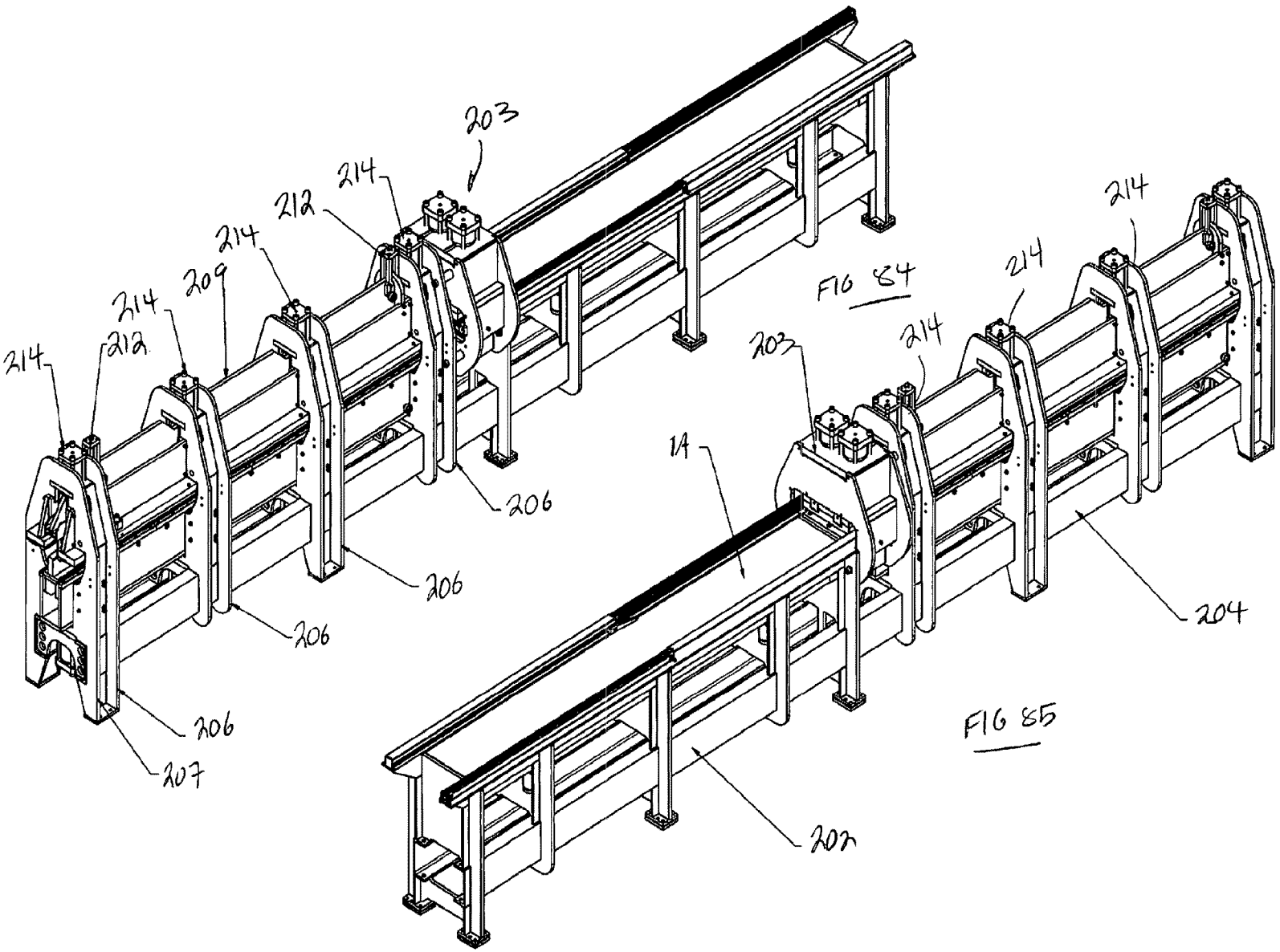
FIGS. 84 and 85 are isometric views of a forming machine for forming the column member of FIG. 81.
Figure 87:
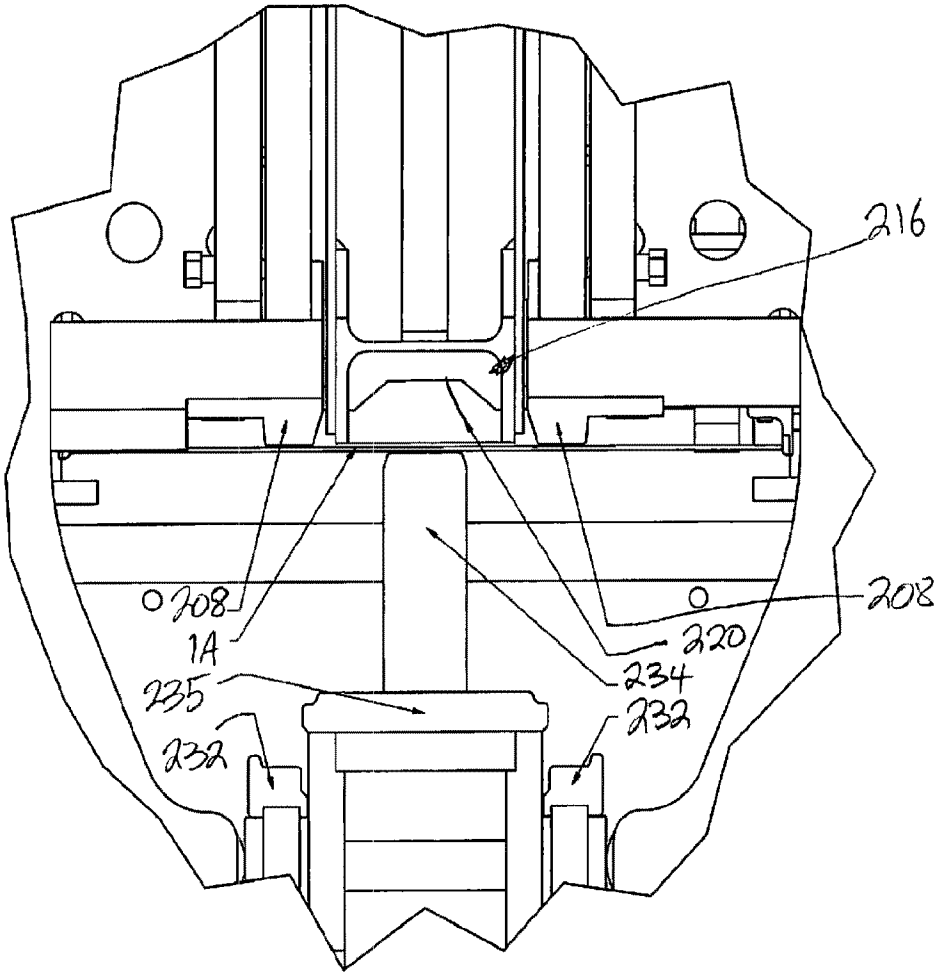
FIG. 87 is a view taken at detail C of FIG. 86.
Figure 86:
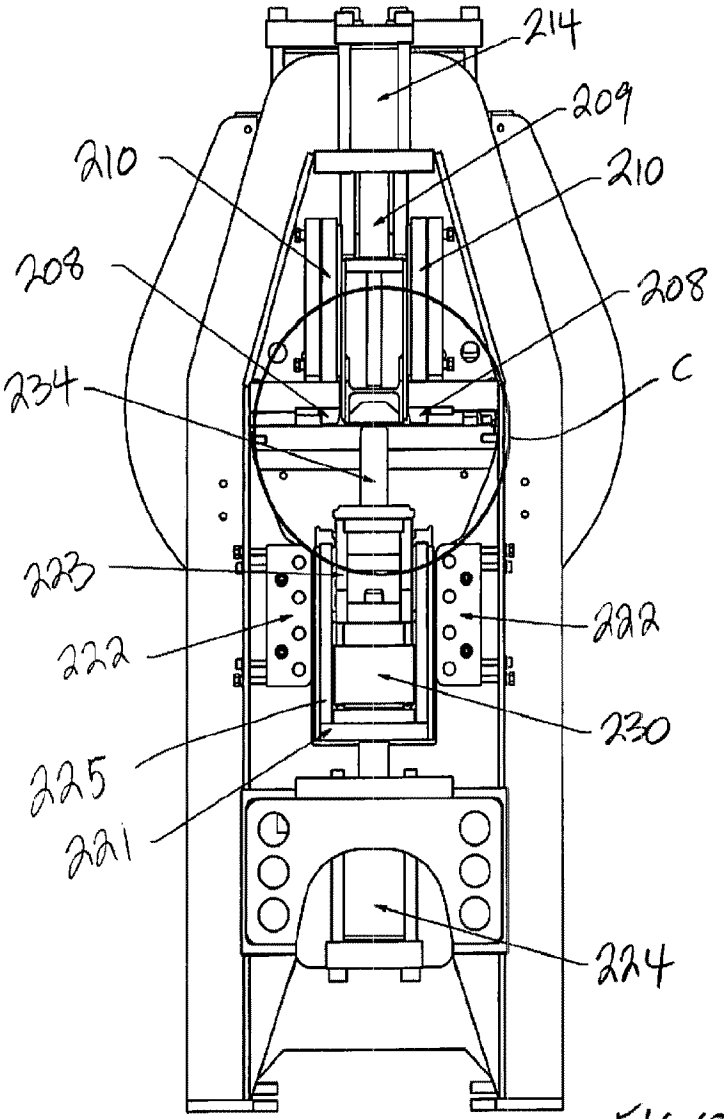
FIG. 86 is an end view of the forming machine of FIG. 84 during a first stage of operation thereof.
Figure 89:
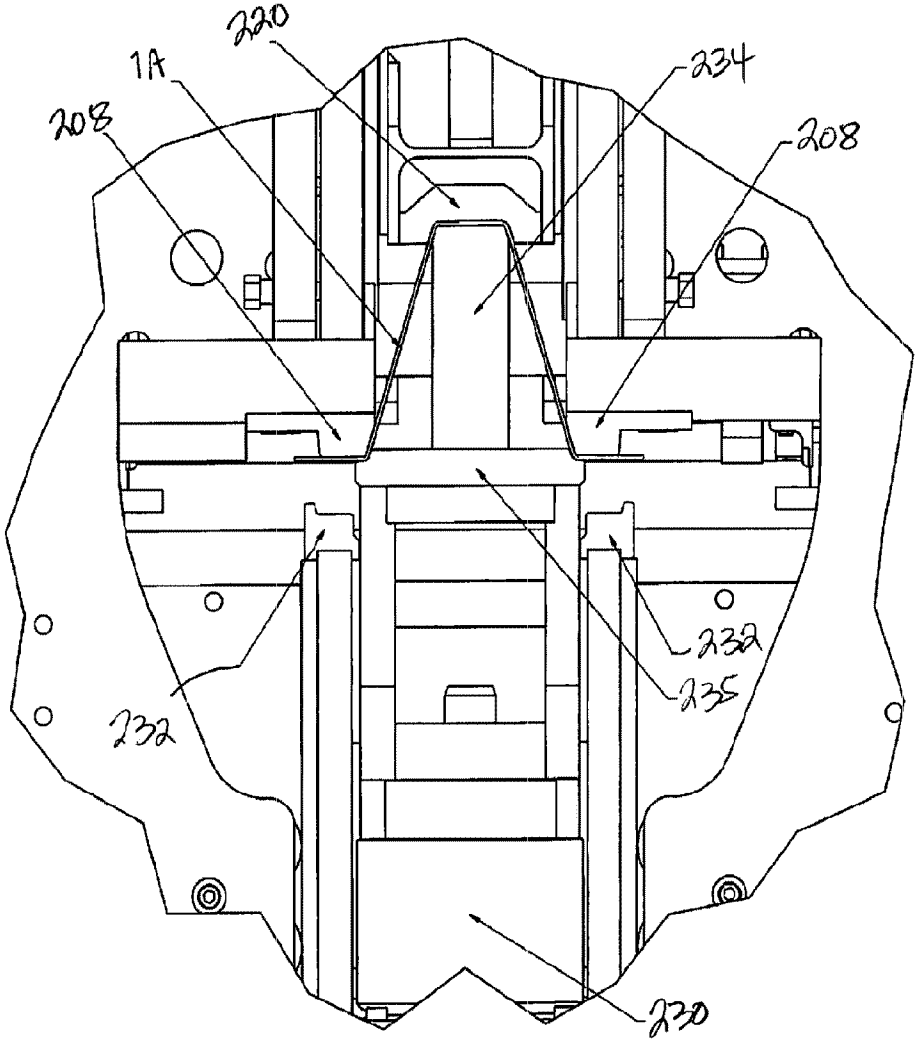
FIG. 89 is a detail view of the forming machine during a third stage of operation thereof.
Figure 88:
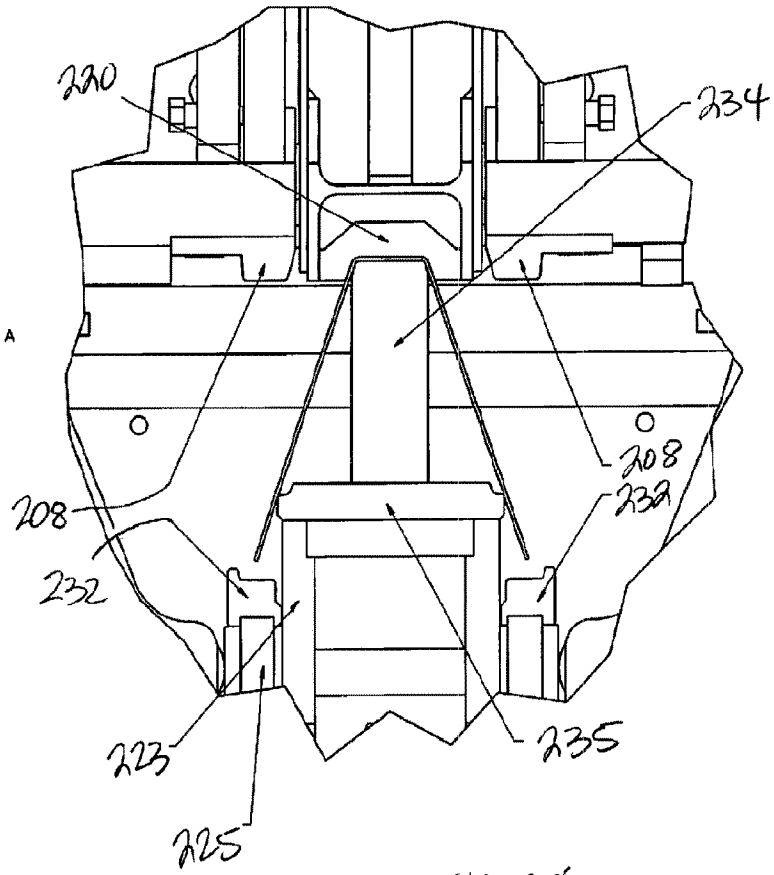
FIG. 88 is a detail view of the forming machine during a second stage of operation thereof.

Referring to FIGS. 84 and 85, there is shown a forming machine 200 for forming a blank of material into the column member 30.

The forming machine 200 comprises a material magazine 202 and a forming section 204. The forming section 204 comprises four spaced journals 206 mounted on a number of through beams, so as to feed material into the forming section 204. The magazine 202 butts directly onto the forming section 204 and forms a structural part of the whole base frame of the machine 200.

A punching station 203 is positioned at a feed end of the forming section 204 and is operable to punch openings or holes into stock to form the holes 31 of the column member 30.

The journals 206 support two outer fixed dies 208 that complete the outturns 35 on the completed "truncated—A" form. The journals 206 also support and house an upper die support beam 209. The upper die support beam 209 is aligned and supported by control elements 210 within the journals and rests on control stops 212 at each end of the machine. The support beam 209 is able to move upwards under the control of an actuator 214 placed in the head of each of the four journals 206. The actuators 214 allow for the controlled vertical movement of the upper die support beam 209. Within the support beam 209 is a longitudinal space 216 that houses an upper die 220. The die 220 is of a semi resilient material.

A lower beam 221 is supported by side control elements 222 where it passes through each journal and in turn rests on upward facing actuators 224. The lower beam 221 is comprised of an inner and outer members. The inner member is moveably supported within the outer member on a number of actuators 230. The inner member supports a lower die 234 which, together with the upper die 220, determines the angle of the truncated "A" form. By cooperating with the upper die 220, the lower inner and outer members of the lower beam form the column member 30 as described below.

At the start of the forming process the upper die 220 is constrained to its bottom home position, providing a material thickness between itself and the bottom die 234. The lower die actuators 224 drive the lower die 234 upwards into the resilient upper die 220 to form the bends at the lateral edges of the cap 33 of the column member 30. The constraint of the upper die 220 is then relaxed and the upper and lower dies 220, 234 move down together until a lower outer die 235 closes onto the upper outer fixed die 208, so completing the second bend of the "A" form, forming the flanges 34. Lower die inner actuators 230 are now enabled to collapse which allows the outer lower dies 232 to close onto the upper fixed dies 208 to form the outturns 35 along each side of the "A" form.

Operation of a forming machine 200 for forming column members 30 may be at least partially automated by use of a programmable logic controller (PLC) running a program.

A blank 1A is fed between the top and bottom dies 208 and 234. Where feeding of the blank 1A is automated, sensors may be employed to sense the presence of the blank 1A and commence operation of the machine 200. Where feeding of the blank 1A is performed manually, commencement of operation will likely be contingent upon the closing of a guard (not illustrated).

The punching station 203 pre-forms the bolt holes in sheet 1A in stages as it passes from the magazine 204 into the "A" forming part of the machine 202 of the machine. This will result in the forming of the many holes 31, and other features on the web 33 of the part 30.

Figure 93:
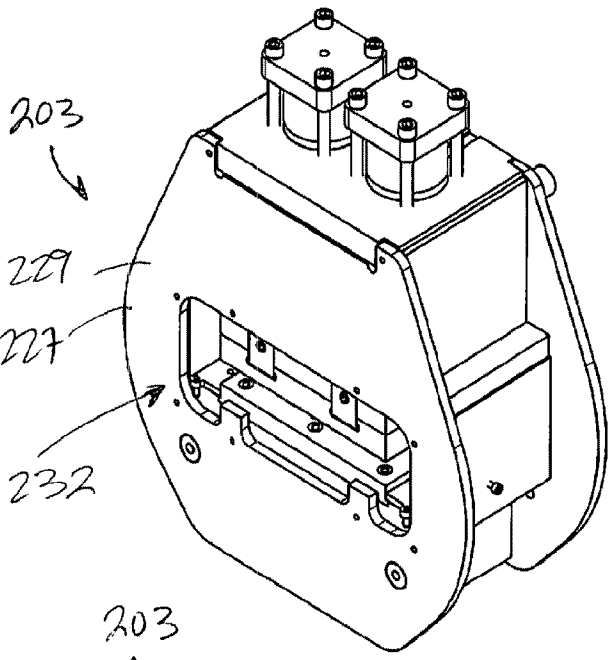
Figure 94:
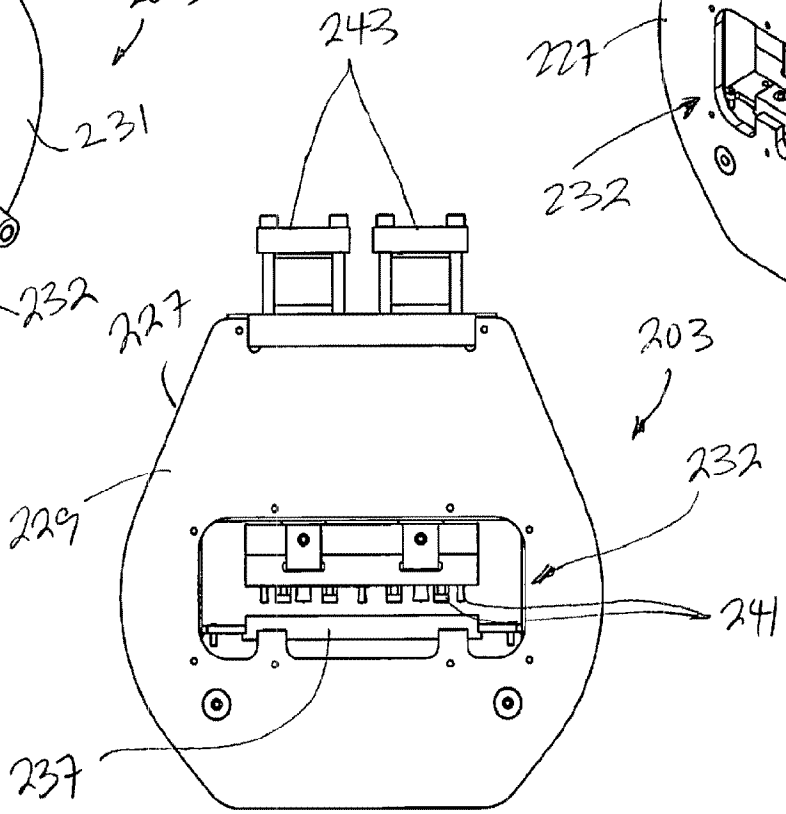
Figure 96:
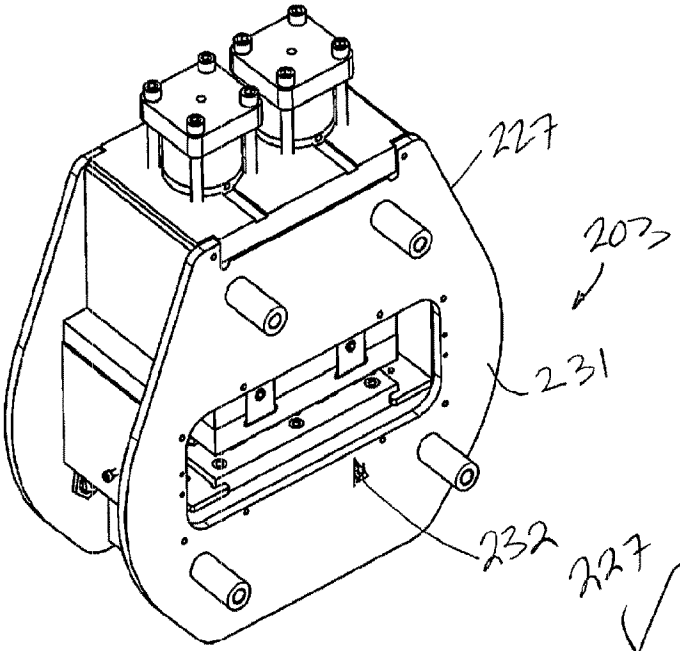
FIG. 96 shows a second stage in the operation of part of the forming machine that forms the side flange of the spreader.
Figure 96:
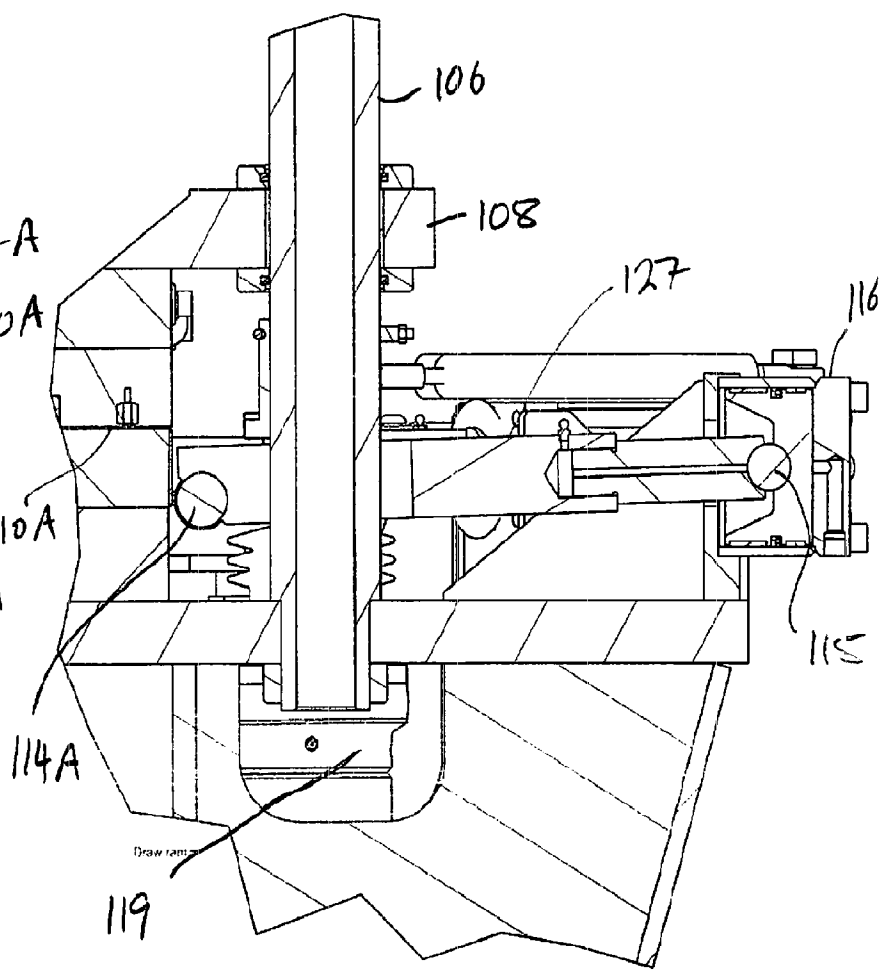
Figure 95:
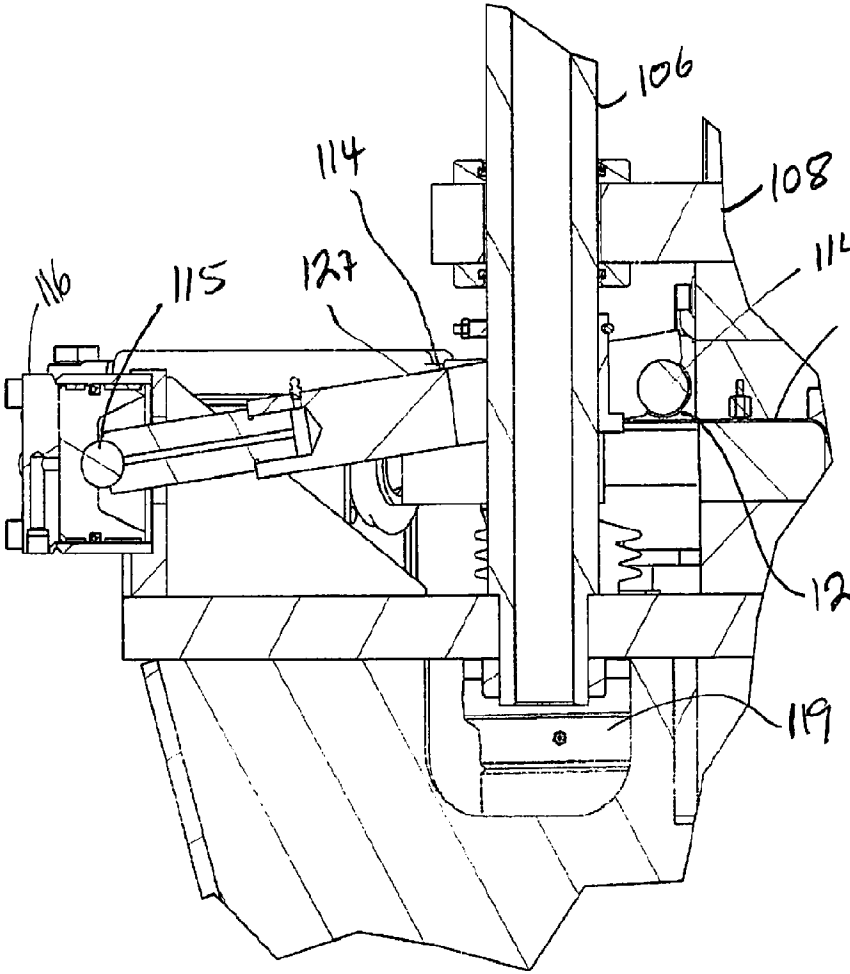
FIG. 95 shows a first stage in the operation of part of the forming machine that forms a side flange of the spreader.
Figure 97:
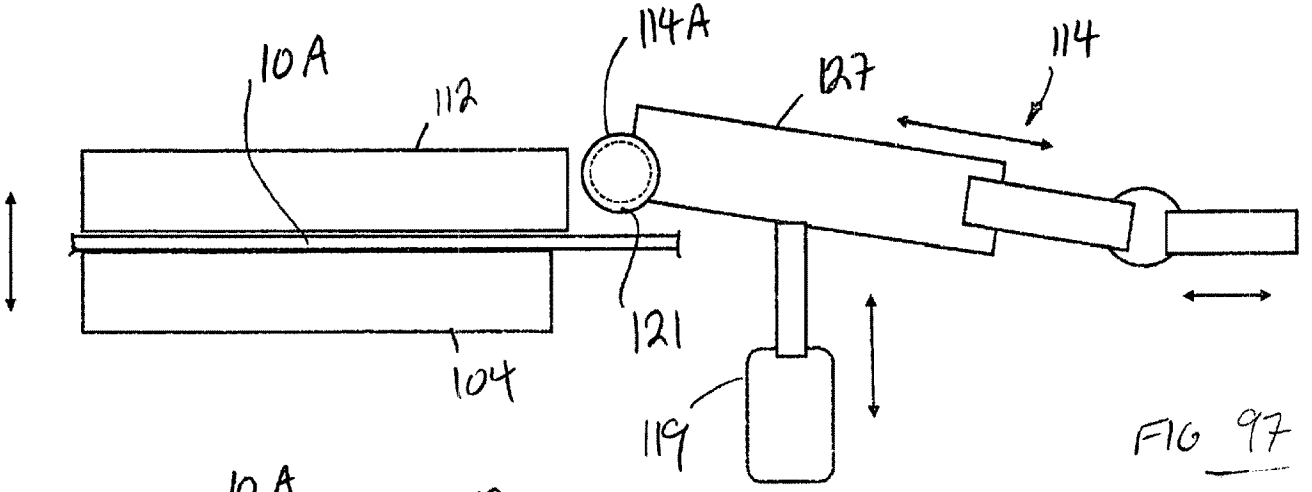
FIG. 97 shows a schematic view of a first stage in an operation to form a side flange of a spreader.
Figure 98:
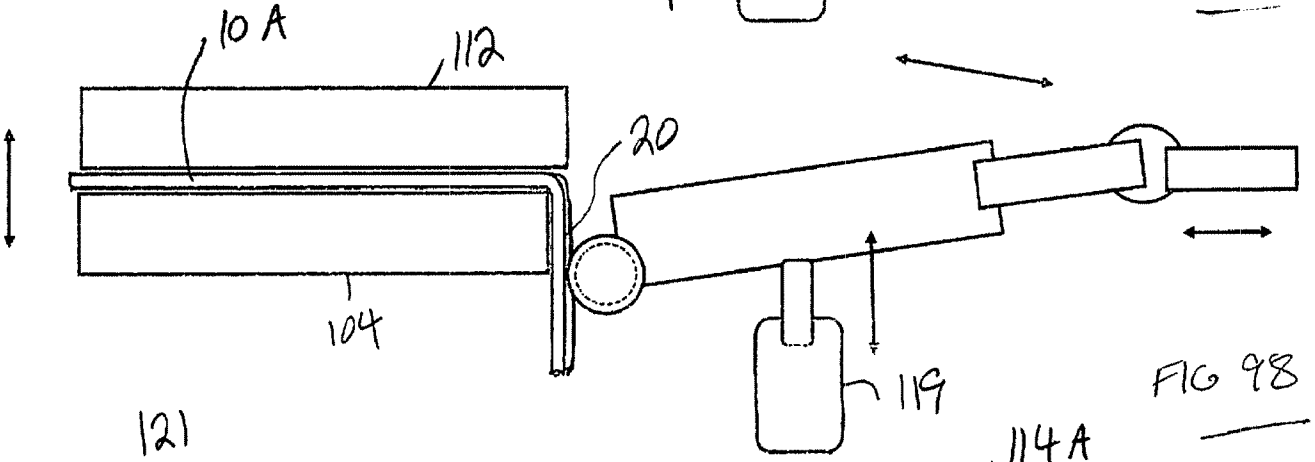
FIG. 98 shows a schematic view of a second stage in the operation of FIG. 88.
Figure 99:
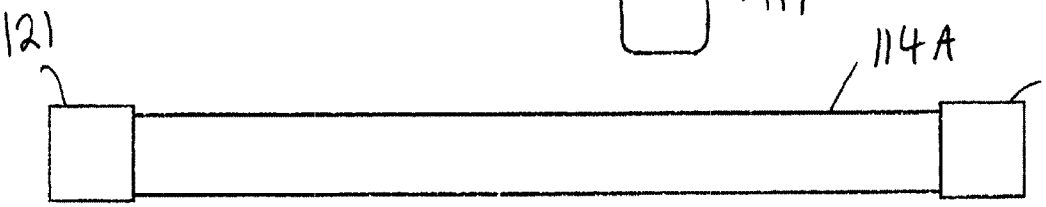
FIG. 99 shows a schematic of a draw tool used in the operation to form the side flange of the spreader.

Detail of the punching station 203 can be seen in FIGS. 92 to 94. The punching station 203 has a housing 227. The housing 227 defines an entry wall 229 and an exit wall 231. Both walls 229, 231 have openings 232 to permit the passage of the blank 1 A.

A bed 237 is mounted on a suitable support structure in the housing 203 for supporting the blank 1 A. A punching head 239 is mounted in the housing to be vertically reciprocally displaceable with respect to the bed 237. A series of punching dies 241 mounted on the head so that when the head 237 is driven reciprocally, the punching dies 241 can carry out a punching operation on the blank 1 A to form the holes 31 in the blank.

A pair of actuators 243 also mounted on the housing to drive the head 237.

The forming machine 200 performs a number of sequential functions in close order, but for reasons of distribution and portability the desired machine is as small and compact as possible. The forming machine 200 could be mounted to a truck bed or tray, or to a trailer for towing behind a vehicle. In this way, column members 30 could be formed at a building site.

All of the actuators referenced herein could be hydraulic cylinders. However, in cases where alternate actuator types (such as electric or pneumatic actuators) can deliver the required force to perform the relevant operation, then these may be employed.

Formation of Flanges for Spreader

As described earlier, the flanges 14 of the spreader 10 are bent or formed so that the portions 20 can be received between the flanges 4 of the beam members 1 without the need for packing or washers. In particular, the flanges 14 are formed so that an overall width of the portion 20 is reduced by an extent which is twice the width of the material used for the associated beam 1. Also, flanges 18 of the spreader 10 are bent or formed to accommodate the tab 23 such that the flanges 18 present a flat surface for hearing or butting against the web 2 of the beam members 1.

FIGS. 95 to 99 indicate a principle of operation that is employed to generate or form the flanges 14, 18. With reference to the preceding drawings, like reference numerals refer to like parts, unless otherwise specified. The use of the common numerals is not intended to indicate that the parts or components referred to in the preceding drawings are somehow essential to the structures shown in FIGS. 90 to 94.

The flipper 114 is mounted on the horizontal flipper actuator 116 with a spherical steel bearing 115. This facilitates pivotal movement of an arm 117 of the flipper 114. The vertical movement of the flipper actuator 118 is operated with a draw ram 119.

Figure 91:
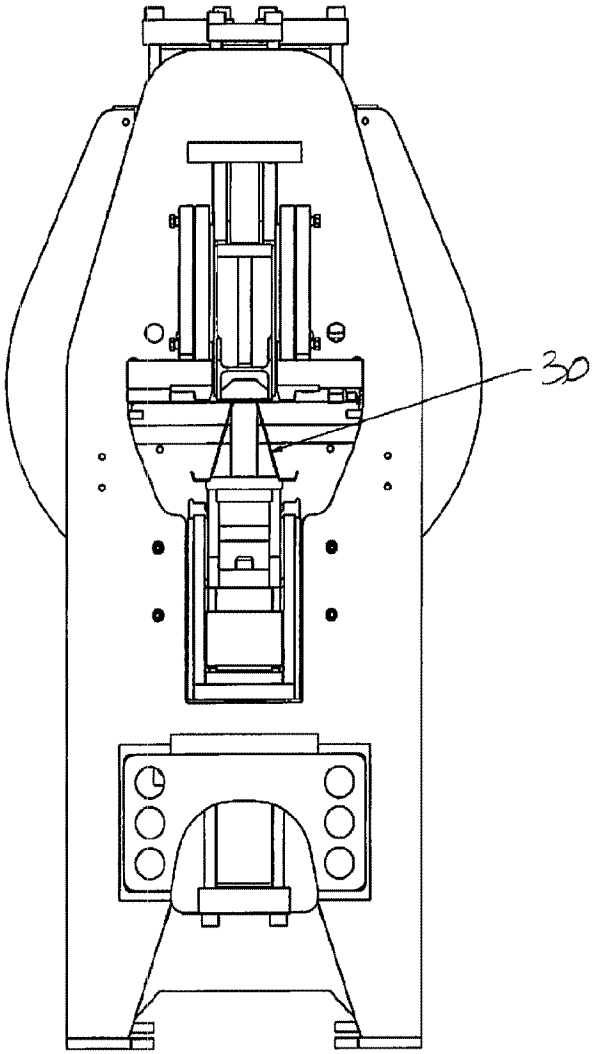
FIG. 91 is an end view of the forming machine after completion of the fourth stage of operation thereof.
Figure 90:
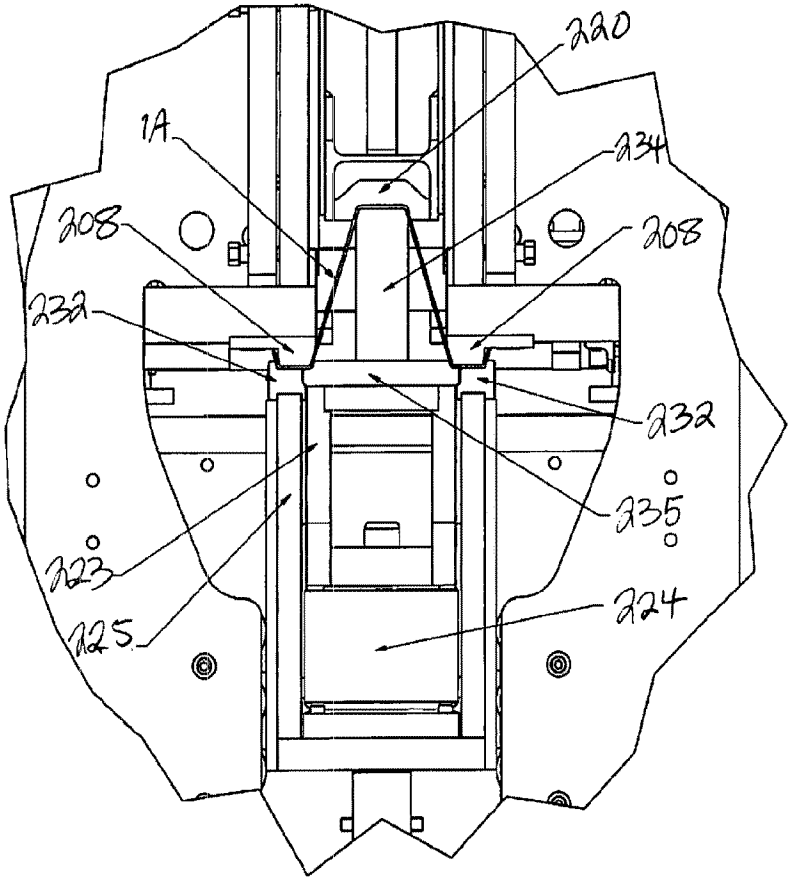
FIG. 90 is a detail view of the forming machine during a fourth stage of operation thereof.

In FIG. 90, the flipper 114 is shown in an up position prior to a drawing process to be performed on the blank. In FIG. 91, the flipper 114 is in a down position subsequent to the drawing process.

In the transition between the up and down positions, the tool 114A acts on the blank to form the flange 14. This process is indicated schematically in FIGS. 92 and 93. The setback of the bottom die 104 relative to the upper die 102 can be seen in these drawings.

Figures 9, 10:
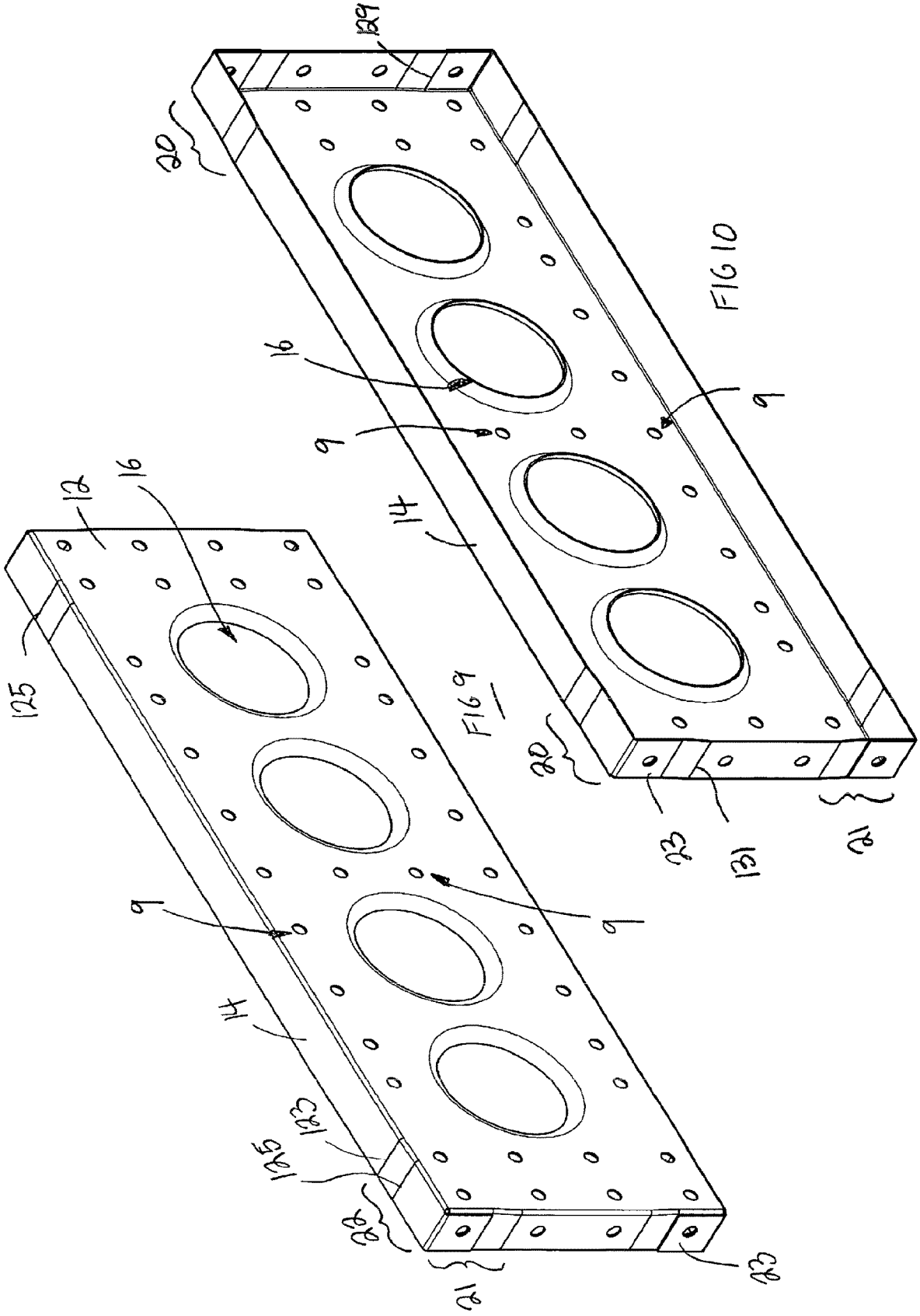
FIG. 9 is an isometric view of the spreader member from one side.
FIG. 10 is an isometric view of the spreader member from another side.

The tool 114A has enlarged end portions 121. A length of these end portions 121 corresponds generally with a length of the portions 20 of reduced width of the spreaders 10. It follows that operation of the flippers 114 results in fold lines 123, 125 of the spreader 10 (FIGS. 9, 10).

It is relevant to note that the tool 114A does not rotate relative to the flipper body 127. Thus, the tool 114A carries out a drawing process on the blank to form the associated flange 14.

As indicated, schematically, the draw ram 119 provides the necessary pivotal movement of the tool 114A in a vertical plane. The horizontal flipper actuator 116 provides the necessary horizontal movement of the tool 114A to generate sufficient horizontal force such that the fold lines 123, 125 are formed in the drawing process.

As described above, the flanges 18 are formed in a similar manner using the plungers 120 and the actuators 122, 124 and 126, all of which drive the tools 120A in the same way as the tool 114A is driven. Thus, fold lines 129, 131 are formed in the flange 18 (FIGS. 9, 10) to accommodate the tabs 23 so that the tabs 23 and the flange 18 present a flat surface for abutment against an inner surface of the web 2.

Application of Building System

The inventor envisages that the method illustrated in FIGS. 22 to 45 can readily be carried out without a level of skill usually required for building dwellings and other permanent structures. It is clear from the above description that the frame assemblies 50 are fabricated or assembled from similar components. Furthermore, the forming machines described above have a relatively low width to length requirement since they are configured for forming strips of metal. As a result, the forming machines can be conveyed in a relatively compact manner, for example, by segmenting the machines in a modular fashion and placing modules side-by-side on a transport bed or in a container.

Thus, in a proposed application, the forming machines are conveyed to an area in which building structures are to be erected using the frame assemblies described above. During the process or method illustrated in FIGS. 20 to 43, the forming machines can be used on site to fabricate the components required for the frame assemblies.

It is relevant to note that all the components, apart from fasteners, of the frame assembly can be fabricated from a sheet or strip of steel. It follows that, together with the forming machines and the steel, the provision of further equipment to a building site is limited. On the other hand, with conventional or existing building systems, a wide variety of different components are required to be provided to the building site. It follows that the logistics and sourcing of materials for conventional or existing building systems can be more complicated than as operations carried out in connection with the present building system.

The various components, particularly the beam and spreader members are modular in nature. It follows that they can be connected together using a common bolt and nut combination. A typical example of such a bolt and nut combination would be one in which a head and a nut both incorporate a flange such that the parts of the components can be sandwiched between the flanges. As described above, the components are assembled without the need for washers or flanges. It follows that it is not necessary to use washers with the bolt and nut combinations.

The inventor envisages that the forming machines described above can be used to punch and form the relevant components from standard sheet or coil stock. It is relevant that the forming machines are not roll formers. Roll formers cannot conveniently be conveyed as can reciprocating machines such as the forming machines described above. The forming machines can be configured to function in a range of conditions, such as in solar-powered container-based arrangements or, where possible, in a traditional factory arrangement. The possibility of using the forming machines in shipping containers enhances the ability to transport the shipping machines to locations where the building method described herein can be practised or carried out.

It is to be understood that a variety of different sheet metal sizes can be used, depending on requirements and on the ability to form the material. For example, a suitable thickness may be anywhere between 1 mm and 8 mm, for example, between about 1 mm and 6 mm. The dimensions of the beams 1 and spreaders 10 can vary depending on the required application and various structural requirements.

According to calculations and investigations carried out by the inventor, the spreader and beam members can be fabricated by forming machines with a power output of about 3 hp. This results in components being fabricated at about 1 to 2 minutes per part. At that rate, the inventor envisages that all the spreader and beam members required for the first floor of the structure of the building described above could be provided within five hours. As result, it is expected that an entire frame for the building described above could be erected within 3 to 4 days.

It follows that, broadly, an exemplary embodiment of a method of building would include transporting forming machines to a building site, forming a strip of steel into the various components required for the base assembly and erecting a building or structure using a number of the base assemblies.

It is also relevant to note that there is described herein a process for forming a spreader with uniformly flush end faces and side faces that are capable of cooperating with C-shaped beams in a frame assembly to present a uniformly flush or level surface for the assembly of a floor on the surface without the need for packing to accommodate discontinuities.

In this description, reference has been made to steel sheet. The inventor envisages that the operations described above can be carried out on other materials that are capable of being formed in a similar manner. These could include other metals.

Throughout the specification, including the claims, where the context permits, the term "comprising" and variants thereof such as "comprise" or "comprises" are to be interpreted as including the stated integer or integers without necessarily excluding any other integers.

It is to be understood that the terminology employed above is for the purpose of description and should not be regarded as limiting. The described embodiments are intended to be illustrative of the invention, without limiting the scope thereof. The invention is capable of being practised with various modifications and additions as will readily occur to those skilled in the art.

Various substantially and specifically practical and useful exemplary embodiments of the claimed subject matter are described herein, textually and/or graphically, including the best mode, if any, known to the inventor for carrying out the claimed subject matter. Variations (e.g., modifications and/or enhancements) of one or more embodiments described herein might become apparent to those of ordinary skill in the art upon reading this application. The inventor expects skilled artisans to employ such variations as appropriate, and the inventor intends for the claimed subject matter to be practiced other than as specifically described herein. Accordingly, as permitted by law, the claimed subject matter includes and covers all equivalents of the claimed subject matter and all improvements to the claimed subject matter. Moreover, every combination of the above described elements, activities, and all possible variations thereof are encompassed by the claimed subject matter unless otherwise clearly indicated herein, clearly and specifically disclaimed, or otherwise clearly contradicted by context.

The use of any and all examples, or exemplary language (e.g., "such as") provided herein, is intended merely to better illuminate one or more embodiments and does not pose a limitation on the scope of any claimed subject matter unless otherwise stated. No language in the specification should be construed as indicating any non-claimed subject matter as essential to the practice of the claimed subject matter.

The use of words that indicate orientation or direction of travel is not to be considered limiting. Thus, words such as "front", "back", "rear", "side", "up", down", "upper", "lower", "top", "bottom", "forwards", "backwards", "towards", "distal", "proximal", "in", "out" and synonyms, antonyms and derivatives thereof have been selected for convenience only, unless the context indicates otherwise. The inventor envisages that various exemplary embodiments of the claimed subject matter can be supplied in any particular orientation and the claimed subject matter is intended to include such orientations.

Thus, regardless of the content of any portion (e.g., title, field, summary, description, abstract, drawing figure, etc.) of this application, unless clearly specified to the contrary, such as via explicit definition, assertion, or argument, or clearly contradicted by context, with respect to any claim, whether of this application and/or any claim of any application claiming priority hereto, and whether originally presented or otherwise:

a. there is no requirement for the inclusion of any particular described or illustrated characteristic, function, activity, or element, any particular sequence of activities, or any particular interrelationship of elements;
b. no characteristic, function, activity, or element is "essential";
c. any elements can be integrated, segregated, and/or duplicated;
d. any activity can be repeated, any activity can be performed by multiple entities, and/or any activity can be performed in multiple jurisdictions; and
e. any activity or element can be specifically excluded, the sequence of activities can vary, and/or the interrelationship of elements can vary.

The use of the terms "a", "an", "said", "the", and/or similar referents in the context of describing various embodiments (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted.

Moreover, when any number or range is described herein, unless clearly stated otherwise, that number or range is approximate. Recitation of ranges of values herein are merely intended to serve as a shorthand method of referring individually to each separate value falling within the range, unless otherwise indicated herein, and each separate value and each separate sub-range defined by such separate values is incorporated into the specification as if it were individually recited herein. For example, if a range of 1 to 10 is described, that range includes all values therebetween, such as for example, 1.1, 2.5, 3.335, 5, 6.179, 8.9999, etc., and includes all subranges therebetween, such as for example, 1 to 3.65, 2.8 to 8.14, 1.93 to 9, etc.

Accordingly, every portion (e.g., title, field, background, summary, description, abstract, drawing figure, etc.) of this application, other than the claims themselves, is to be regarded as illustrative in nature, and not as restrictive, and the scope of subject matter protected by any patent that issues based on this application is defined only by the claims of that patent.

The invention claimed is:

1. A forming machine for forming, from a metal sheet, a spreader member of a frame system for a building structure, the forming machine comprising:

a base;

a platform positioned above the base;

a top die arranged on the platform;

a bottom die supported by the base and operatively arranged with respect to the top die, the top and bottom dies being reciprocally displaceable relative to each other to punch apertures and notches or cuts in the sheet;

two side flange formers arranged on the base, one on each of two opposed sides of the bottom die, configured to form side flanges of the spreader member having a planar form, wherein the planar form of one of the side flanges extends parallel to the planar form of the other of the side flanges, wherein the two side flange formers are configured to actuate horizontally and vertically, wherein each of the two side flange formers is connected to horizontal and vertical side flange former actuators for horizontal and vertical actuation of each of the two side flange formers such that the two side flange formers are configured to fold sides of the metal sheet to form the side flanges of the spreader member that are parallel to one another; and two end flange formers arranged on the base, one at each of two opposed ends of the bottom die, configured to form end flanges of the spreader member having a planar form, wherein the planar form of one of the end flanges extends parallel to the planar form of the other of the end flanges, wherein each of the two end flange formers are configured to actuate horizontally and vertically, wherein each of the two end flange formers is connected to end flange former actuators for horizontal and vertical actuation of each of the two end flange formers such that the two end flange formers are configured to fold ends of the metal sheet to form the two end flanges of the spreader member that are parallel to one another.

2. The forming machine of claim 1, wherein the two side flange formers incorporate a die former that is shaped so that, upon operation of the two side flange formers, the die former can carry out an operation on the sides of the metal sheet retained between the top and bottom dies to bend the side flanges so that at least one end portion of the spreader member has a reduced width.

3. The forming machine of claim 1, wherein the two end flange formers incorporate a die former that is shaped so that, upon operation of the two end flange formers, the die former can carry out an operation on the ends of the metal sheet so that a resultant end flange of the spreader member has inwardly extending zones to accommodate tabs that extend from the side flanges such that, when the tabs are folded inwardly, the end flanges and the tabs present a substantially flat surface.

4. The forming machine of claim 3, in which the base supports four tail arms, two for each end of the die, each tail arm being driven between a home position and a forming position with a tail arm actuator, such that, when the tails arms are actuated, they fold the tabs inwardly such that the end flanges and the tabs present a substantially flat surface.

5. The forming machine of claim 1, including columns extending vertically from the base to support the platform in a suspended position above the bottom die.

6. The forming machine of claim 1, including top die actuators mounted on the platform, the actuators being configured to drive, reciprocally, the top die between a home position and a forming position.

7. The forming machine of claim 1, in which the horizontal side flange former actuators move the side flange formers horizontally, and the vertical side flange former actuators move the side flange formers vertically.

8. The forming machine of claim 7, in which the horizontal and vertical side flange former actuators are configured to act cooperatively to move the side flange formers between a home position and a forming position.

9. The forming machine of claim 1, in which the actuators for horizontal and vertical actuation of each end flange former include actuators for driving the end flange formers between a home position and a forming position, and an actuator for returning the end flange formers to the home position.

10. The forming machine of claim 3, in which the base supports two end punches, one for each end of the bottom die, the punches configured for punching holes in the end flanges and tabs.

11. The forming machine of claim 10, in which each end punch is actuated by an end punch actuator for driving the end punch between a home position and a punching position.

12. The forming machine of claim 1, in which the forming machine is configured to be mounted to a towing vehicle for road transport.

13. A method of forming a spreader member of a frame system for a building structure, from a metal sheet, using the forming machine as claimed in claim 1, the method comprising:

feeding a blank between the top and bottom dies;

moving the top die onto the bottom die to form holes and other features on a web of the spreader member such that the flanges and tabs are in a pre-bent condition subsequent to operation of the closure of the top die onto the bottom die;

actuating the side flange formers to bend sides of the metal sheet to form the side flanges of the spreader member; and actuating the end flange formers to bend ends of the metal sheet to form the end flanges of the spreader member.

14. The method of claim 13, in which the step of bending the sides of the sheet to form the side flanges is carried out so that at least one end portion of the resultant spreader member has a length that is greater than a depth of flanges of corresponding beam members and is of a reduced width to permit the end portion to fit and to extend between the flanges of beam members.

15. The method of claim 13, in which the step of bending the sides of the sheet to form the side flanges is carried out so that at least one end portion of the resultant spreader member fits between flanges of corresponding beam members with the flanges of the beam members and the spreader member being substantially co-planar.

16. The method of claim 13, in which the end flange formers incorporate a die former, the method including the step of actuating the end flange formers so that the die former carries out an operation on the ends of the metal sheet so that the end flanges of the spreader member have inwardly extending zones to accommodate tabs that extend from the side flanges such that, when the tabs are folded inwardly, the end flanges and the tabs present a substantially flat surface.

* * * * *